United States Patent [19]

Seto et al.

[11] Patent Number: 5,068,172

[45] Date of Patent: Nov. 26, 1991

[54] SILVER HALIDE COLOR PHOTOGRAPHIC MATERIALS

[75] Inventors: Nobuo Seto; Masakazu Morigaki; Hideaki Naruse, all of Kanagawa, Japan

[73] Assignee: Fuji Photo Film Co., Ltd., Kanagawa, Japan

[21] Appl. No.: 482,070

[22] Filed: Feb. 20, 1990

[30] Foreign Application Priority Data

Feb. 20, 1989 [JP] Japan ..... 1-38304

[51] Int. Cl.[5] ..... G03C 7/32

[52] U.S. Cl. ..... 430/551; 430/558

[58] Field of Search ..... 430/551, 558

[56] References Cited

U.S. PATENT DOCUMENTS

| | | | |
|---|---|---|---|
| 4,452,884 | 6/1984 | Leppard | 430/551 |
| 4,465,757 | 8/1984 | Leppard et al. | 430/216 |
| 4,465,765 | 8/1984 | Leppard et al. | 430/512 |
| 4,496,649 | 1/1985 | Leppard et al. | 430/372 |
| 4,518,679 | 5/1985 | Leppard et al. | 430/372 |
| 4,540,654 | 9/1985 | Sato et al. | 430/381 |
| 4,558,131 | 12/1985 | Leppard et al. | 430/551 X |
| 4,621,046 | 11/1986 | Sato et al. | 430/381 |
| 4,629,682 | 12/1986 | Leppard et al. | 430/372 |
| 4,748,100 | 5/1988 | Umemoto et al. | 430/505 |
| 4,857,444 | 8/1989 | Hirose et al. | 430/505 |
| 4,863,842 | 9/1989 | Kaneko et al. | 430/551 |
| 4,865,963 | 9/1989 | Furutachi et al. | 430/558 |

FOREIGN PATENT DOCUMENTS

| | | | |
|---|---|---|---|
| 178794 | 4/1986 | European Pat. Off. | 430/551 |
| 0226849 | 7/1987 | European Pat. Off. . | |
| 0234783 | 9/1987 | European Pat. Off. . | |

*Primary Examiner*—Charles L. Bowers, Jr.
*Assistant Examiner*—Janet C. Baxter
*Attorney, Agent, or Firm*—Birch, Stewart, Kolasch & Birch

[57] ABSTRACT

A silver halide color photographic material wherein at least one coupler selected from the group consisting of the compounds represented by the following general formulae (I) and (II), at least one compound represented by the following general formula (III) and at least one compound represented by the following general formula (IV) are included in the same layer, Formula (I)

and

Formula (II)

Formula (III)

Formula (IV)

wherein the values of R, $R_1$, $R_2$, $R_3$, $R_4$, $R_5$, $R_6$, $R_7$, $R_8$, $R_9$, $R_{10}$, $R_{11}$, $R_{12}$, A and X are defined in the specification. The photographic materials disclosed exhibit outstanding image storage stability, a decreased occurrence of stain in unexposed portions and a decreased occurrence of color fading by light in their magenta image.

11 Claims, No Drawings

SILVER HALIDE COLOR PHOTOGRAPHIC MATERIALS

FIELD OF THE INVENTION

This invention relates to silver halide color photographic materials, and in particular it relates to silver halide color photographic materials in which color fading in the magenta image and color changes in the non-image portions (referred to as the white-background hereinafter) are prevented.

BACKGROUND OF THE INVENTION

It is well known that color images are formed when exposed silver halides are used as oxidants and couplers and oxidized primary aromatic amine-based color developers react to produce indophenol, indoaniline, indamine, azomethine, phenoxazine, phenazine and other similar dyes.

Of these, 5-pyrazolone, cyanoacetophenone, indazolone, pyrazolobenzimidazole and pyrazolotriazole based couplers are used to form magenta images.

Hitherto, it has largely been the 5-pyrazolones for which studies have been most advanced and which have been most widely supplied as magenta color image forming couplers. However, it is known that with dyes formed by 5-pyrazolone-based couplers, there is unwanted absorption having a yellow component in the vicinity of 430 nm and that this is a cause of color contamination.

By way of magenta color image forming skeletons in which this yellow component has been reduced, there have been proposals for a pyrazolobenzimidazole skeleton as described in G.B. Patent 1,047,612, an indazolone skeleton as described in U.S. Pat. No. 3,770,447 and a pyrazolo[5,1-c]-1,2,4-triazole skeleton as described in U.S. Pat. No. 3,725,067.

However, the magenta couplers described in these patents are still unsatisfactory in that, when they are mixed into the silver halide emulsion in a form whereby they have been dispersed in a protective hydrophilic colloid such as gelatin, they provide no more than an unsatisfactory color image, their solubility in high-boiling organic solvents is poor, they are difficult to synthesize, they have no more than a relatively low coupling activity in common developers and the light fastness of the dye is extremely low.

As a result of diverse studies into novel types of magenta color image couplers which do not exhibit secondary absorption in the vicinity of 430 nm, which is the largest problem in terms of the hue of 5-pyrazolone-based couplers, the present inventors discovered the 1H-pyrazolo[1,5-b]-1,2,4-triazole magenta couplers disclosed in JP-A-59-171956 (the term "JP-A" as used herein means an "unexamined Japanese patent application") and U.S. Pat. No. 4,540,654 which do not exhibit secondary absorption on the shorter wavelength side, for which the fastness of the dye is high and which are easy to synthesize. These couplers have the distinguishing features that they are outstanding in terms of color reproduction and outstanding in their synthesizability, that they can be made what is known as 2-equivalent by introducing an eliminating group in the coupling active position and it is possible to reduce the amount of silver used.

Nevertheless, there are the problems that the color-forming property of these couplers is low and that there are major changes in photographic properties which accompany variations in processing solution constituent concentrations during continuous processing (for example sulfite ions, hydroxylamine derivatives and the like which are added to developing solutions as antioxidants for color developing agents).

The 1H-pyrazolo[5,1-c]-1,2,4-triazole and 1H-pyrazolo[1,5-b]-1,2,4-triazole magenta couplers in which the 6-position has been substituted with an alkyloxy group or an aryloxy group as described in JP-A-62-209457 are known as means of overcoming these problems, and it is understood that the color-forming properties are improved and that variations in the photographic properties during continuous processing are markedly inhibited when using these couplers. However there are the problems that staining (an increase in the density of white-base portions) is exacerbated by aging after processing and that the light fastness of the azomethine dyes which are formed from these couplers is markedly reduced.

Staining is undesirable in silver halide color photographic materials not only because it determines the quality of the transparent image portion of the image but also because it worsens the color in the color image and detracts from the visual sharpness. With reflective materials (such as color papers) in particular, the reflected density of the stain will in theory be accentuated to several times the transmitted density and even the slightest of stains detracts from the picture quality, which constitutes a major problem.

Improvements which make use of the addition of various compounds are undertaken to resolve such problems. For example, JP-B-57-20617 (the term "JP-B" as used herein means an "examined Japanese patent publication"), JP-A-58-114036, JP-A-59-53846, JP-A-59-4-78344, JP-A-59-109052, JP-A-59-113441, JP-A-59-119351, JP-A-59-133543, JP-A-61-4045, JP-A-62-178241, JP-A-62-161150, European Patent 242,211 and other such patents disclose methods using hindered amine-based derivatives and hindered amine-based derivatives which have a hindered phenol within the molecule. However, with the compounds actually described in these patents, the prevention of damp heat staining and of light fading of the dye by the couplers of the inventions is insufficient and some even exert an adverse influence on the photographic properties. Furthermore, JP-A-62-92945, JP-A-62-96944 and JP-A-63-231340 describe examples in which hindered amine-based derivatives are applied to pyrazoloazole-based couplers, but the couplers of these inventions did not exhibit an adequate effect. Moreover, European Patent 218,266 describes similar examples but adequate effects were not exhibited by the couplers actually described in this patent. Again, although the hindered amine-based derivatives described in Japanese Patent Application No. 62-309497 exhibit an effect on stain prevention, they exert an adverse influence on photographic properties such as the speed and color-forming properties and these are not satisfactory compounds. Furthermore, by way of examples in which the light fading of pyrazoloazole couplers is improved by the joint use of two different compounds, there have been disclosures of methods involving the joint use of a hindered amine-based derivative and a hydroquinone derivative as described in JP-A-62-180367, and the joint use of a hindered amine-based derivative and a metal complex as described in JP-A-62-183459. However, even though color fading by light is slightly improved with these methods, they have no effect on damp heat staining and many of them also have an adverse effect on the photographic properties.

In general, pyrazoloazole-based magenta couplers are liable to produce magenta staining upon aging due to chemicals remaining after processing. Compounds for preventing the occurrence of such magenta staining are disclosed in European Patents 255,722, 258,662 and 277,589. These compounds have an effect on the magenta stain which is produced by the remaining chemicals but they are insufficient to prevent the stain (yellowing) which occurs when the couplers degrade With this in mind, there is a desire for techniques which inhibit the increase in stain and inhibit color fading by light and which do not have any adverse effect on the photographic properties.

Accordingly, an object of this invention is to use a pyrazoloazole magenta coupler with an outstanding hue and outstanding color-forming properties to provide color photographic materials with which the color reproduction is outstanding and the increase in stain of the white-base is inhibited and which provide color images with outstanding light fastness.

Another objective of this invention is to provide color photographic materials in which there is essentially no occurrence of the changes in photographic properties which can occur due to aging after taking a photograph.

SUMMARY OF THE INVENTION

As a result of various investigations, the present inventors discovered that the abovementioned objectives are achieved by means of the invention described hereinafter.

The present invention relates silver halide color photographic materials wherein at least one coupler selected from the group consisting of the compounds represented by the following general formulae (I) and (II), at least one compound represented by the following general formula (III) and at least one compound represented by the following general formula (IV) are included in the same layer.

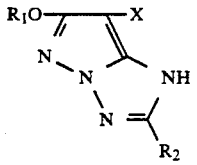

Formula (I)

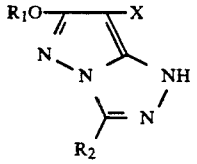

Formula (II)

In the formulae, $R_1$ represents an alkyl group, an aryl group or a heterocyclic group and $R_2$ represents a hydrogen atom or a substituent group. X represents a hydrogen atom or a group eliminated by a coupling reaction.

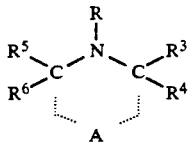

Formula (III)

In the formula, R represents an acyl group, an alkyloxycarbonyl group, aryloxycarbonyl group, alkylsulfinyl group, arylsulfinyl group, alkylsulfonyl group, carbamoyl group, sulfamoyl group or arylsulfonyl group. $R^3$, $R^4$, $R^5$ and $R^6$ may be identical or different and respectively represent alkyl groups. A represents a group of non-metallic atoms necessary to form a 5-membered, 6-membered or 7-membered ring. Here, $R^3$ and $R^4$, $R^5$ and $R^6$, R and $R^3$, and $R^3$ and A may respectively link together to form a 5-membered or 6-membered ring and A, R, or A and R may represent a divalent group to form a dimer or a trimer of the compound represented by formula (III).

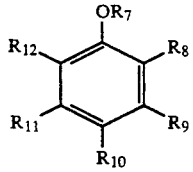

Formula (IV)

In the formula, $R_7$ represents an alkyl group, alkenyl group, aryl group, heterocyclic group or

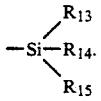

Here, $R_{13}$, $R_{14}$ and $R_{15}$ may be identical or different and respectively represent an alkyl group, alkenyl group, aryl group, alkoxy group, alkenoxy group or aryloxy group. $R_8$, $R_9$, $R_{10}$, $R_{11}$ and $R_{12}$ may be identical or different and respectively represent a hydrogen atom, alkyl group, alkenyl group, aryl group, acylamino group, alkylamino group, alkylthio group, arylthio group, halogen atom or —O—$R_7'$. Where $R_7'$ has the same meaning as $R_7$, $R_7$ and $R_8$ may link together to form a 5-membered ring, 6-membered ring or spiro ring. $R_8$ and $R_9$ or $R_9$ and $R_{10}$ may link together to form a 5-membered ring, 6-membered ring or spiro ring.

The magenta couplers of general formulae (I) and (II) are now described in detail.

$R_1$ represents an alkyl group such as the methyl group, ethyl group, isopropyl group, t-butyl group, trifluoromethyl group, phenylmethyl group, methoxyethyl group, 2-phenoxyethyl group, 2-methylsulfonylethyl group, 2-hydroxyethyl group, 3,3,3-trifluoropropyl group, 2-fluoroethyl group, 2-chloroethyl group, 2-bromoethyl group, 2-cyanoethyl group or 3-oxobutyl group, an aryl group such as the phenyl group, 4-methylphenyl group, 4-t-butylphenyl group, 4-acylaminophenyl group, 4-halogenophenyl group, 4-alkoxyphenyl group or 2-alkoxyphenyl group or a heterocyclic group such as the 2-furyl group, 2-thienyl group, 2-pyrimidinyl group, 2-benzothiazolyl group, 2-pyridyl group, 3-pyridyl group or 4-pyridyl group.

$R_2$ represents a hydrogen atom or a substituent. The substituent has preferably from 1 to 50 carbon atoms in total and preferably includes halogen atom (for example chlorine, bromine), alkyl group [for example a sulfonamido-substituted alkyl group (such as the sulfonamidomethyl group, 1-sulfonamidoethyl group, 2-sulfonamidoethyl group, 1-methyl-2-sulfonamidoethyl group and 3-sulfonamidopropyl group), acylamino-substituted alkyl group (such as the acylaminomethyl group, 1-acylaminoethyl group, 2-acylaminoethyl group, 1-methyl-2-acylaminoethyl group and 3-acylaminopropyl group), sulfonamido-substituted phenylalkyl group (such as the p-sulfonamidophenylmethyl group, p-sulfonamidophenylethyl group, 1-(p-sulfonamidophenyl)ethyl group, p-sulfonamidophenylpropyl group), acylamino-substituted phenylalkyl group (such as the p-acylaminophenylmethyl group, p-acylaminophenylethyl group, 1-(p-acylaminophenyl-)ethyl group, p-acylaminophenylpropyl group), alkylsulfonyl-substituted alkyl group (such as the 2-dodecylsulfonylethyl group, 1-methyl-2-pentadecylsulfonylethyl group and octadecylsulfonylpropyl group), phenylsulfonyl-substituted alkyl group (such as the 3-(2-butyl-5-t-octylphenylsulfonyl)propyl group and 2-(4-dodecyloxyphenylsulfonyl)ethyl group) and other such substituted alkyl groups and the methyl, ethyl, hexyl, dodecyl and other such unsubstituted alkyl groups], aryl group (for example sulfonamidophenyl, acylaminophenyl, alkoxyphenyl, aryloxyphenyl, substituted alkylphenyl, sulfonamidonaphthyl, acylaminonaphthyl and other such substituted aryl groups and phenyl, naphthyl and other such unsubstituted aryl groups), heterocyclic groups (for example 2-furyl, 2-thienyl, 2-pyrimidinyl and 2-benzothiazolyl), cyano group, alkoxy group (for example methoxy, ethoxy, 2-methoxyethoxy, 2-dodecylethoxy and 2-methanesulfonylethoxy), aryloxy group (for example phenoxy, 2-methylphenoxy and 4-t-butylphenoxy), acylamino group (for example acetamido, benzamido, tetradecanamido, α-(2,4-di-t-amylphenoxy)butylamido, γ-(3-t-butyl-4-hydroxyphenoxy)butylamido and α-{4-(4-hydroxyphenylsulfonyl)phenyoxy}decanamido), anilino group (for example phenylanilino, 2-chloroanilino, 2-chloro-5-tetradecanamidoanilino, 2-chloro-5-dodecyloxycarbonylanilino, N-acetylanilino and 2-chloro-5-{α-(3-t-butyl-4-hydroxyphenoxy)-dodecanamido}anilino), ureido group (for example, phenylureido, methylureido and N,N-dibutylureido), sulfamoylamino group (for example N,N-dipropylsulfamoylamino and N-methyl-N-dodecylsulfamoylamino), alkylthio group (for example methylthio, octylthio, tetradecylthio, 2-phenoxyethylthio, 3-phenoxypropylthio and 3-(4-t-butylphenoxy)propylthio), arylthio group (for example phenylthio, 2-butoxy-5-t-octylphenylthio, 3-pentadecylphenylthio, 2-carboxyphenylthio and 4-tetradecanamidophenylthio), alkoxycarbonylamino group (for example methoxycarbonylamino and tetradecyloxycarbonylamino), sulfonamido group (for example methanesulfonamido, hexadecanesulfonamido, benzenesulfonamido, p-toluenesulfonamido, octadecanesulfonamido and 2-methyl-oxy-5-t-butylbenzenesulfonamido), carbamoyl group (for example N-ethylcarbamoyl, N,N-dibutylcarbamoyl, N-(2-dodecyloxyethyl)carbamoyl, N-methyl-N-dodecylcarbamoyl and N-{3-(2,4-tert-amylphenoxy)propyl}carbamoyl), sulfamoyl group (for example N-ethylsulfamoyl,N,N-dipropylsulfamoyl, N-(2-dodecyloxyethyl)sulfamoyl, N-ethyl-N-dodecylsulfamoyl and N,N-diethylsulfamoyl), sulfonyl group (for example methanesulfonyl, octanesulfonyl, benzenesulfonyl and toluenesulfonyl), or alkoxycarbonyl group (for example methoxycarbonyl, butyloxycarbonyl, dodecylcarbonyl or octadecylcarbonyl); and amongst these the alkyl group, aryl group, alkylthio group and arylthio group are preferred and the alkyl group and aryl group are more preferred.

For X, apart from a hydrogen atom, it is possible to mention as preferred coupling leaving groups halogen atoms (for example chlorine, bromine and iodine), carboxyl groups or groups linked by oxygen atoms (for example acetoxy, propanoyloxy, benzoyloxy, 2,4-dichlorobenzoyloxy, ethoxyoxaloyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy and 2-benzothiazolyloxy), groups linked by nitrogen atoms (for example benzenesulfonamido, N-ethyltoluenesulfonamido, heptafluorobutanamido, 2,3,4,5,6-pentafluorobenzamido, octanesulfonamido, p-cyanophenylureido, N,N-dimethylsulfamoylamino, 1-piperidyl, 5,5-dimethyl-2,4-dioxo-3-oxazolidinyl, 1-benzylethoxy-3-hydantoinyl, 2N-1,1-dioxo-3[2H]-oxo-1,2-benzoisothiazolyl, 2-oxo-1,2-dihydro-1-pyridinyl, imidazolyl, pyrazolyl, 3,5-diethyl-1,2,4-triazol-1-yl, 5- or 6-bromobenzotriazol-1-yl, 5-methyl-1,2,3,4-tetrazol-1-yl and benzimidazolyl), groups linked by sulfur atoms (for example phenylthio, 2-carboxyphenylthio, 2-methoxy-5-octylphenylthio, 4-methanesulfonylphenylthio, 4-octanesulfonamidophenylthio, benzylthio, 2-cyanoethylthio, 1-ethoxycarbonyltridecylthio, 5-phenyl-2,3,4,5-tetrazolylthio and 2-benzothiazolyl) and the like.

Furthermore, $R_1$, $R_2$ or X may constitute divalent groups and form dimers. In such cases, $R_1$ or $R_2$ represents a substituted or unsubstituted alkylene group (for example, methylene, ethylene, 1,10-decylene or —$CH_2CH_2$—O—$CH_2CH_2$—), substituted or unsubstituted phenylene group (for example 1,4-phenylene, 1,3-phenylene,

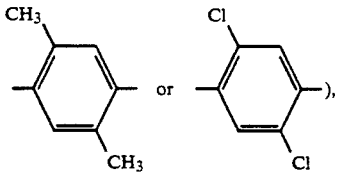

and X represents the coupling leaving group mentioned above as a divalent group in an appropriate position.

Moreover, the couplers represented by general formulae (I) and (II) can be contained in a vinyl monomer. In such cases, the linking group represented by one of $R_1$ or $R_2$ includes groups created by combining those groups chosen from among the alkylene group (a substituted or unsubstituted alkylene group, for example methylene, ethylene, 1,10-decylene and —$CH_2CH_2OCH_2CH_2$—), phenylene group (a substituted or unsubstituted phenylene group, for example, 1,4-phenylene, 1,3-phenylene,

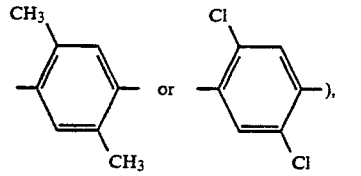

—NHCO—, —COHN, —O—, —OCO—and aralkylene group (for example —CH₂— 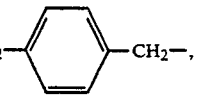 —CH₂—, —CH₂CH₂— 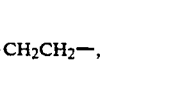 —CH₂CH₂—,

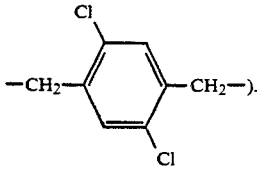

The following are preferred as linking groups

—CH₂CH₂—, —CH₂CH₂CH₂— 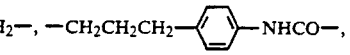 —NHCO—,

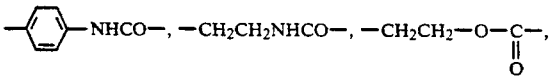 —NHCO—, —CH₂CH₂NHCO—, —CH₂CH₂—O—C(=O)—,

—CH₂CH₂O—CH₂CH₂—NHCO—,

—CH₂CH₂— 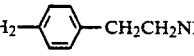 —CH₂CH₂NHCO—.

Moreover, the vinyl group may have substituent groups other than those represented by general formula (I), and it is possible to mention the chlorine atom and lower alkyl groups with 1 to 4 carbon atoms (for example methyl, ethyl) as preferred substituent groups.

Monomers which contain the coupler moiety represented by general formula (I) or (II) may produce copolymeric polymers with non-color-forming ethylenic monomers which do not couple with the oxidation products of primary aromatic amine developing agents.

Non color-forming ethylenic monomers which do not couple with the oxidation products of primary aromatic amine developing agents include acrylic acid, α-chloroacrylic acid, α-alkylacrylic acids (such as methacrylic acid) and esters or amides derived from these acrylic acids (for example acrylamide, n-butylacrylamide, t-butylacrylamide, diacetone acrylamide, methacrylamide, methyl acrylate, ethyl acrylate, n-propyl acrylate, n-butyl acrylate, t-butyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxy methacrylate), methylene-bis-acrylamide, vinyl esters (for example vinyl acetate, vinyl propionate and vinyl laurate), acrylonitrile, methacrylonitrile, aromatic vinyl compounds (for example styrene and derivatives thereof, vinyltoluene, divinylbenzene, vinylacetophenone and sulfostyrene), itaconic acid, citraconic acid, crotonic acid, vinylidene chloride, vinyl alkyl ethers (for example vinyl ethyl ether), maleic acid, anhydrous maleic acid, maleic acid esters, N-vinyl-2-pyrrolidone, N-vinylpyridine and 2- or 4-vinylpyridine. Here, it is also possible to use two or more types of non-color-forming ethylenically unsaturated monomers together. Examples of this include n-butyl acrylate and methyl acrylate, styrene and methacrylic acid, methacrylic acid and acrylamide or methyl acrylate and diacetone acrylamide.

As is commonly known in the field of polymer color couplers, non-color-forming ethylenically unsaturated monomers for copolymerization with solid water-insoluble monomer couplers can be selected so that the physical properties and/or the chemical properties of the copolymers which are formed, for example the solubility, the compatibility with gelatin or other such binder for the photographic colloid constituents, the plasticity or thermal stability are beneficially affected.

The polymer couplers used in this invention may be water-soluble or water-insoluble, and of these polymer coupler latexes are particularly preferred.

Actual examples of representative magenta couplers in this invention are now given, but the invention is not limited by these.

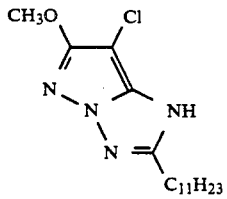

(M-1)

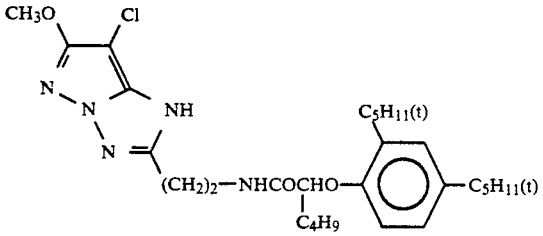

(M-2)

-continued
(M-3)
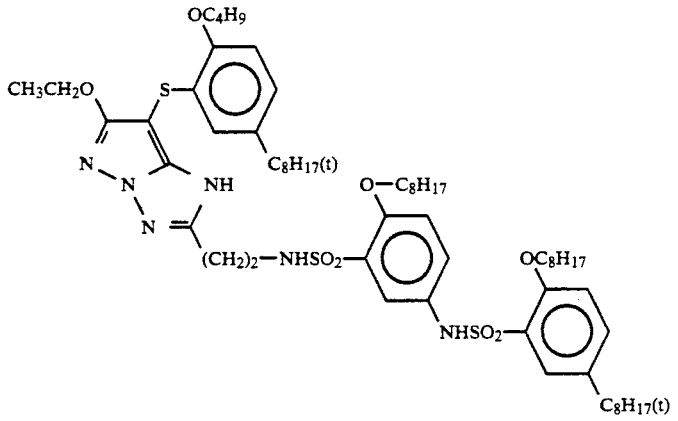
(M-4)
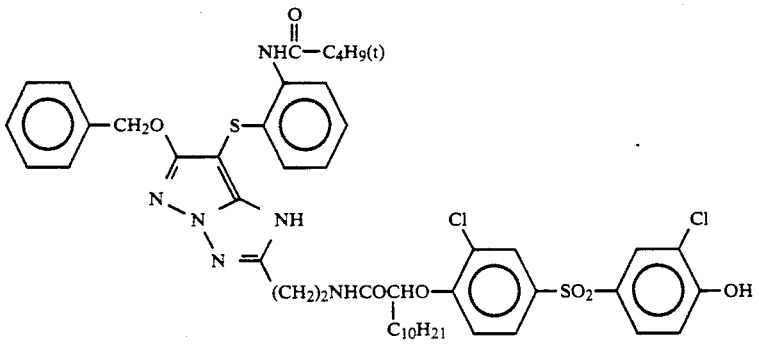
(M-5)
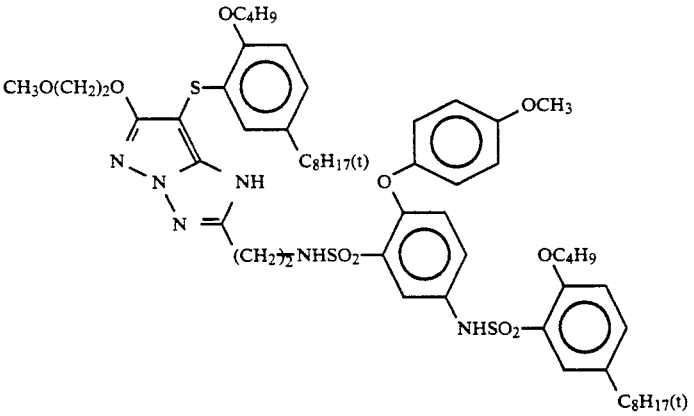
(M-6)
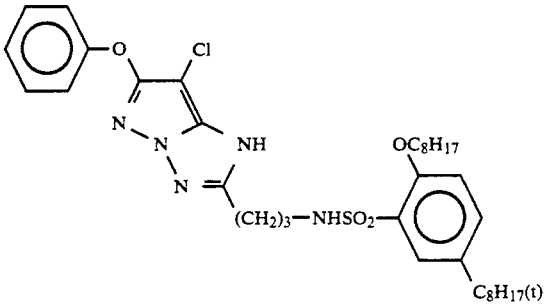

-continued
(M-7)
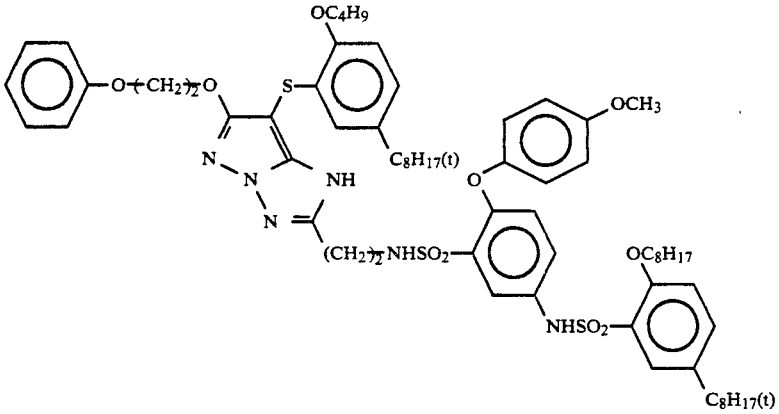
(M-8)
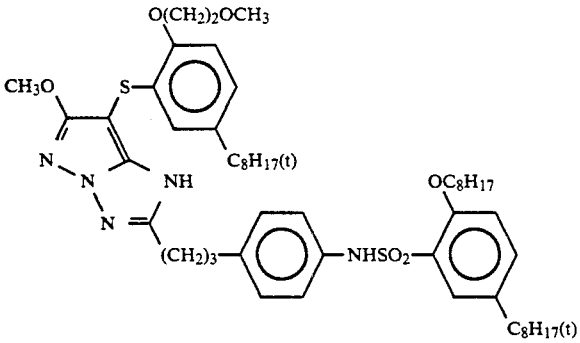
(M-9)
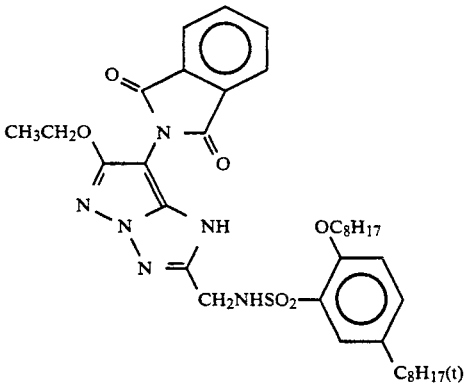
(M-10)
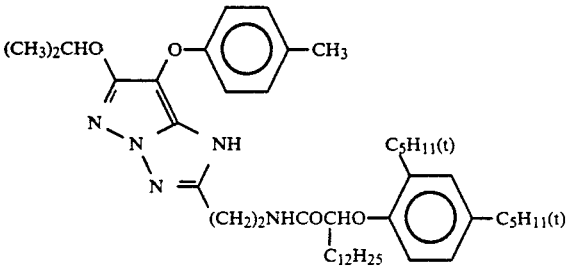

-continued
(M-11)
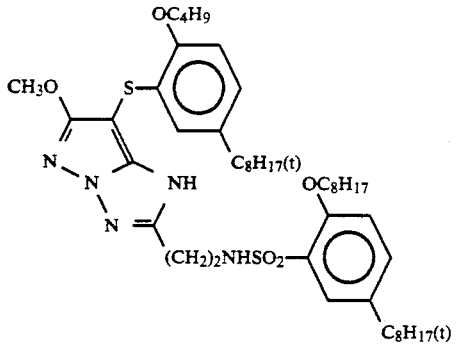
(M-12)
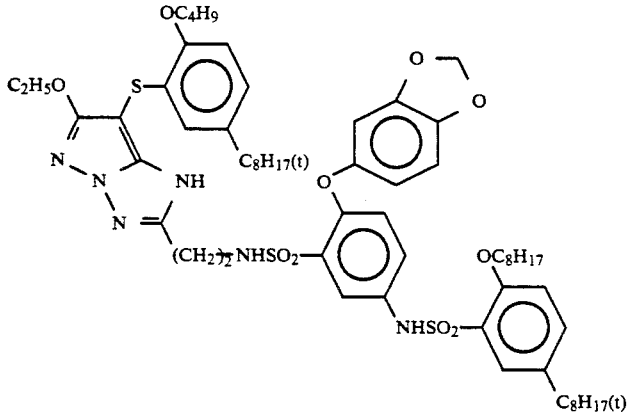
(M-13)
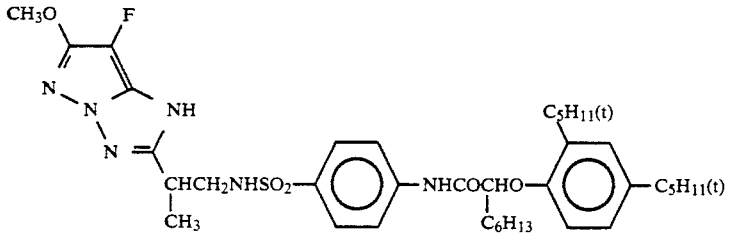
(M-14)
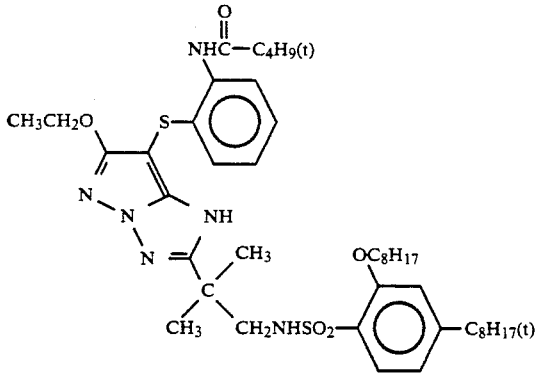
(M-15)
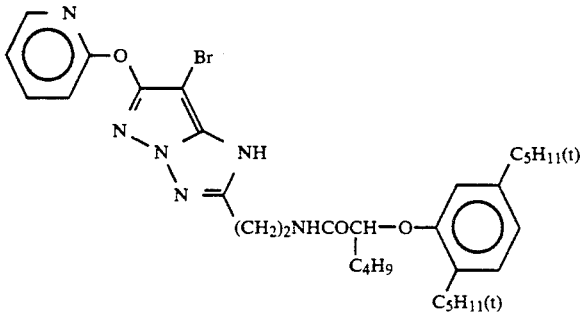

-continued
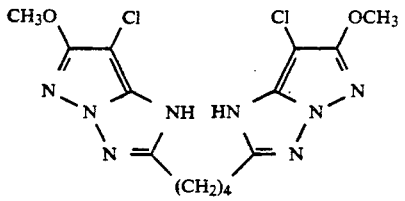
(M-16)
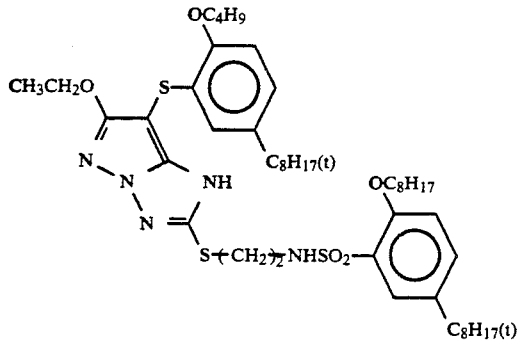
(M-17)
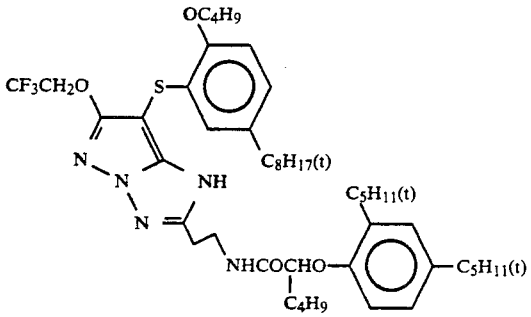
(M-18)
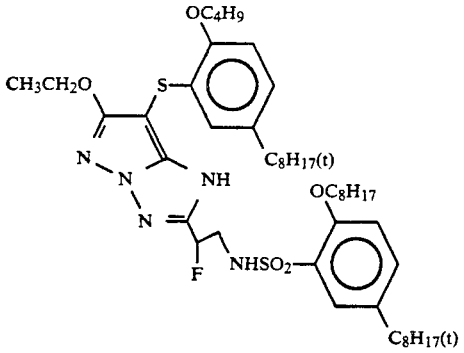
(M-19)
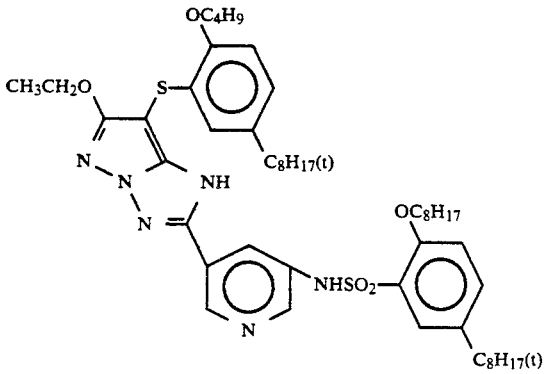
(M-20)

-continued
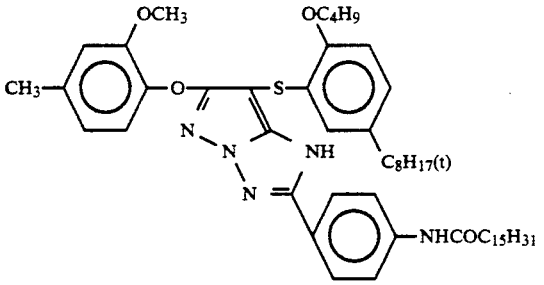
(M-21)
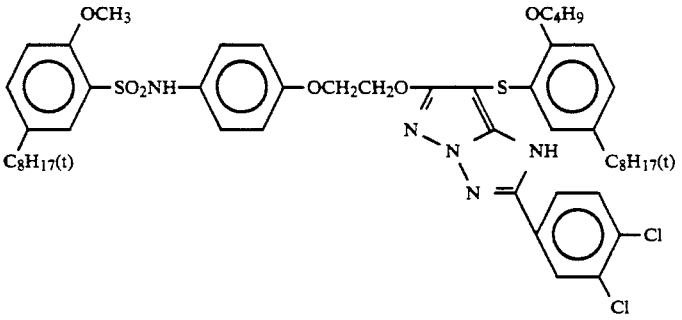
(M-22)
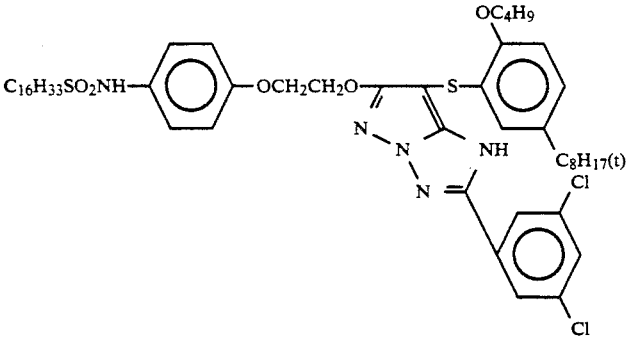
(M-23)
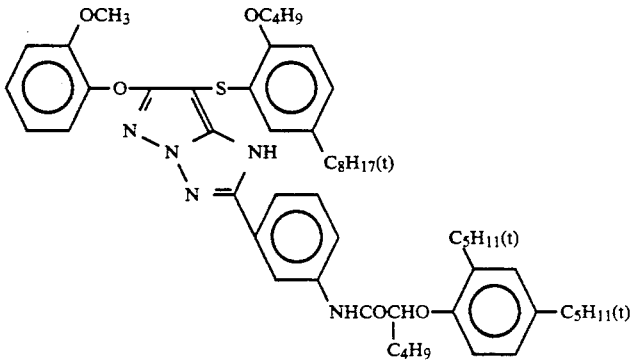
(M-24)

-continued
(M-25)
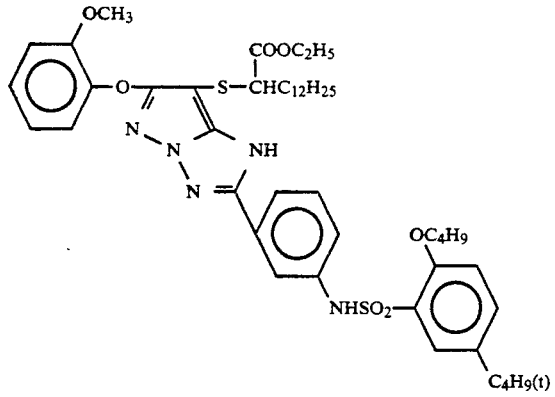
(M-26)
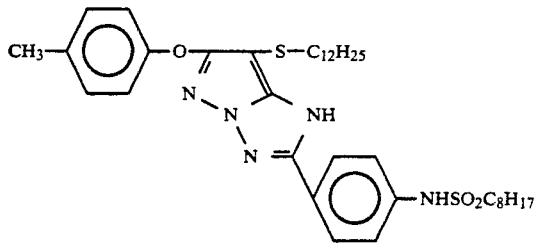
(M-27)
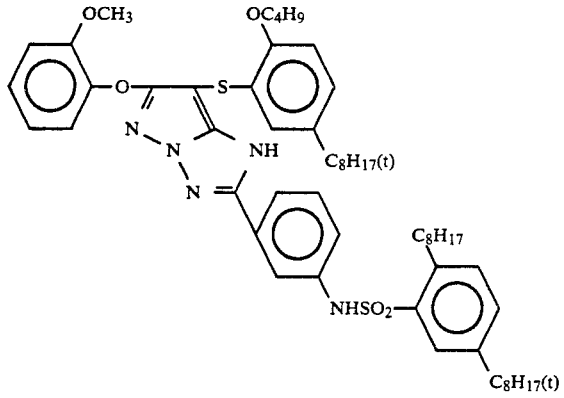
(M-28)
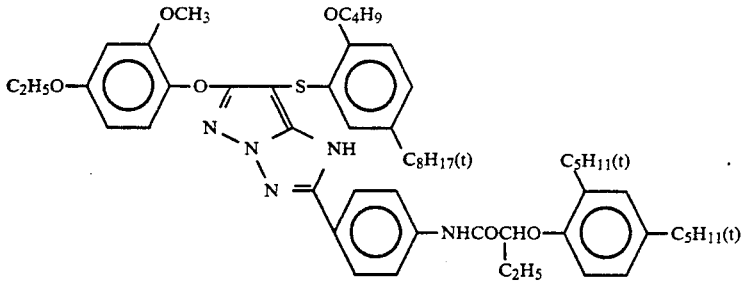
(M-29)
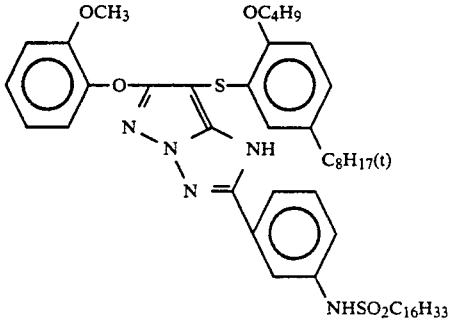

-continued
(M-30)
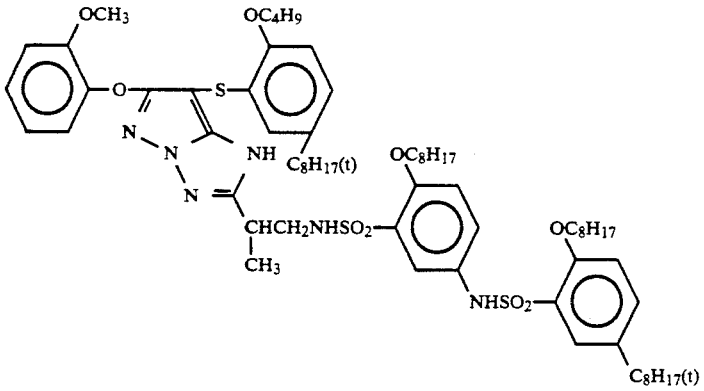
(M-31)
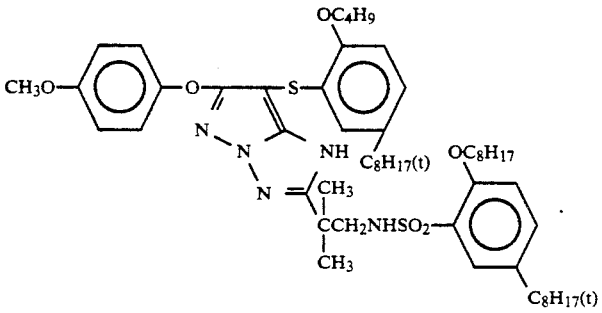
(M-32)
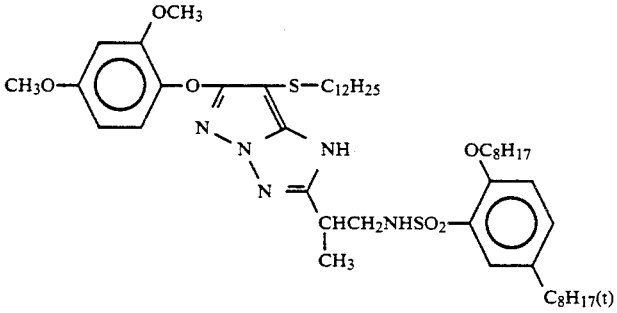
(M-33)
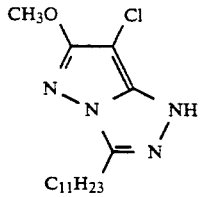
(M-34)
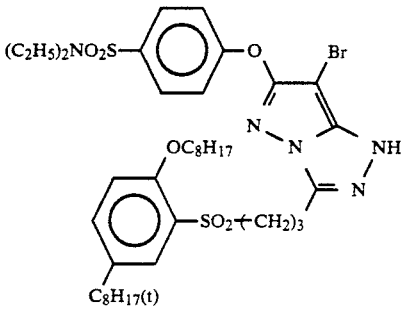

-continued
(M-35)
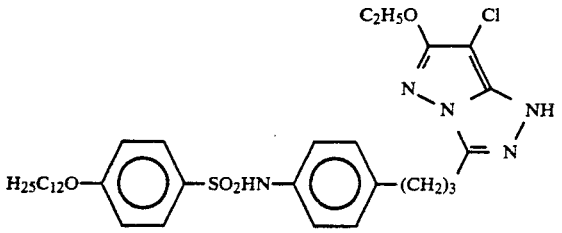
(M-36)
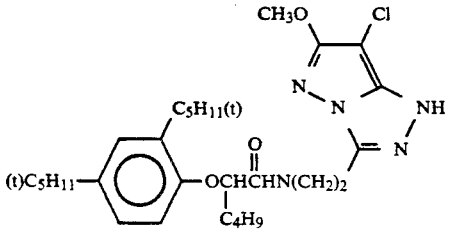
(M-37)
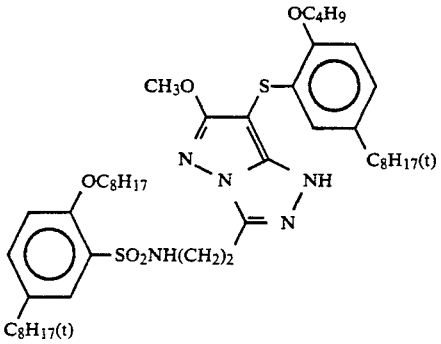
(M-38)
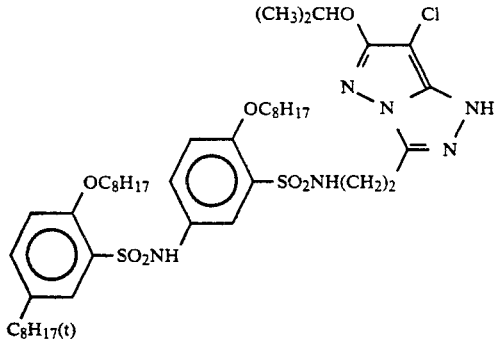
(M-39)
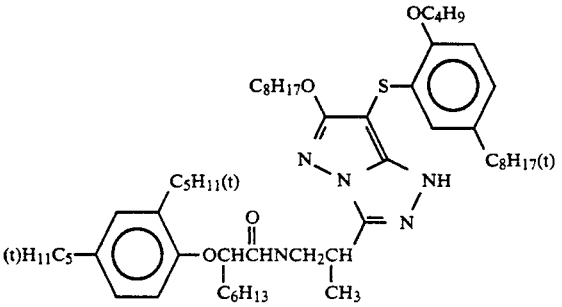

-continued
(M-40)
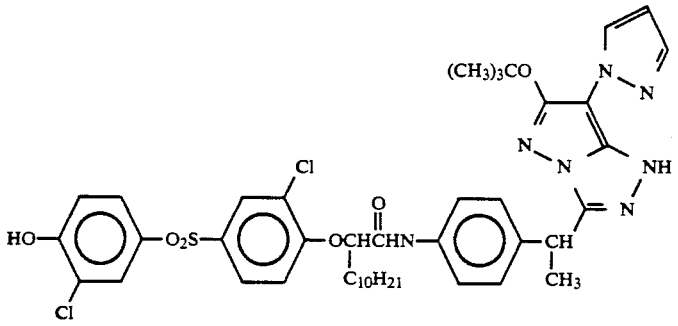
(M-41)
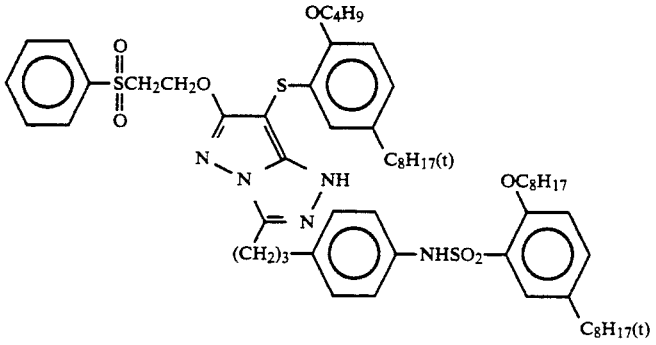
(M-42)
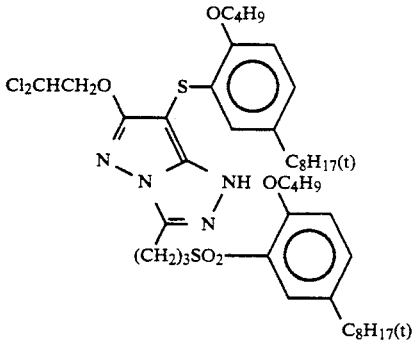
(M-43)
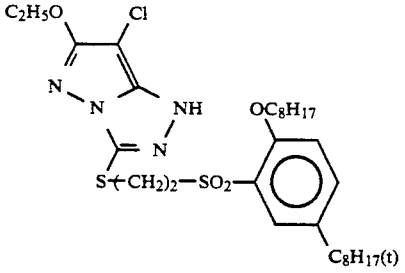
(M-44)
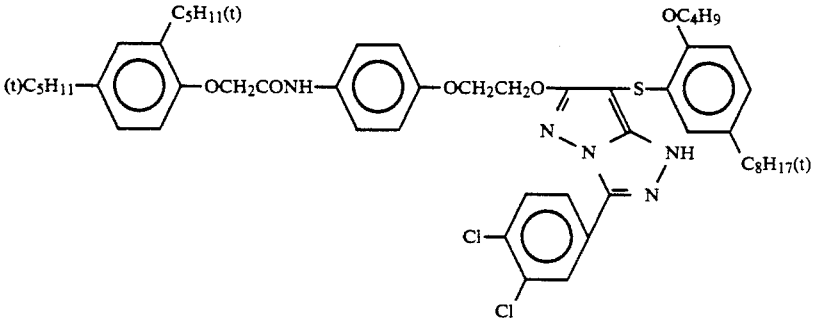

-continued
(M-45)
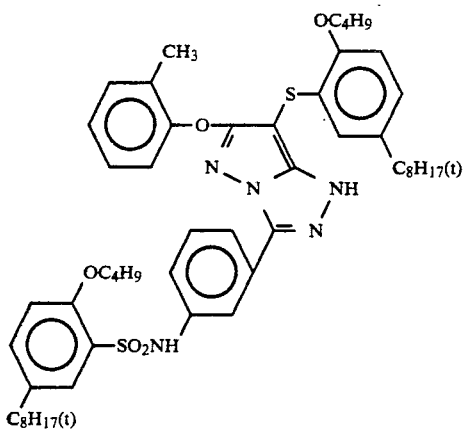
(M-46)
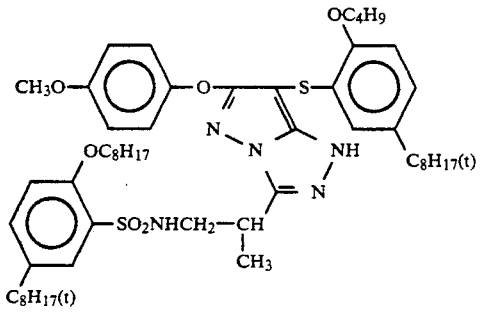
(M-47)
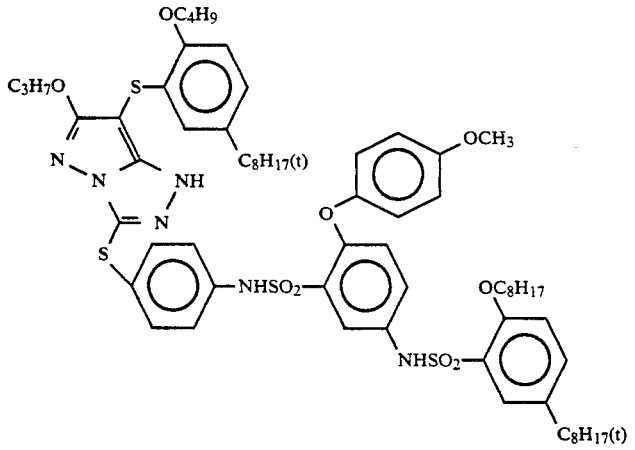
(M-48)
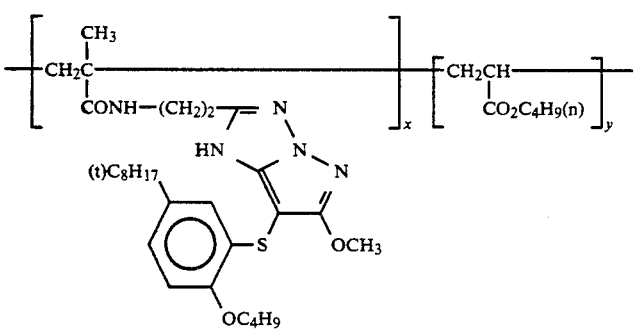
x:y = 50:50
(by weight, hereinafter the same)

-continued
(M-49)
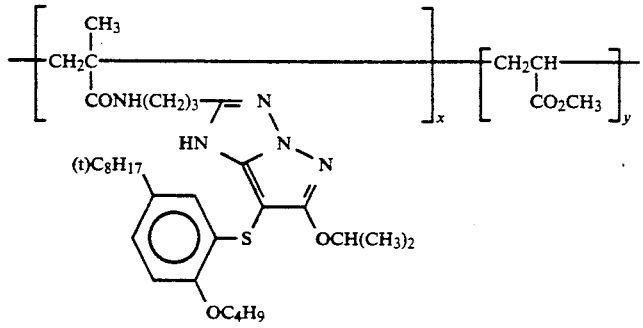
x:y = 50:50
(M-50)
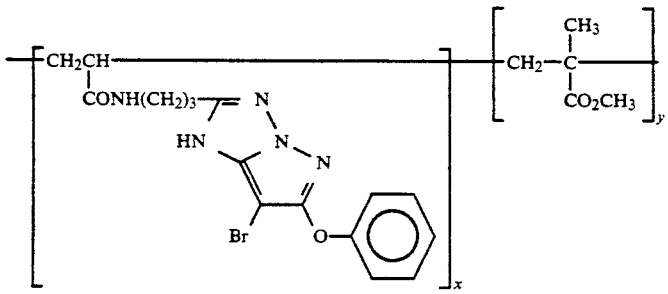
x:y = 45:55
(M-51)
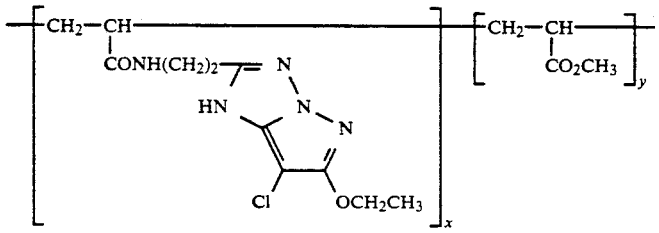
x:y = 45:55
(M-52)
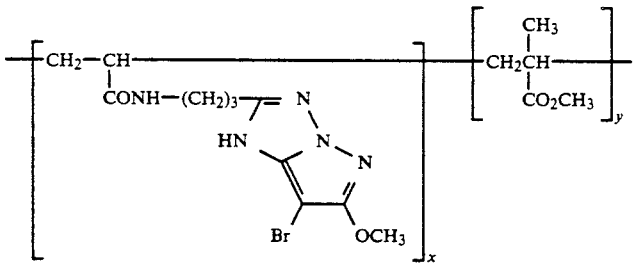
x:y = 45:55
(M-53)
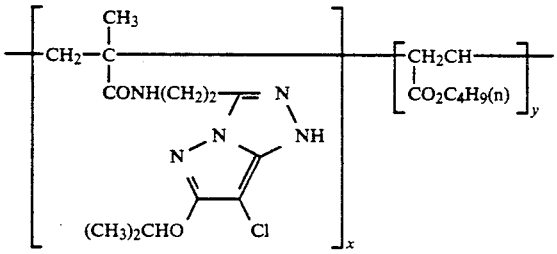
x:y = 50:50
With the couplers of the above-mentioned general formulae (I) and (II), cases in which $R_1$ is an aryl group A general synthesis method for couplers of this invention is now described. JP-A-60-197688 describes a synthesis method for 1H-pyrazolo[1,5,-b]-1,2,4-triazole when the 6-position contains a hydrogen atom or an alkyl group and the couplers of this invention (general formulae (I) and (II)) can also be synthesized by a method which is basically the same although the starting materials are different. Details of another synthesis method are described on pages 37 to 50 of the specification of Japanese Patent Application No. 62-175515.

Two or more of these magenta couplers may be contained in the same layer. These couplers will generally be added at $2\times10^{-3}$ mole to $5\times10^{-1}$ mole, and preferably $1\times10^{-2}$ mole to $5\times10^{-1}$ mole, for every mole of silver in the emulsion layer.

To describe general formula (III) in further detail, R represents a group preferably having 2 to 40 carbon atoms, and more preferably 2 to 25 carbon atoms, for example, an acyl group (for example acetyl, propionyl, butyryl, isobutyryl, pivaloyl, myristoyl, crotonoyl, benzoyl, toluyl, fluoroyl and 2,4-di-t-acylphenoxyacetyl), alkyloxycarbonyl group (for example methoxycarbonyl, octyloxycarbonyl and hexadecyloxycarbonyl), aryloxycarbonyl group (for example phenoxycarbonyl and 4-methylphenoxycarbonyl), alkylsulfinyl group (for example methylsulfinyl and ethylsulfinyl), arylsulfinyl group (for example phenylsulfinyl and 4-methoxyphenylsulfinyl), alkylsulfonyl group (for example methanesulfonyl, octanesulfonyl and 4-phenoxybutanesulfonyl) carbamoyl group, sulfamoyl group or arylsulfonyl group (for example benzenesulfonyl and 4-methoxybenzenesulfonyl), and it is preferably an acyl group, alkyloxycarbonyl group or aryloxycarbonyl group, and particularly preferably an acyl group. $R_3$, $R_4$, $R_5$ and $R_6$ may be identical or different and respectively represent an alkyl group (for example methyl, ethyl, propyl or octyl).

A represents a group of non-metallic atoms necessary to form a 5-membered, 6-membered or 7-membered ring and represents, for example, $-CH_2CH_2-$, $-CH_2CH_2CH_2-$, $-CH_2\underset{\underset{O}{\|}}{C}CH_2-$, $-CH_2OCH_2-$, $-CH_2SO_2CH_2$, $-CH_2\underset{\underset{O}{\|}}{O}C-$, $-CH_2\underset{\underset{OR_{16}}{|}}{C}HCH_2-$,

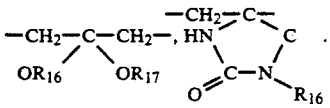

Here, $R_{16}$ and $R_{17}$ are identical or different and respectively represent a hydrogen atom, alkyl group, acyl group, sulfonyl group, sulfinyl group or alkoxycarbonyl group. Furthermore, $R_3$ and $R_4$, $R_5$ and $R_6$, R and $R_3$, and $R_3$ and A may respectively link to form a 5-membered or 6-membered ring (for example cyclopentyl, cyclohexyl, cyclohexenyl and pyranyl, piperazine. A, R or A and R may represent a divalent group to form a dimer or a trimer of the compound represented by formula (III), wherein A and R each may be derived from the above described groups A and R, respectively).

The compounds represented by general formula (III) can be contained in a vinyl monomer, in the same way as in the couplers represented by formula (I) and (II). The monomers which contain the moiety of the compound represented by general formula (III) may produce copolymeric polymers with non-color-forming ethylenic monomers which do not react with the oxidation products of primary aromatic amine developing agents.

From the standpoint of the effects of the invention, A is preferably a group of atoms which forms a 5-membered or 6-membered ring, and the case in which it is 2,2,6,6-tetramethylpiperidine is particularly preferred. Moreover, for the molecule as a whole, compounds which do not have a phenolic hydroxyl group within the molecule are particularly preferred.

Specific examples of general formula (III) are given below but the invention is not limited by these.

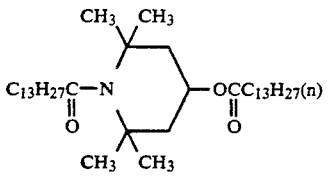

III-1

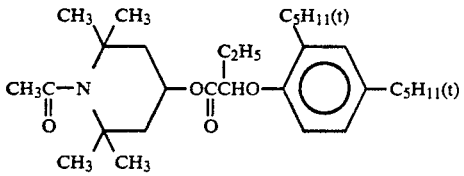

III-2

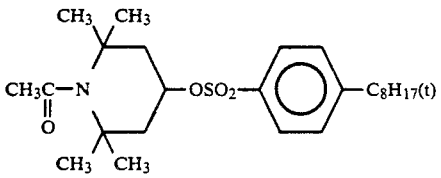

III-3

-continued
III-4
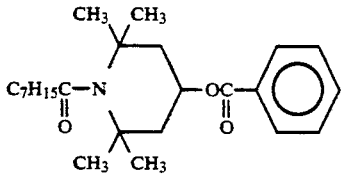
III-5
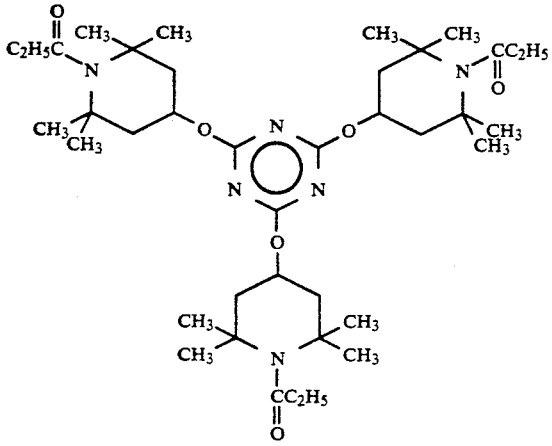
III-6
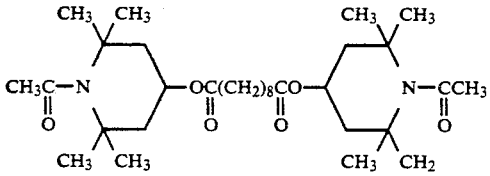
III-7
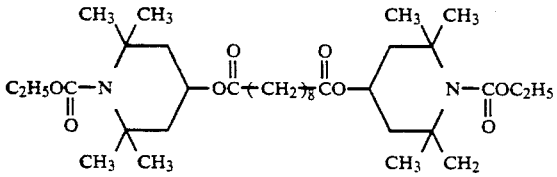
III-8
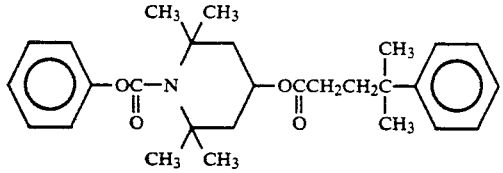
III-9
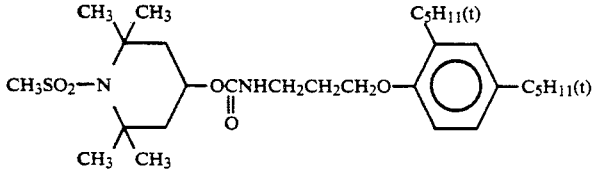
III-10
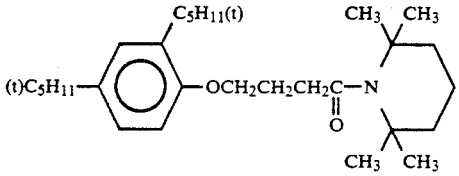

-continued
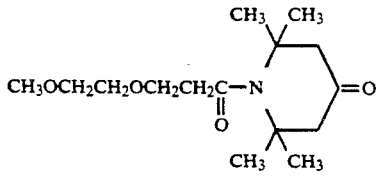
III-11
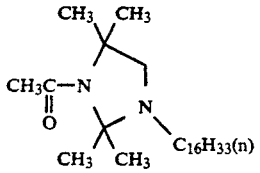
III-12
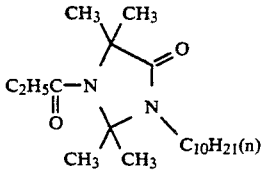
III-13
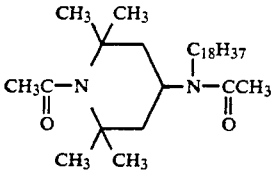
III-14
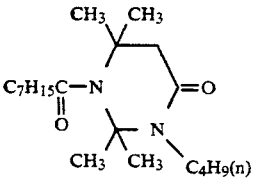
III-15
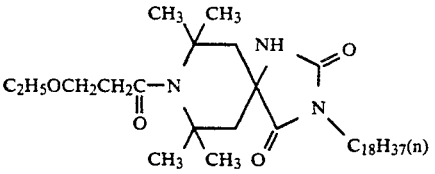
III-16
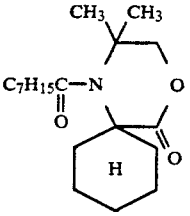
III-17
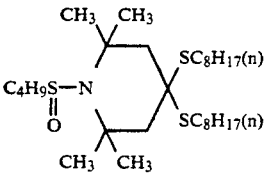
III-18

-continued
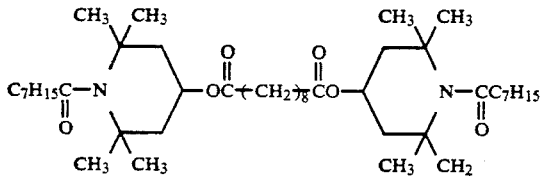
III-19
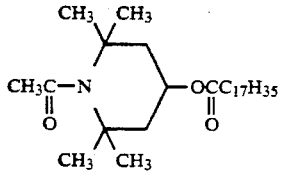
III-20
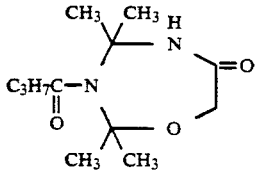
III-21
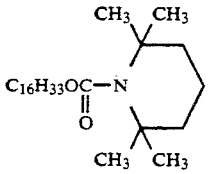
III-22
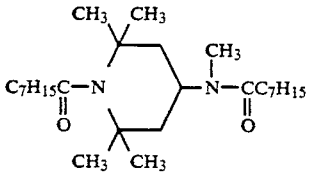
III-23
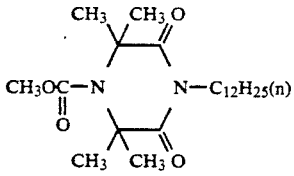
III-24
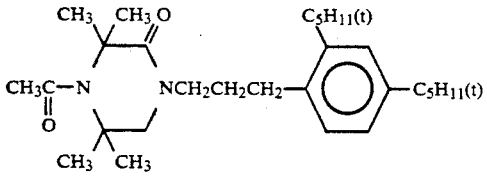
III-25
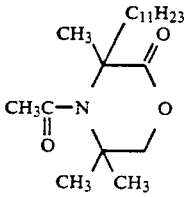
III-26

-continued
III-27
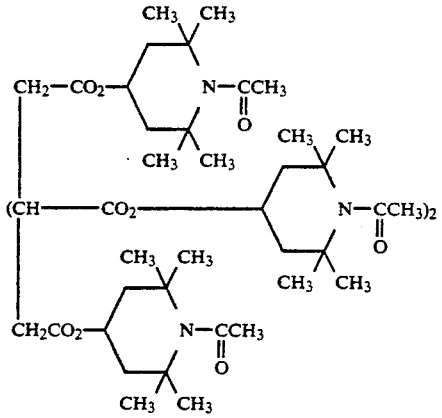
III-28
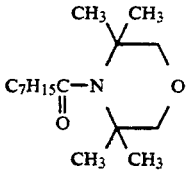
III-29
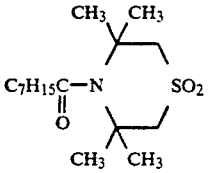
III-30
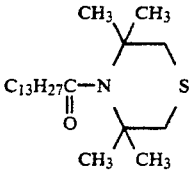
III-31
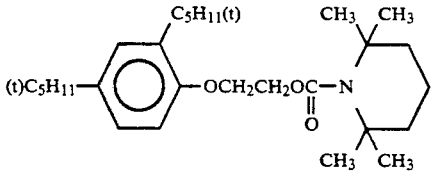
III-32
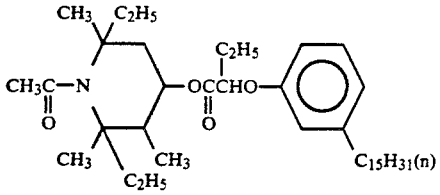
III-33
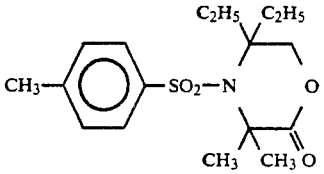

-continued
III-34
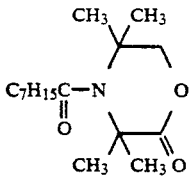
III-35
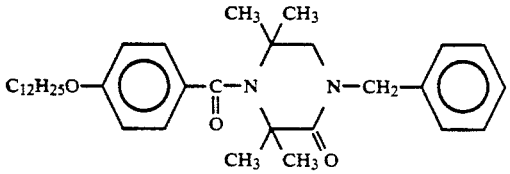
III-36
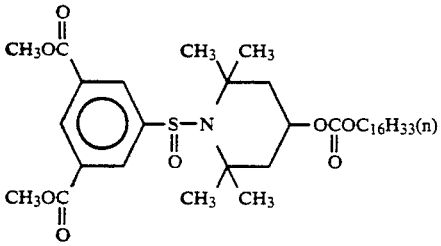
III-37
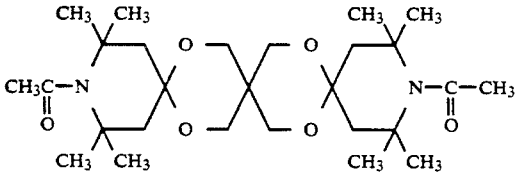
III-38
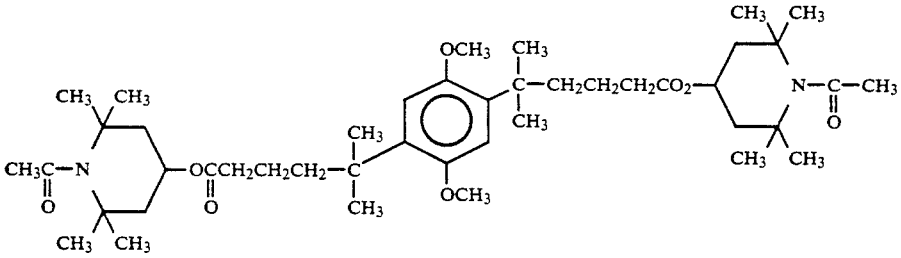
III-39
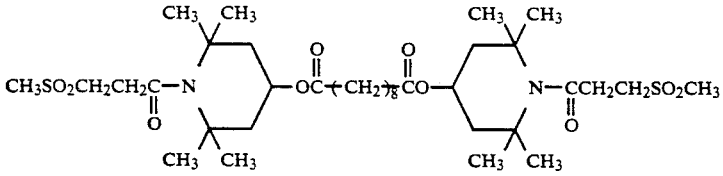
III-40
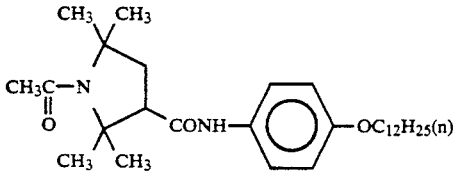
III-41
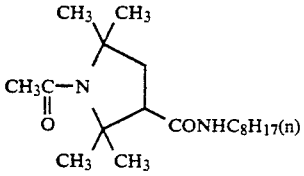

-continued

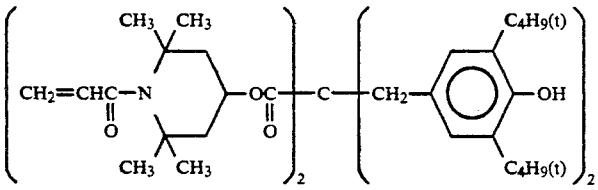

III-42

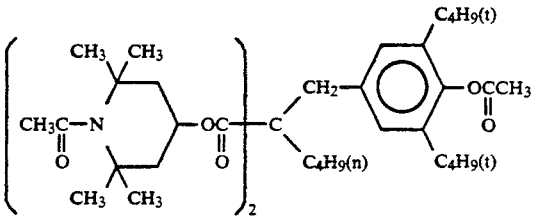

III-43

These compounds can be synthesized using the synthesis methods described in *Synthesis* 1984, p. 894, ibid. 1984, p. 122, ibid. 1981, p. 40, *The Journal of Organic Chemistry*, Vol. 45, p. 754 (1980), *The Journal of the Chemical Society Section C*, p. 1653 (1971), JP-A-49-53573, JP-A-49-7180, JP-A-49-53575, JP-A-49-53571 and G.B. Patent 1,410,846.

Furthermore, the amount of these compounds which is added is preferably 5 to 300 mol % and more preferably 10 to 100 mol % with respect to the coupler.

To describe general formula (IV) in further detail, the substituent $R_7$ to $R_{12}$ constituting the compound represented by the general formula (IV) are preferably selected so that the molecular weight of the compound of formula (IV) containing $R_7$ to $R_{12}$ is in total 200 or more, and more preferably, $R_7$ represents an alkyl group (for example, methyl, n-butyl, n-octyl, n-hexadecyl, ethoxyethyl, 3-phenoxypropyl and benzyl), alkenyl group (for example, vinyl and allyl), aryl group (for example, phenyl and naphthyl), heterocyclic group (for example, pyridyl and tetrahydropyranyl) or

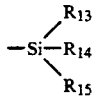

(for example, trimethylsilyl and tert-butyldimethylsilyl). $R_8$, $R_9$, $R_{10}$, $R_{11}$ and $R_{12}$ are identical or different and respectively represent a hydrogen atom, alkyl group (for example, methyl, n-butyl, n-octyl, secdodecyl, t-butyl, t-amyl, t-hexyl, t-octyl, t-octadecyl, $\alpha,\alpha$-dimethylbenzyl and 1,1-dimethyl-4-hexyloxycarbonylbutyl), alkenyl group (for example, vinyl and allyl), aryl group (for example, phenyl, naphthyl, p-methoxyphenyl and 2,4-t-butylphenyl), acylamino group (for example, acetylamino, propionylamino and benzamino), alkylamino group (for example, N-methylamino, N,N-dimethylamino, N,N-dihexylamino, piperidino, N-cyclohexylamino and N-(t-butyl)amino), alkylthio group (for example, methylthio, n-butylthio, sec-butylthio, t-butylthio and dodecylthio), arylthio group (for example, phenylthio and naphthylthio), halogen atom (for example, chlorine and bromine) or —O—$R_7'$. Where $R_7'$ has the same meaning as $R_7$. $R_7$ and $R_8$ may link together to form a 5-membered ring, 6-membered ring or spiro ring. $R_8$ and $R_9$ or $R_9$ and $R_{10}$ may link together to form a 5-membered ring, 6-membered ring or spiro ring. By way of such rings, it is possible to mention, for example, the chroman ring, coumaran ring, spirocroman ring and spiroindan ring.

The compounds represented by general formula (IV) can be contained in a vinyl monomer, in the same way as in the couplers represented by formula (I) and (II). The monomers which contain the compound moiety represented by general formula (IV) may produce copolymeric polymers with non-color-forming ethylenic monomers which do not react with the oxidation products of primary aromatic amine developing agents.

Amongst the compounds represented by general formula (IV), those represented by the following general formulae (IV-I) to (IV-7) are preferred from the standpoint of the effects of this invention.

Formula (IV-1)

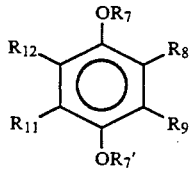

Formula (IV-2)

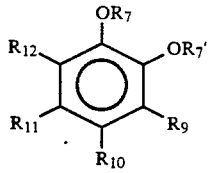

Formula (IV-3)

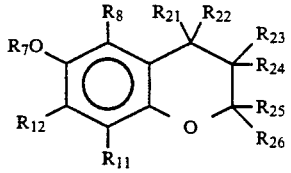

Formula (IV-4)

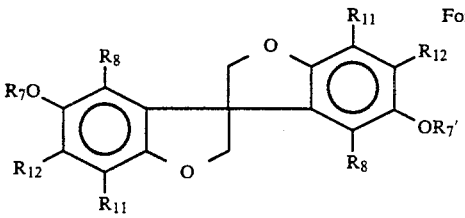

-continued

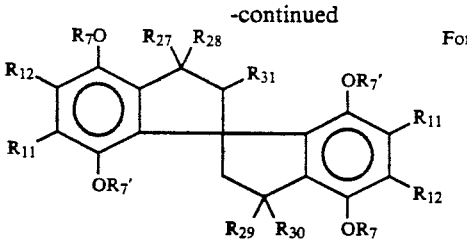

Formula (IV-5)

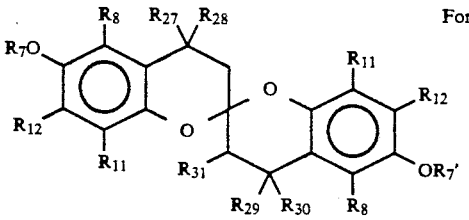

Formula (IV-6)

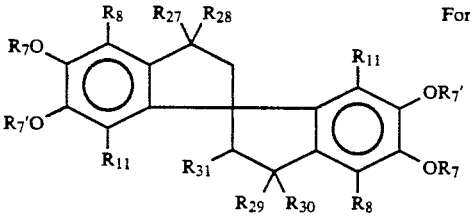

Formula (IV-7)

In general formulae (IV-1) to (IV-7), $R_7$, $R_7'$, $R_8$, $R_9$, $R_{10}$, $R_{11}$ and $R_{12}$ represent the same groups as in general formula (IV). $R_{21}$ to $R_{31}$ may be identical or different and represent hydrogen atoms, alkyl groups (for example, methyl, ethyl, isopropyl and dodecyl) or aryl groups (for example, phenyl and p-methoxyphenyl).

Of the compounds represented by general formulae (IV-1) to (IV-7), cases in which $R_7$ and $R_7'$ are alkyl groups or aryl groups are preferred and cases in which they are alkyl groups are most preferred. Furthermore, cases in which $R_8$ to $R_{12}$ are hydrogen atoms, alkyl groups or aryl groups are preferred.

By way of compounds which are further preferred for the compounds represented by general formulae (IV-1) to (IV-7), there are the compounds of general formulae (IV-1), (IV-5), (IV-6) and (IV-7), the compounds of general formula (IV-7) being most preferred.

Specific examples of compounds represented by general formula (IV) are now given but the invention is not limited by these.

A-1

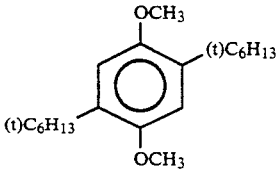

A-2

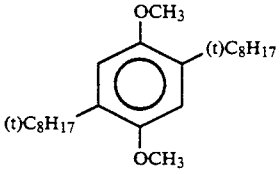

A-3

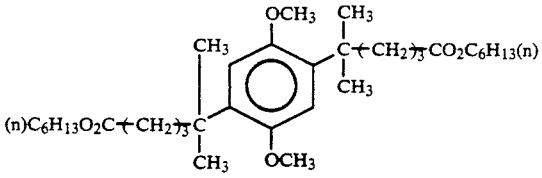

A-4

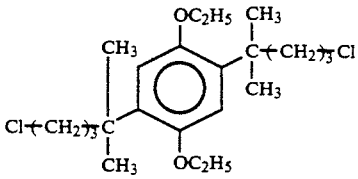

A-5

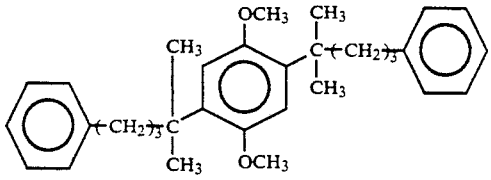

-continued
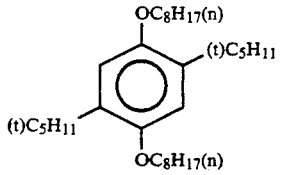
A-6
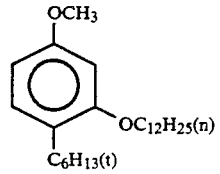
A-7
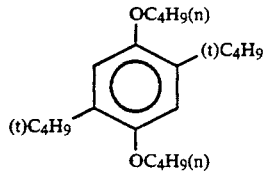
A-8
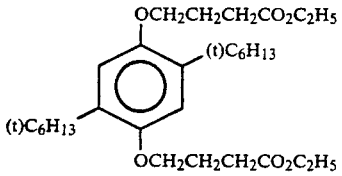
A-9
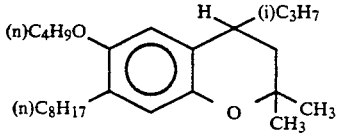
A-10
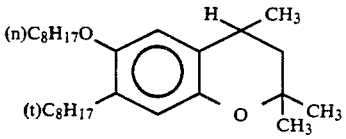
A-11
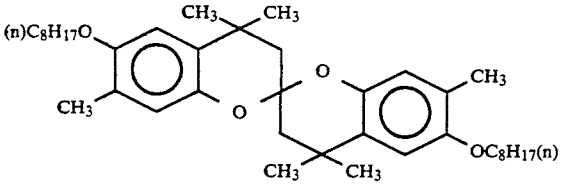
A-12
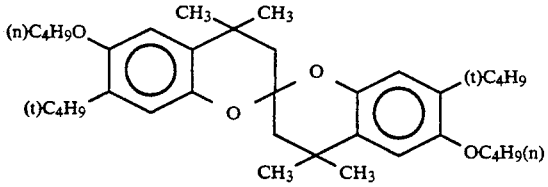
A-13
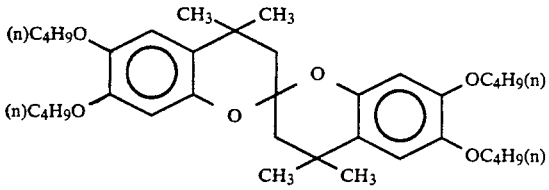
A-14

-continued
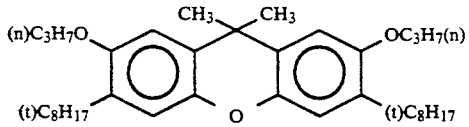
A-15
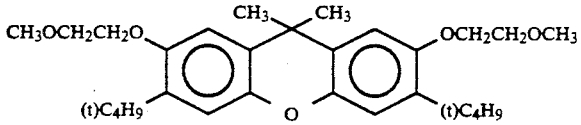
A-16
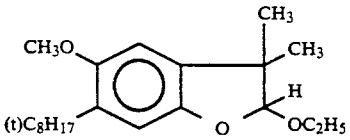
A-17
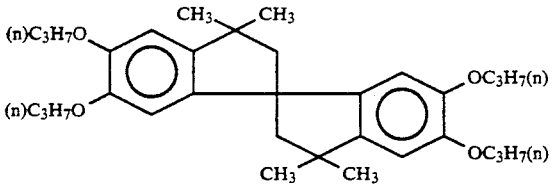
A-18
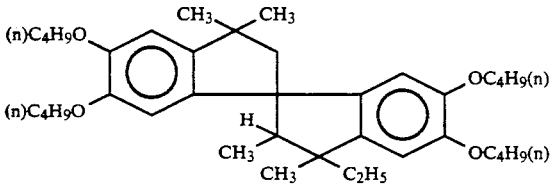
A-19
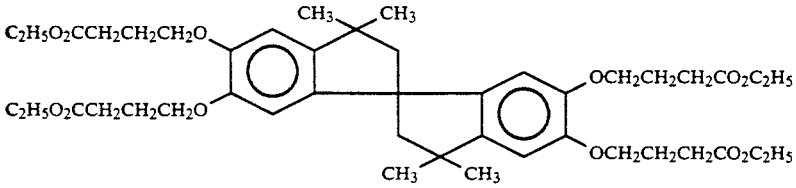
A-20
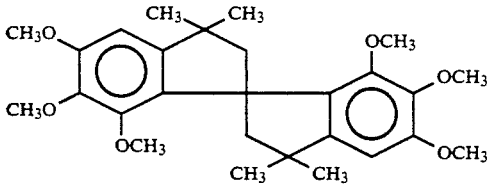
A-21
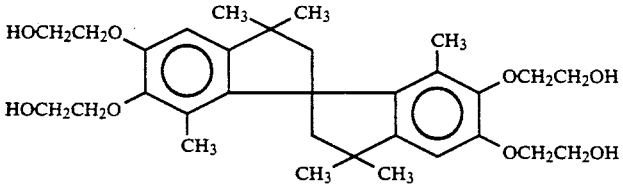
A-22
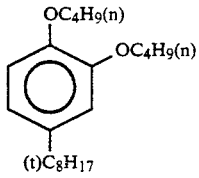
A-23

-continued
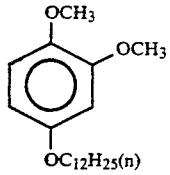
A-24
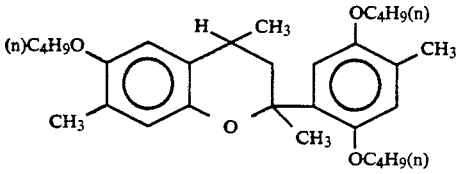
A-25
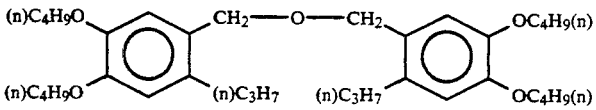
A-26
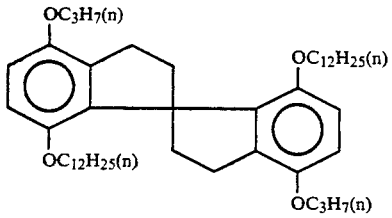
A-27
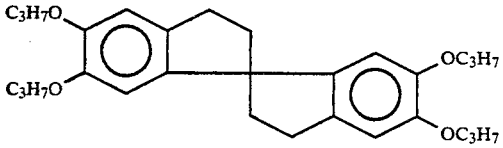
A-28
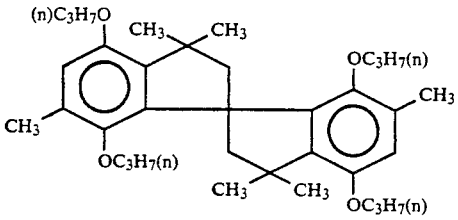
A-29
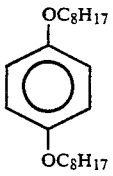
A-30
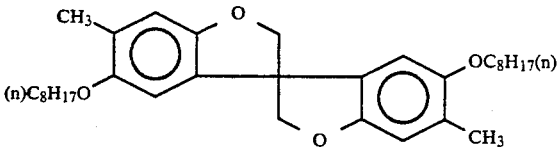
A-31
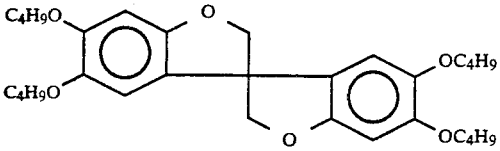
A-32

-continued
A-33
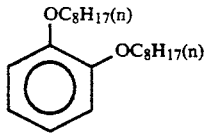
A-34
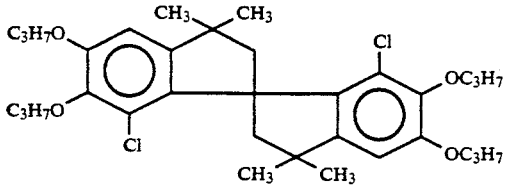
A-35
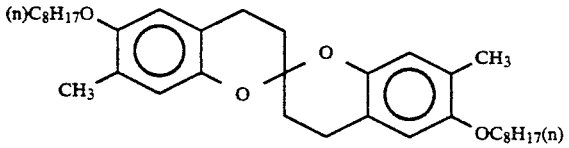
A-36
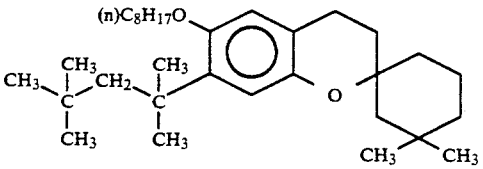
A-37
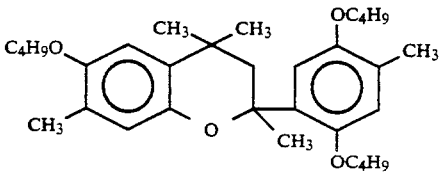
A-38
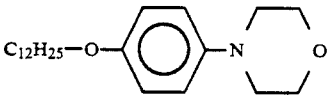
A-39
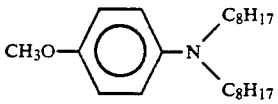
A-40
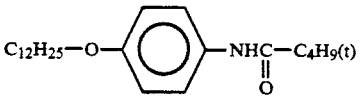
A-41
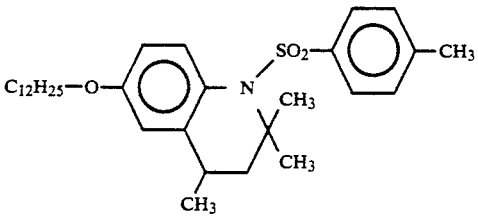
A-42
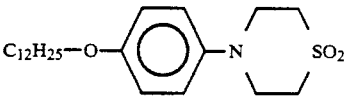

-continued

A-43

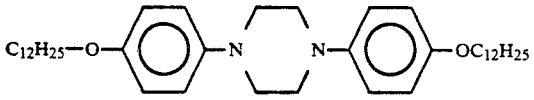

A-44

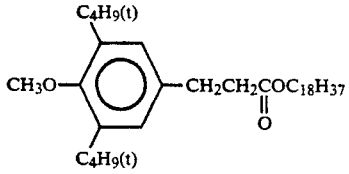

A-45

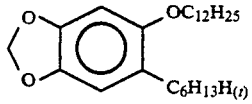

A-46

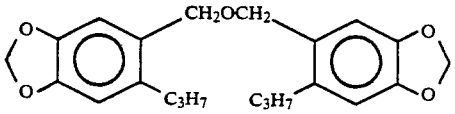

These compounds can be synthesized by the methods described in JP-B-45-14034, JP-B-56-24257, JP-B-59-52421, JP-A-55-89835, JP-A-56-159644, JP-A-62-244045, JP-A-62-244046, JP-A-62-273531 and European Patent 0,239,972 and by methods which are in accordance with these.

The amount of these compounds which is added is 10 to 400 mol % and preferably 20 to 150 mol % with respect to the coupler.

The compounds of general formulae (I), (II), (III) and (IV) are provided as coatings by emulsification and dispersion in a hydrophilic colloid after being dissolved singly or 2 or 3 being dissolved at a time or 4 being dissolved together in a high-boiling organic solvent. However, from the standpoint of the effects of the invention, it is preferable that these compounds are dissolved together in a high-boiling organic solvent and are present together in the oil drops.

Furthermore, the compounds represented by general formula (V) and general formula (VI) can be mentioned as desirable image stabilizers which are used together with the compounds of this invention.

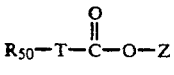

Formula (V)

$Z-SO_2M$ Formula (VI)

In the formula, $R_{50}$ represents an alkyl group, alkenyl group, aryl group or heterocyclic group and T represents —O— or a simple single bond. Z represents an aryl group or heterocyclic group, M represents a hydrogen atom or a group of atoms which forms an inorganic or organic salt.

To explain general formula (V) and general formula (VI) in further detail, $R_{50}$ represents an alkyl group (for example, methyl, ethyl, 2-ethylhexyl, hexadecyl and 2,4-di-t-phenoxyethyl), alkenyl group (for example, vinyl and allyl), aryl group (for example, phenyl and p-methoxyphenyl) or a heterocyclic group (for example, 3-pyridyl and 4-pyridyl), and it is preferably an alkyl group. Z represents an aryl group (for example, phenyl, 2,6-dichlorophenyl, 2,6-dichloro-4-ethoxycarbonylphenyl, 3,5-di-2-ethylhexylcarbamoylphenyl) or a heterocyclic group (for example, 2-pyridyyl, 3-(1-phenyl-2-pyrazolyl) and 3-(1-phenyl-4-dimethyl-2-pyrazolyl), and it is preferably an aryl group. M is a hydrogen atom or a group of atoms which forms an inorganic salt (for example, a lithium salt, sodium salt or potassium salt) or an organic salt (for example, a tetraethylamine salt or ammonium salt), and it is preferably an inorganic salt.

Representative examples of these compounds are given below but the invention is not limited to these.

(V-1)

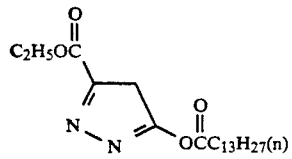

(V-2)

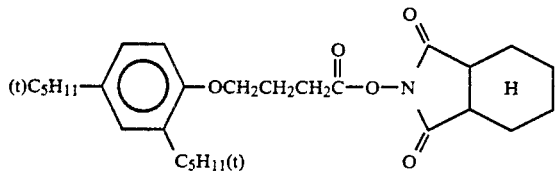

-continued
(V-3)
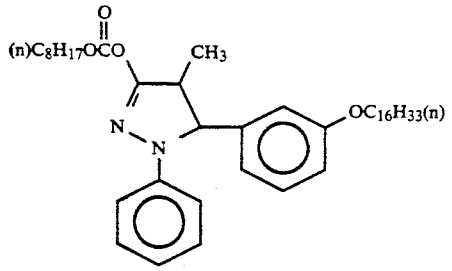
(V-4)
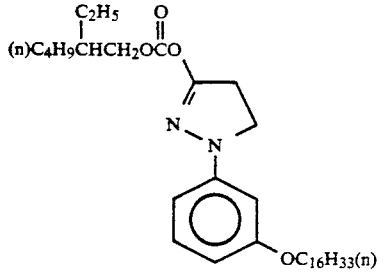
(V-5)
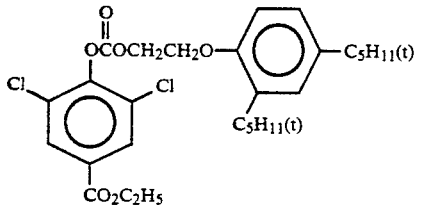
(V-6)
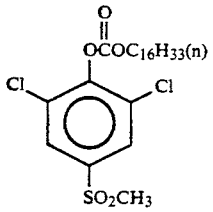
(V-7)
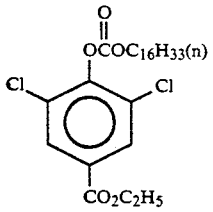
(V-8)
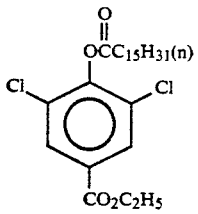
(V-9)
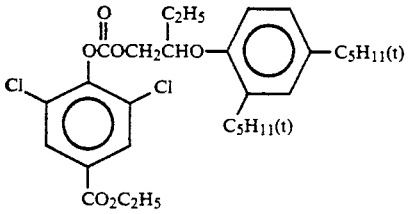

-continued
(V-10)
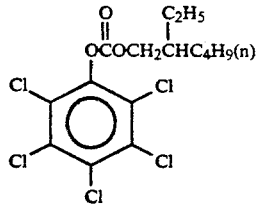
(V-11)
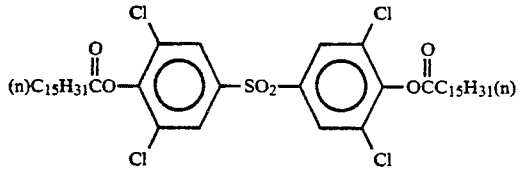
(V-12)
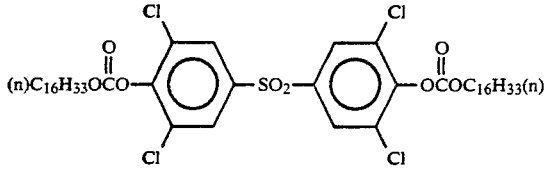
(V-13)
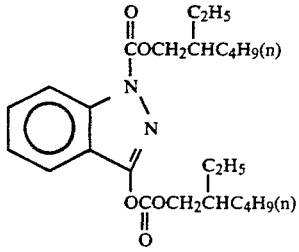
(VI-1)
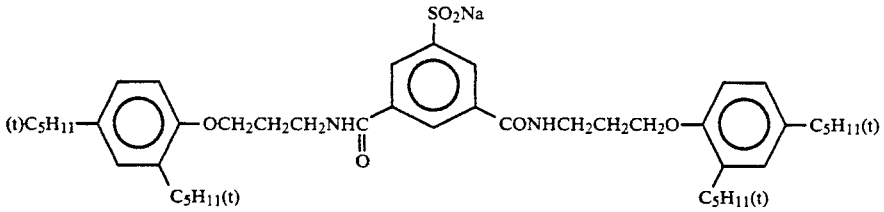
(VI-2)
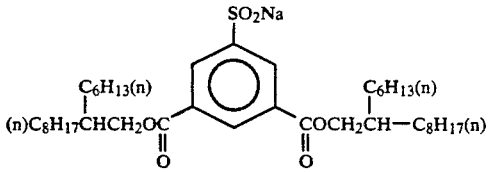
(VI-3)
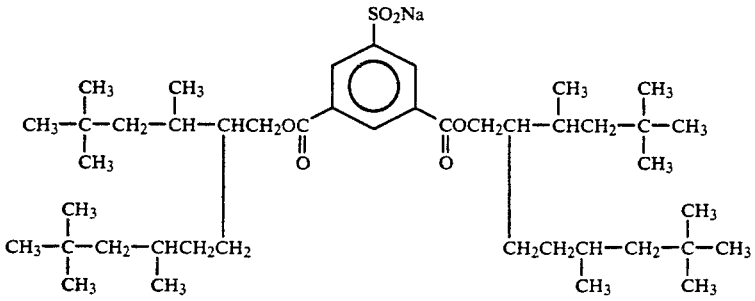

-continued
(VI-4)
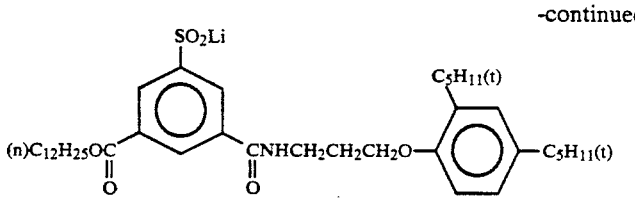
(VI-5)
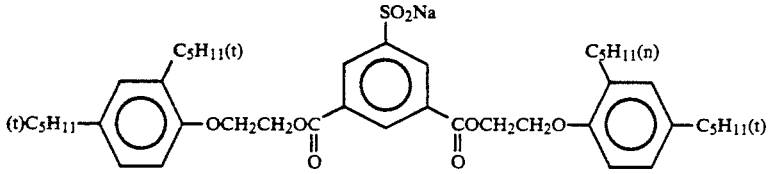
(VI-6)
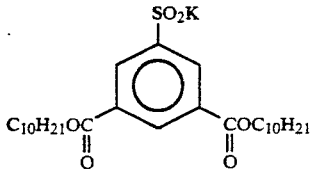
(VI-7)
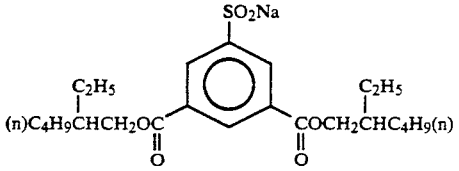
(VI-8)
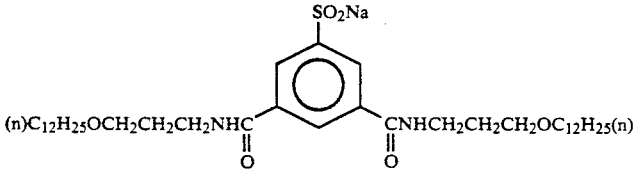
(VI-9)
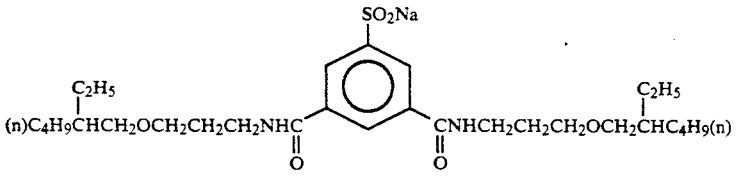
(VI-10)
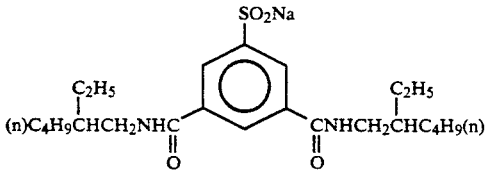
(VI-11)
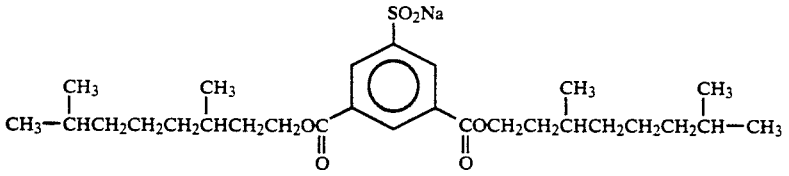
(VI-12)
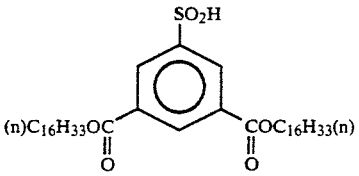

-continued
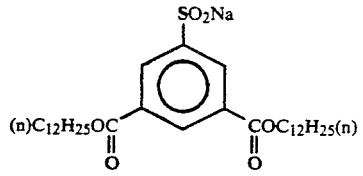
(VI-13)
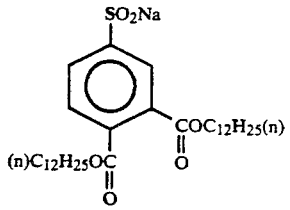
(VI-14)
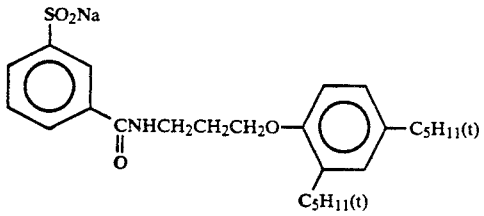
(VI-15)
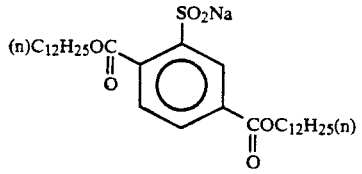
(VI-16)
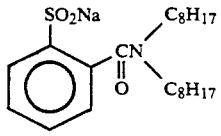
(VI-17)
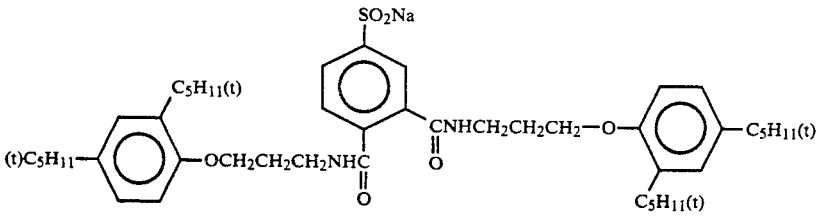
(VI-18)
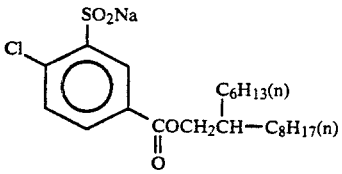
(VI-19)
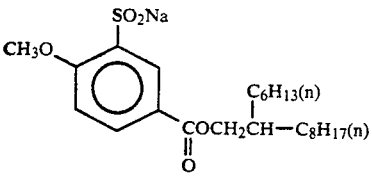
(VI-20)

-continued (VI-21)

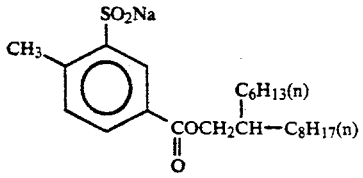

The compounds of general formula (V) and general formula (VI) can be synthesized by the methods described, for example, in JP-A-62-283338, JP-A-63-115866, JP-A-63-115855, European Patent 255,722 and by methods in accordance with these.

These compounds may be used singly or jointly with the compounds of general formula (V) and general formula (VI).

The amount of these compounds which is added is 1 to 200 mol % and preferably 5 to 50 mol % with respect to the coupler.

The color photographic materials of this invention can be constructed by providing, on a support, coatings of at least one blue-sensitive silver halide emulsion layer, green-sensitive silver halide emulsion layer and red-sensitive silver halide emulsion layer. With general color printing papers, it is common to provide coatings on the support in the order given above but different sequences are acceptable. It is possible to effect color reproduction by the subtractive method by including in these photosensitive emulsion layers dyes which are in an additive complementary color relationship with the sensitizing light and the silver halide emulsions having sensitivities in their respective wavelength regions—which is to say so-called color couplers which form yellow for blue, magenta for green and cyan for red. However they may also have a structure such that the photosensitive layer and the hue which the coupler forms do not correspond in the way described above.

Emulsions comprising silver chlorobromide or silver chloride which essentially contain no silver iodide are preferably used for as the silver halide emulsions used in this invention. Here, "essentially contain no silver iodide" refers to a silver iodide content of 1 mol % or less and preferably 0.2 mol % or less. The halogen composition of the emulsion may be even or varied between the grains, but it is easier to make the properties of the grains uniform if an emulsion having an even halogen composition between grains is used. Furthermore, as regards the halide compositional distribution within the silver halide emulsion grains, it is possible to make an appropriate selection of so-called uniform structure grains in which the composition is even, whichever portion of the silver halide grain is considered; so-called layer structure grains in which the halogen composition differs between the core within the silver halide grain and the shell (one layer or several layers) which surrounds this core; or grains with a structure having portions in which the halide composition differs in a non-layered manner within the grain or on its surface (structures in which, when the grain surface is involved, portions with different compositions have been joined to an edge, corner or surface). It is more advantageous to use the latter two than the uniform structure grains to achieve high speeds and these are also desirable from the aspect of pressure resistance. When the silver halide grains have a structure as described above, there may be a distinct boundary at the boundary between the different portions in the silver halide composition, or there may be an indistinct boundary with mixed crystals being formed by the compositional differences, or again the grains may be ones in which there are positively continuous structural changes.

In the halogen composition of these silver chlorobromide emulsions, it is possible to use any desired silver bromide/silver chloride ratio. This ratio may be in a wide range in accordance with the intended purpose, but it is preferable to use grains with a silver chloride ratio of 2% or more.

Furthermore, it is preferable to use so-called high silver chloride emulsions, which have a high silver chloride content, as photosensitive materials appropriate to rapid processing. The silver chloride content of these high silver chloride emulsions is preferably 90 mol % or more and more preferably 95 mol % or more.

Preferred amongst such high silver chloride emulsions are those with a structure having a localized silver bromide phase within and/or on the surfaces of silver halide grains in a laminar or non-laminar form as described previously. The halogen composition of the above-mentioned localized phase is preferably at least 10 mol %, and more preferably in excess of 20 mol % of the silver bromide content. These localized phases may be within the grain, on edges or corners of the grain surface or on the surfaces and, as one preferred example, it is possible to mentioned where it has been epitaxially grown on the corner portion of the grain.

Meanwhile, even with high silver chloride emulsions with a silver chloride content of 90 mol % or more, it is preferable to use grains with a uniform structure with little halogen composition distribution within the grain in order to suppress, as much as possible, speed reductions which occur when a photosensitive material sustains pressure.

Additionally, it is also effective to further increase the silver chloride content of the silver halide emulsion in order to decrease the replenishment amount for the development processing solutions. In cases such as this, it is preferable to use almost pure silver chloride emulsions of the kind for which the silver chloride content is 98 mol % to 100 mol %. When considering the speed and fogging, silver chlorobromide emulsions with a silver chloride content of 98 to 99.9 mol % are preferred.

The average grain size (the numerical average taking the diameter of the circle equivalent to the projected surface area of a grain as the grain size) of the silver halide grains contained in silver halide emulsions used in this invention is preferably 0.1$\mu$ to 2$\mu$.

Furthermore, as regards their grain size distribution, so-called monodisperse emulsions with a variation coefficient (the standard deviation in the grain size divided by the average grain size) of 20% or less and preferably 15% or less are preferred. Here, it is preferable to use the abovementioned monodisperse emulsions by blending them in the same layer or to carry out multi-layer coating in order to obtain a wide latitude.

As regards the shape of the silver halide grains contained in the photographic emulsion, it is possible to use cubic, tetradecahedral, octahedral and other such regular crystal forms, spherical, tabular and other such irregular crystal forms or grains having a complex form of these. Furthermore, the grains may consist of a mixture of grains having various crystal forms. Of these, emulsions containing 50% or more, preferably 70% or more and more preferably 90% or more of grains having the abovementioned regular crystal forms are preferred in this invention.

In addition to these, it is also possible to make preferred use of emulsions of a kind in which tabular grains with an average aspect ratio (the circle-calculated diameter/thickness) of 5 or more and preferably 8 or more constitute more than 50% of all the grains by projected surface area.

The silver chlorobromide emulsion used in this invention can be prepared using a method such as described in *Chimie et Physique Photographique* by P. Glafkides (published by the Paul Montel Co., 1967), *Photographic Emulsion Chemistry* by G. F. Duffin (published by the Focal Press Co., 1966) and *Making and Coating Photographic Emulsion* by V. L. Zelikman et al. (published by the Focal Press Co., 1964). Thus, the acidic method, neutral method, ammonia method and the like are all acceptable, and the one-sided mixing method, simultaneous mixing method or a combination thereof or another such method may be used as the system for reacting soluble silver salts and soluble halogen salts. It is also possible to use the method in which the grains are formed in an excess of silver ions (the so-called reverse mixing method). As one form of the simultaneous mixing method, it is possible to use the method in which the pAg in the liquid phase in which the silver halide is formed is kept constant, which is to say the so-called controlled double jet method. Using this method it is possible to obtain silver halide emulsions in which the crystal form is regular and the grain size is close to uniform.

With the silver halide emulsions used in this invention it is possible to introduce various polyvalent metal ion impurities in the emulsion grain formation or physical ripening stages. As examples of the compounds used, it is possible to mention the salts of cadmium, zinc, lead, copper, thallium or the like, or salts or complex salts of Group VIII elements such as iron, ruthenium, rhodium, palladium, osmium, iridium, platinum and the like. The abovementioned Group VIII elements are used with particular preference. The amount of these compounds which is added will extend over a wide range in accordance with what is intended, but will preferably be $10^{-9}$ to $10^{-2}$ with respect to the silver halide.

The silver halide emulsions used in this invention normally undergo chemical sensitization and spectral sensitization.

For the chemical sensitization, it is possible to make single or conjoint use of sulfur sensitization as typified by the addition of unstable sulfur compounds, precious metal sensitization as typified by gold sensitization, reduction sensitization or the like. As regards the compounds used in the chemical sensitization, those described in the specification of JP-A-62-215272, from the bottom right column on page 18 to the top right column on page 22 are used for preference.

Spectral sensitization is carried out in order to provide the emulsion of each layer of the photosensitive material of this invention with a spectral sensitivity in the desired light wavelength region. In this invention this is preferably performed by adding dyes which absorb light in the wavelength region corresponding to the desired spectral sensitivity; i.e. spectrally sensitizing dyes. By way of examples of spectrally sensitizing dyes which can be used here it is possible to mention those described in *Heterocyclic Compounds—Cyanine Dyes and Related Compounds* by F. M. Harmer (John Wiley & Sons [New York, London], 1964). As examples of actual compounds, it is preferable to use those described in the previously cited specification of JP-A-62-215272, top right column of page 22 to page 38.

It is possible to add various compounds or various precursors thereof to the silver halide emulsions used in this invention in order to prevent fogging during the manufacturing process, storage or photographic processing of the photosensitive material or to stabilize its photographic performance. These are generally referred to as photographic stabilizers. It is preferable to use those described in the previously cited specification of JP-A-62-215272, page 39 to page 72 as specific examples of these compounds.

The emulsions used in this invention may be so-called surface latent image emulsions in which the latent image forms mainly on the surface of the grain or they may be so-called internal latent image emulsions in which the latent image forms mainly on the inside of the grain.

In color photosensitive materials, it is common to use yellow couplers, magenta couplers and cyan couplers which respectively form yellow, magenta and cyan by coupling with the oxidized forms of aromatic amine-based color developing agents.

Of the yellow couplers used in this invention acylacetamide derivatives such as benzoylacetoanilide and pivaloylacetoanilide are preferred.

Of these, those represented by the following general formulae [Y-1] and [Y-2] are appropriate as yellow couplers.

Formula [Y-1]

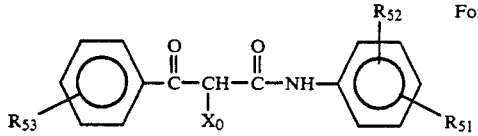

Formula [Y-2]

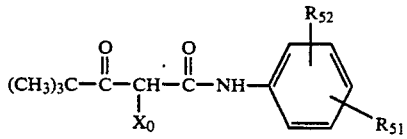

In the formulae, $X_0$ represents a hydrogen atom or an eliminating group released at a coupling reaction group. $R_{51}$ represents a diffusion-resistant group with 8–32 carbon atoms, and $R_{52}$ represents a hydrogen atom, 1 or more halogen atoms, a lower alkyl group, lower alkoxy group or diffusion-resistant group with 8–32 carbon atoms. $R_{53}$ represents a hydrogen atom or substituent group. When there are 2 or more of $R_{53}$ these may be identical or different.

Details of pivaloylacetoanilide yellow couplers are described in U.S. Pat. No. 4,622,287, line 15 of column 3 to line 39 of column 8 and the specification of U.S. Pat. No. 4,623,616, line 50 of column 14 to line 41 of column 19.

Details of benzoylacetoanilide yellow couplers are described, for example, in U.S Pat. Nos. 3,408,194, 3,933,501, 4,046,575, 4,133,958 and 4,401,752.

By way of specific examples of pivaloylacetoanilide yellow couplers, it is possible to mention compound examples (Y-1) to (Y-39) as described in the previously mentioned U.S. Pat. No. 4,622,287, column 37 to column 54, and of these (Y-1), (Y-4), (Y-6), (Y-7), (Y-15), (Y-21), (Y-22), (Y-23), (Y-26), (Y-35), (Y-36), (Y-37), (Y-38) and (Y-39) are preferred.

Additionally, it is possible to mention compound examples (Y-1) to (Y-33) of the previously mentioned U.S. Pat. No. 4,623,616, column 19 to column 24, and of these (Y-2), (Y-7), (Y-8), (Y-12), (Y-20), (Y-21), (Y-23) and (Y-29) are preferred.

By way of other preferred substances, it is possible to mention the typical specific example (34) described in column 6 of U.S. Pat. No. 3,408,194, compound examples (16) and (19) described in column 8 of U.S. Pat. No. 3,933,501, compound example (9) described in columns 7–8 of U.S. Pat. No. 4,046,575, compound example (1) described in column 5 to 6 of U.S. Pat. No. 4,133,958, compound example 1 described in column 5 of U.S. Pat. No. 4,401,752 and the following compounds a) to h).

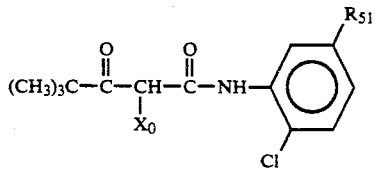

| Compound | $R_{51}$ | $X_0$ |
|---|---|---|
| a | $-COOCH(CH_3)COOC_{12}H_{25}$ | 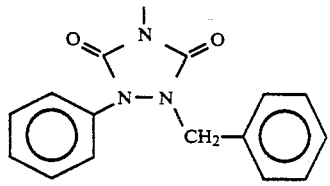 |
| b | $-COOCH(C_4H_9)COOC_{12}H_{25}$ | As above |
| c | 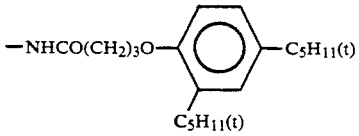 | 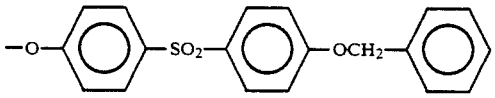 |
| d | As above | 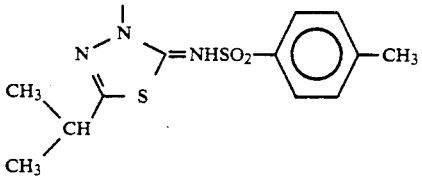 |
| e | As above | 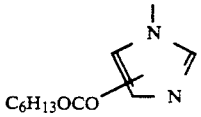 |
| f | $-NHSO_2C_{12}H_{25}$ | 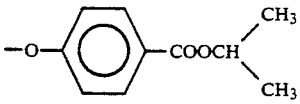 |
| g | $-NHSO_2C_{16}H_{33}$ | 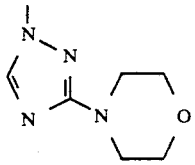 |

-continued

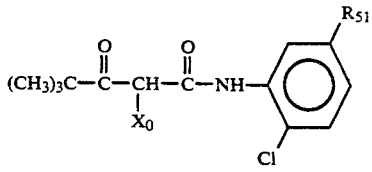

| Compound | $R_{51}$ | $X_0$ |
|---|---|---|
| h | $-NHC(O)C(CH_3)CH_2SO_2C_{12}H_{25}$ | 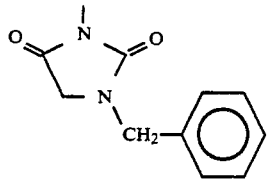 |

Of the couplers mentioned above, those which have a nitrogen atom for the leaving atom are particularly preferred.

Phenolic cyan couplers and naphtholic cyan couplers are most typical of cyan couplers. By way of phenolic cyan couplers, there are those which have an acylamino group in the 2-position and an alkyl group in the 5-position of the phenol nucleus as described, for example, in U.S. Pat. Nos. 2,369,929, 4,518,687, 4,511,647 and 3,772,002 (including polymer couplers), typical specific examples of these including the coupler of embodiment example 2 described in Canadian Patent 625,822, compound (1) described in U.S. Pat. No. 3,772,002, compound (I-4) and (I-5) described in U.S. Pat. No. 4,564,590, compounds (1), (2), (3) and (24) described in JP-A-61-39045 and compound (C-2) described in JP-A-62-70846.

By way of phenolic cyan couplers there are also the 2,5-diacylaminophenol-based couplers described in U.S. Pat. Nos. 2,772,162, 2,895,826, 4,334,011, 4,500,653 and JP-A-59-164555, specific examples of these including compound (V) described in U.S. Pat. No. 2,895,826, compound (17) described in U.S. Pat. No. 4,557,999 compounds (2) and (12) described in U.S. Pat. No. 4,565,777, compound (4) described in U.S. Pat. No. 4,124,396 and compound (I-19) described in U.S. Pat. No. 4,613,564.

By way of phenolic cyan couplers there are also those in which a nitrogen-containing heterocyclic ring has been condensed on the phenol nucleus as described in U.S. Pat. Nos. 4,372,173, 4,564,586, 4,430,423, JP-A-61-390441 and JP-A-62-257158, and typical specific examples these include couplers (1) and (3) described in U.S. Pat. No. 4,327,173, couplers (3) and (16) described in U.S. Pat. No. 4,564,586, couplers (1) and (3) described in U.S. Pat. No. 4,430,423 and the following compounds.

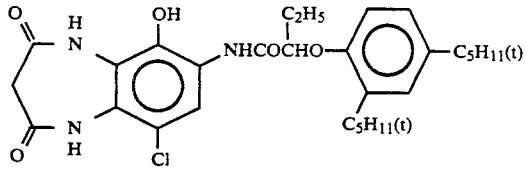

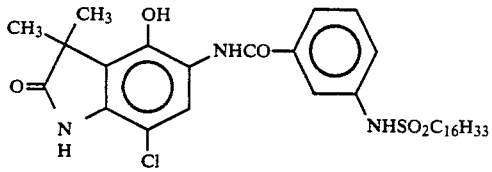

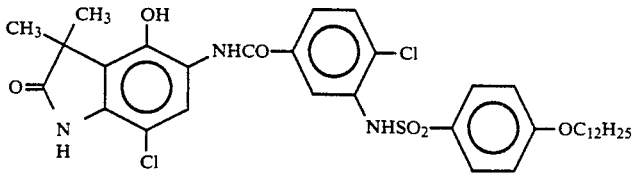

-continued
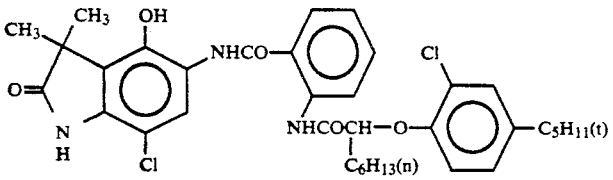
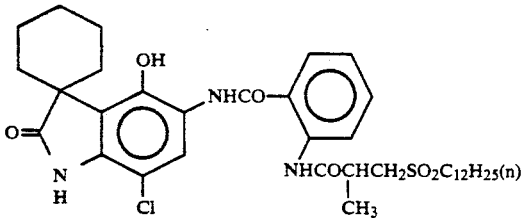
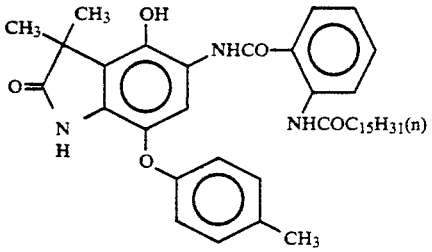
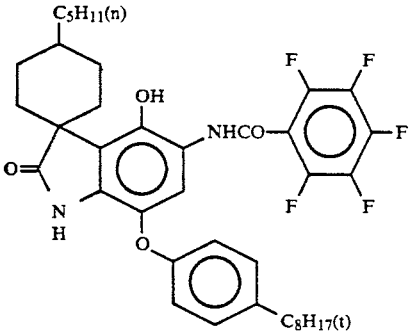
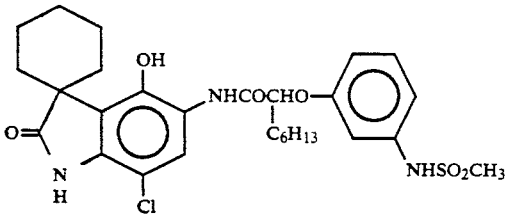
Apart from cyan couplers of the type described above, it is also possible to use the diphenylimidazole-based cyan couplers described in the laid-open European Patent Application EP 0,249,453A2, which are:
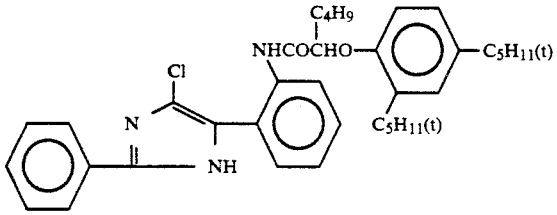

-continued

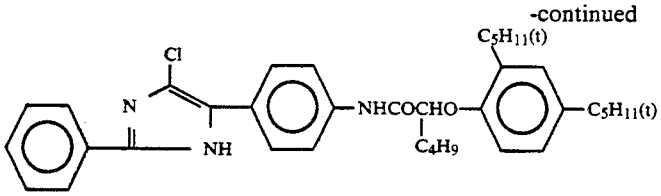

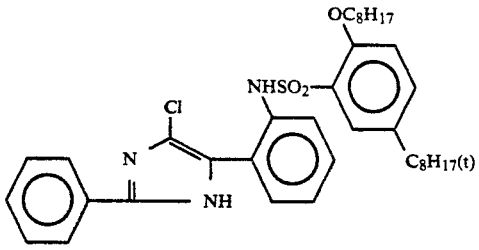

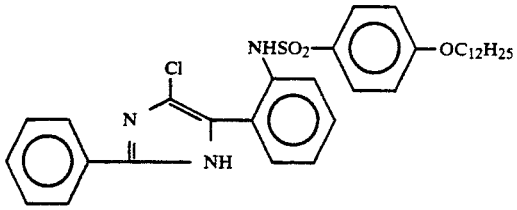

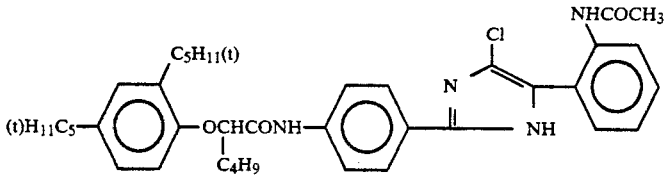

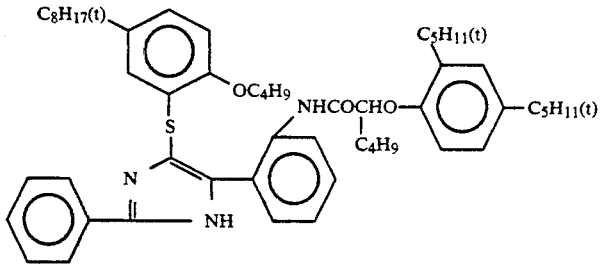

In addition, by way of phenolic cyan couplers, there are the ureido-based couplers described in U.S. Pat. Nos. 4,333,999, 4,451,559, 4,444,872, 4,427,767, 4,579,813 and European Patent (EP) 067,689B1, and typical specific examples of these include coupler (7) described in U.S. Pat. No. 4,333,999, coupler (1) described in U.S. Pat. No. 4,451,559, coupler (14) described in U.S. Pat. No. 4,444,872, coupler (3) described in U.S. Pat. No. 4,427,767, couplers (6) and (24) described in U.S. Pat. No. 4,609,619, couplers (1) and (11) described in U.S. Pat. No. 4,579,813, couplers (45) and (50) described in European Patent (EP) 067,689B1 and coupler (3) described in JP-A-61-42658.

By way of naphtholic cyan couplers, there are those having an N-alkyl-N-arylcarbamoyl group in the naphthol nucleus (for example, U.S. Pat. No. 2,313,586), those having an alkylcarbamoyl in the 2-position (for example, U.S. Pat. Nos. 2,474,293 and 4,282,312), those having an arylcarbamoyl group in the 2-position (for example, JP-B-50-14523), those having a carboxylic acid amido or sulfonamido group in the 5-position (for example, JP-A-60-237448, JP-A-61-145557 and JP-A-61-153640), those having an aryloxy leaving group (for example, U.S. Pat. No. 3,476,563), those having a substituted alkoxy leaving group (for example, U.S. Pat. NO. 4,296,199) and those having a glycolic acid leaving group (for example, JP-B-60-39217).

These couplers can be included in the emulsion layers by dispersion with at least one type of high-boiling organic solvent. High-boiling organic solvents represented by the following formulae (A) to (E) are preferably used.

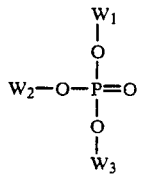

Formula (A)

$W_1-COO-W_2$ Formula (B)

-continued

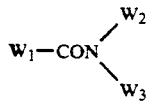

Formula (C)

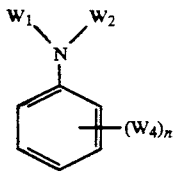

Formula (D)

$W_1—O—W_2$ Formula (E)

(In the formula, $W_1$, $W_2$ and $W_3$ respectively represent substituted or unsubstituted alkyl groups, cycloalkyl groups, alkenyl groups, aryl groups or heterocyclic groups, $W_4$ represents $W_1$, $OW_1$ or S-$W_1$, n is an integer of 1 to 5 and, when n is 2 or more, $W_4$ may be identical or different, and in general formula (E) $W_1$ and $W_2$ may form a condensed ring).

Furthermore, these couplers can be impregnated into loadable latex polymers (for example U.S. Pat. No. 4,203,716) in the presence or without the presence of the high-boiling organic solvents mentioned above, or they may be dissolved in a water-insoluble or organic-solvent-soluble polymer and emulsified and dispersed in a hydrophilic aqueous colloid solution.

The monomeric polymers or copolymeric polymers described on pages 12–30 of the specification of laid-open World Patent W088/00723 are preferably used and the use of acrylamide-based polymers is particularly preferred from the point of view of the stability of the color image.

The photosensitive materials used in this invention may contain anti-color-fogging agents, hydroquinone derivatives, aminophenol derivatives, gallic acid derivatives, ascorbic acid derivatives and the like.

Various color-fading preventors can be used in combination with the compounds represented by general formulae (III) or (IV) in the photosensitive materials of this invention. Namely, hydroquinones, 6-hydroxychromans, 5-hydroxycoumarans, spirochromans, p-alkoxyphenols, bisphenols and sundry other hindered phenols, gallic acid derivatives, methylenedioxybenzenes, aminophenols, hindered amines and ether or ester derivatives of these compounds in which the phenolic hydroxyl group has been silylated or alkylated can be mentioned as typical examples of organic color-fading preventors for cyan, magenta and/or yellow images. Furthermore, it is also possible to use metal complexes as represented by (bis-salicylaldoximate)nickel and (bis-N,N-dialkyldithiocarbamate)nickel.

Specific examples of organic color-fading preventors are described in the specifications of the following patents.

Hydroquinones are described in U.S. Pat. Nos. 2,360,290, 2,418,613, 2,700,453, 2,701,197, 2,728,659, 2,732,300, 2,735,765, 3,982,944, 4,430,425, G.B. Patent 1,363,921, U.S. Pat. Nos. 2,710,801 and 2,816,208, 6-hydroxychromans, 5-hydroxycoumarans and spirochromans are described, for example, in U.S. Pat. Nos. 3,432,300, 3,573,050, 3,574,627, 3,698,909, 3,764,337 and JP-A-52-152225, spiroindans are described in U.S. Pat. No. 4,360,589, p-alkoxyphenols are described, for example, in U.S. Pat. No. 2,735,765, G.B. Patent 2,066,975, JP-A-59-10539, JP-B-57-19765, hindered phenols are described, for example, in U.S. Pat. No. 3,700,455, JP-A-52-72224, U.S. Pat. No. 4,228,235 and JP-B-52-6623, gallic acid derivatives, methylenedioxybenzenes and aminophenols are respectively described, for example, in U.S. Pat. Nos. 3,457,079, 4,332,886 and JP-B-56-21144, hindered amines are described, for example in U.S. Pat. Nos. 3,336,135, 4,268,593, G.B. Patents 1,326,889, 1,354,313, 1,410,846, JP-B-41-1420, JP-A-58-114036, JP-A-59-53846, JP-A-59-78344, and metal complexes are described, for example, in U.S. Pat. Nos. 4,245,018, 4,685,603, 4,050,938, 4,241,155 and G.B. Patent 2,027,731(A). With these compounds, the objective can be achieved by adding them to the photosensitive layer normally at 5 to 100% by weight with regard to the respective color couplers by co-emulsifying them together with the couplers. In order to prevent degradation of the cyan image by heat and, in particular, light, it is more effective to introduce ultraviolet absorbers in the layers on either side neighboring the cyan-forming layer.

By way of ultraviolet absorbers in the hydrophilic colloid layers of the photosensitive materials produced using this invention, it is possible to use, for example, benzotriazole compounds (for example, JP-B-62-13658 and JP-A-55-50245), 4-thiazolidone compounds (for example, U.S. Pat. Nos. 3,314,794 and 3,352,681), benzophenone compounds (such as those described in JP-A-46-2784), cinnamic acid ester compounds (for example, those described in U.S. Pat. Nos. 3,705,805 and 3,707,375), butadiene compounds (such as those described in U.S. Pat. No. 4,045,229) or benzooxydol compounds (for example, those described in U.S. Pat. No. 3,700,455). Ultraviolet-absorbing couplers (for example α-naphthol-based cyan dye forming couplers) and ultraviolet-absorbing polymers and the like may also be used. These ultraviolet absorbers may be mordanted in specific layers.

Water-soluble dyes may be included in the photosensitive materials produced using this invention as filter dyes in the hydrophilic colloid layers or in order to prevent irradiation and other such purposes. Such dyes include oxonol dyes, hemioxonol dyes, styryl dyes, merocyanine dyes, cyanine dyes and azo dyes. Of these, the oxonol dyes, hemioxonol dyes and merocyanine dyes are effective.

It is advantageous to use gelatin as a binder or protective colloid which can be used in the emulsion layers of the photosensitive materials of this invention, but it is possible to use other hydrophilic colloids either individually or together with gelatin.

The gelatin in this invention may be lime-treated or it may be treated using an acid. The details of gelatin production are described in *The Macromolecular Chemistry of Gelatin* by Arthur Weiss (Academic Press, published 1964).

Cellulose nitrate film and polyethylene terephthalate and other such transparent films and reflective supports which are commonly used in photographic materials can be used as the supports which are employed in this invention. In view of the object of this invention, it is more preferable to use a reflective support.

"Reflective support" as used in this invention means one which sharpens the dye image which is formed in the silver halide emulsion layers by raising the reflectance. Such reflective supports include ones in which the support has been coated with a hydrophobic resin containing a dispersion of light-reflecting substances such as titanium oxide, zinc oxide, calcium carbonate and calcium sulfate, and ones in which a hydrophobic resin containing a dispersion of light-reflecting substances has been used as the support. By way of example, there are baryta paper, polyethylene-coated paper, polypropylene-based synthetic papers, transparent supports which are conjointly provided with reflective layers or which make conjoint use of reflective substances, examples including glass plate, polyethylene terephthalate, cellulose triacetate or cellulose nitrate and other such polyester films, polyamide films, polycarbonate films, polystyrene films and vinyl chloride resins and the like and these supports can be chosen appropriately in accordance with the intended use.

For the light-reflecting substance, a white-pigment may be adequately milled in the presence of a surfactant and it is preferable to use pigment grains the surfaces of which have been treated with di-, tri- or tetra-hydric alcohol.

The occupied surface area percentage per stipulated unit surface area for the fine white pigment grains can be determined most typically by dividing the observed surface area into touching unit surface areas of 6 $\mu m \times 6$ $\mu m$ and measuring the surface area percentage (Ri) occupied by the fine grains projected in the unit surface area. The variation coefficient for the occupied surface area percentage can be determined by the ratio $s/\overline{R}$ for the standard deviation s of Ri with regard to the average value for Ri ($\overline{R}$). The number of unit surface areas investigated (n) is preferably 6 or more. Thus, the variation coefficient $s/\overline{R}$ can be determined from $$\sqrt{\frac{\sum_{i=1}^{n} (Ri - R)^2}{n-1}} \Big/ \frac{\sum_{i=1}^{n} Ri}{n}$$

The variation coefficient in the surface area percentage occupied by the fine pigment grains in this invention is preferably 0.15 or less and particularly preferably 0.12 or less. When it is 0.08 or less it is possible to state that the dispersion of the grains is essentially "uniform".

The color photographic materials of this invention preferably undergo color development, bleach-fixing and washing processing (or stabilization processing). The bleaching and the fixing need not be in one bath as previously stated but may be carried individually.

In cases involving continuous processing, it is desirable that the replenishment amount for the developing solution should be on the low side from the point of view of economizing on the source materials and reducing pollution.

The preferred color developing solution replenishment amount is less than 200 ml per 1 $m^2$ of photosensitive material. This is more preferably 120 ml or less. This is most preferably 100 ml or less. However, replenishment amount as referred to here denotes the amount of so-called color developer replenishment solution which is replenished, and the amount of additives and the like which compensate for degradation upon aging and the concentration fraction comes outside the bounds of the replenishment amount. Moreover, additives as referred to herein denotes, for example, water for diluting concentration, preservatives which readily degrade over time and alkalis for raising the pH.

The color developing solutions which are applied to this invention are preferably aqueous alkali solutions which have primary aromatic amine color developing agents for their main components. Aminophenol-based compounds are effective as such color developing agents but p-phenylenediamine-based compounds are preferably used and typical examples of these include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and the sulfuric acid salts, hydrochloric acid salts or p-toluenesulfonic acid salts thereof. Two or more of these compounds can be used conjointly as required.

Color developing solutions generally contain pH buffers such as alkali metal carbonates, borates and phosphates, antifoggants and development inhibitors such as bromine salts, iodine salts, benzimidazoles, benzothiazoles or mercapto compounds. Furthermore, if required, it is possible to use various preservatives such as hydroxylamines, diethylhydroxylamines, hydrazine sulfite, phenylsemicarbazides, triethanolamine, catechol sulfonates and triethylenediamine(1,4-diazabicyclo[2,2,-2]octane), organic solvents such as ethylene glycol and diethylene glycol, development accelerators such as benzyl alcohol, polyethylene glycol, quaternary ammonium salts and amines, dye-forming couplers, competitive couplers, sodium borohydride and other such fogging agents, 1-phenyl-3-pyrazolidone and other such auxiliary developing agents, viscosity enhancers, various chelating agents as typified by aminopolycarboxylic acid, aminopolyphosphonic acid, alkylphosphonic acid and phosphonocarboxylic acid, examples including ethylenediaminetetraacetic acid, nitrilotriacetic acid, diethylenetriaminepentaacetic acid, cyclohexanediaminetetraacetic acid, hydroxyethylimidinoacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof.

When using a reversal process, color development is usually carried out after black-and-white development. In the black-and-white developing solutions, it is possible to use, either singly or in combination, known black-and-white developing agents such as a dihydroxybenzene such as hydroquinone, a 3-pyrazolidone such as 1-phenyl-3-pyrazolidone or an aminophenol such as N-methyl-p-aminophenol.

The pH of these color developing solutions and black-and-white developing solutions is generally 9 to 12. Furthermore, the replenishment amounts for these developing solutions will partly depend on the color photographic material being processed but is generally 3 or less per square meter of photosensitive material and it will also be possible to reduce this to 500 ml or less by reducing the bromide ion concentration in the replenishment solution. When the replenishment amount is reduced, it is preferable to prevent aerial oxidation and evaporation of the solution by reducing the surface area of the processing solution which is in contact with the air. Furthermore, it is also possible to reduce the replenishment amount by using a method which suppresses the build-up of bromide ions in the developing solution.

The photographic emulsion layer is normally subjected to bleach processing after color development. The bleach processing may be carried out simultaneously with a fixing process (bleach-fixing processing) or it may be carried out separately. Moreover, a processing method in which bleach-fixing is carried out after bleach processing is also acceptable in order to speed-up the processing. Moreover it is also possible to carry out processing in bleach-fixing baths for which two tanks are linked, fixing processing before the bleach-fixing processing, or bleach processing after bleach-fixing processing, as required and in accordance with the intended objectives. By way of bleaching agents, it is possible to use compounds of polyvalent metals such as iron(III), cobalt(III), chromium(VI) and copper(II), peroxides, quinones, nitro compounds and the like. By way of representative bleaching agents, it is possible to use ferricyanide compounds; dichromates; complex organic salts of iron(III) or cobalt(III), examples including the complex salts of ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid and other such aminopolycarboxylic acids or citric acid, tartaric acid or malic acid; persulfates; bromates; permanganates; and nitrobenzenes. Of these, iron(III) aminopolycarboxylic acid complex salts, notably iron(III) ethylenediaminetetraacetic acid complex salts and persulfates are preferred from the standpoint of the rapidity of processing and the prevention of environmental pollution. Moreover, iron(III) aminopolycarboxylic acid complex salts are particularly useful in both bleaching solutions and bleach-fixing solutions. The pH of the bleaching solutions or bleach-fixing solutions which use these iron(III) aminopolycarboxylic acid complex salts is normally 5.5 to 8, but it is possible to carry out processing at a lower pH in order to speed-up the process.

If required, it is possible to use bleaching accelerators in the bleaching solutions, bleach-fixing solutions and baths previous thereto. Specific examples of useful bleaching accelerators are described in the following specifications: the compounds having mercapto groups or disulfide groups described in, for example, U.S. Pat. No. 3,893,858, West German Patents 1,290,812, 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure* No. 17129 (July 1978); the thiazolidine derivatives described in JP-A-50-140129; the thiourea derivatives described in JP-B-45-8506, JP-A-52-20832, JP-A-53-32735 and U.S. Pat. No. 3,706,561; the iodine compounds described in West German Patent 1,127,715 and JP-A-58-16235; the polyoxyethylene compounds described in West German Patents 996,410 and 2,748,430; the polyamine compounds described in JP-B-45-8836; the compounds described in JP-A-49-42434, JP-A-49-59644JP-A-53-94927, JP-A-54-35727, JP-A-55-26506 and JP-A-58-163940; and bromine compound ions. Of these, the compounds having a mercapto group or disulfide group are preferred from the point of view of their large accelerator effect and the compounds described in U.S. Pat. No. 3,893,858, West German Patent 1,290,812 and JP-A-53-95630 are particularly preferred. Moreover, the compounds described in U.S. Pat. No. 4,552,834 are also preferred. These bleach accelerators may be added to the sensitive material. These bleach accelerators are particularly effective during the bleach-fixing of color photosensitive materials for photographic use.

By way of fixing agents, it is possible to mentioned thiosulfates, thiocyanates, thioether compounds, thioureas and large amounts of iodine salts and it is common to use thiosulfates; in particular ammonium thiosulfate salts are most widely used. Sulfites and bisulfites or carbonyl bisulfite adducts are preferred as preservatives for bleach-fixing solutions.

It is common for the silver halide color photographic materials of this invention to undergo washing and/or stabilization processes after a desilvering process. The amount of washing water in the washing process can be set over a wide range in accordance with various conditions including the characteristics (such as the couplers and other such materials used) and application of the photosensitive material, the temperature of the washing water, the number of washing tanks (the number of stages), the direction of flow, the replenishment system such as direct current and the like. Amongst these, the relationship between the number of washing tanks and the amount of water in a multi-stage countercurrent system can be determined by the method described in *The Journal of the Society of Motion Picture and Television Engineers,* Vol. 64, pp. 248-253 (May 1955).

The amount of washing water can be reduced greatly by the use of a multi-stage countercurrent system as described in the literature mentioned above, but there is the problem that bacteria propagate due to the increase in the residence time of the water within the tank and the floating matter which is produced adheres to the photosensitive material. The method for reducing calcium ions and magnesium ions which is described in Japanese Patent Application No. 61-131632 is extremely effective as a measure for solving this problem in the processing of the color photosensitive materials of this invention. Furthermore, it is also possible to use the isothiazolone compounds and thiabendazoles described in JP-A-57-8542, chlorinated sodium isocyanurate and other such chlorine-based bactericides as well as benzotriazole, and the bactericides described in "Sakkin Bobaizai no Kagaku" (The Chemistry of Bactericides and Antifungal Agents) by H. Horiguchi, *Biseibutsu no Genkin, Sakkin, Bobai Gijutsu* (Sterilization, Bactericidal and Antifungal Techniques for Microorganisms) edited by the Hygiene Techniques Society and *Bokin Bobaizai Jiten* (Antimicrobial and Antifungal Dictionary) edited by the Antimicrobial Antifungal Study Society of Japan.

The pH of the washing water in the processing of the photosensitive materials of this invention is 4 to 9 and preferably 5 to 9. The washing water temperature and washing time can be set variously by, for example, the characteristics and application of the photosensitive material, and in general a range of 15° to 45° C. over 20 sec. to 10 min., preferably 25° to 40° C. over 30 sec. to 5 min. is selected. Moreover, it is also possible to process the photosensitive materials of this invention using a direct stabilization solution instead of the washing mentioned above. It is possible to use any of the known methods described in JP-A-57-8543, JP-A-58-14834 and JP-A-60-220345 for such stabilization processing.

Furthermore, there will be cases involving further stabilization processing following on from the washing processing mentioned above, and as an example of this it is possible to mention a stabilization bath containing formalin and a surfactant which is used as the final bath for color photosensitive materials for photographic use. It is also possible to add various chelating agents and antifungal agents to this stabilization bath.

It is also possible to reuse the overflow from the replenishment of the abovementioned washing and/-stabilization solutions in a desilvering stage or other such stage.

Color developing agents may be incorporated into the silver halide color photosensitive materials of this invention in order to simplify and speed-up processing. It is preferable to use various precursors of color developing agents for the incorporation. By way of example, it is possible to mention the indoaniline-based compounds described in U.S. Pat. No. 3,342,597, the Schiff's base compounds described in *Research Disclosures* No. 14,850 and No. 15,159, the aldol compounds described in *Research Disclosure* No. 13,924, the metal salt complexes described in U.S. Pat. No. 3,719,492 and the urethane-based compounds described in JP-A-53-135628.

If required, various 1-phenyl-3-pyrazolidones may be incorporated into the silver halide color photosensitive materials of this invention in order to accelerate color development. Typical compounds are described in JP-A-56-64339, JP-A-57-144547 and JP-A-58-115438.

The various processing solutions in this invention are used at 10° C. to 50° C. Normally, a temperature of 33° C. to 38° C. will be standard, but the processing can be accelerated and the processing time reduced by raising the temperature and, conversely, it is possible to achieve an improvement in the image quality and an improvement in the stability of the processing solution by lowering the temperature. Moreover, processing which makes use of cobalt reinforcement or hydrogen peroxide reinforcement as described in West German Patent 2,226,770 or in U.S. Pat. No. 3,674,499 may be carried out in order to economize on silver in the photosensitive material.

In order for the outstanding features of the silver halide photographic materials of this invention to be exhibited without problem, it is preferable to carry out processing using a color developing solution which essentially contains no benzyl alcohol and which contains no more than 0.002 mole/l of bromide ions for a development time of 2 min. 30 sec.

"Essentially contains no benzyl alcohol" as described above means no more than 2 ml and more preferably no more than 0.5 ml with respect to 1 l of color developing solution and most preferably it means containing none whatsoever.

EXAMPLES

The invention is explained specifically using Examples below, but the invention is not limited by these.

EXAMPLE 1

Multi-layer color printing papers with the layer compositions shown below were produced on paper supports which had been laminated on both sides with polyethylene. The coating solutions were prepared as described below.

Preparation of the first layer coating solution 19.1 g of the yellow coupler (ExY), 4.4 g of the color image stabilizer (Cpd-1) and 1.8 g of the color image stabilizer (Cpd-7) were dissolved by the addition of 27.2 cc of ethyl acetate and 4.1 g respectively of the solvents (Solv-3) and (Solv-6) and this solution was emulsified and dispersed in 185 cc of a 10% aqueous gelatin solution containing 8 cc of 10% sodium dodecylbenzenesulfonate. Meanwhile, a preparation was made by adding $5.0\times10^{-4}$ mole of the blue-sensitizing dye shown below for every 1 mole of silver to a sulfur sensitized silver chlorobromide emulsion (a 1:3 mixture (Ag molar ratio) of silver bromide 80.0 mol %, cubic, average grain size 0.85μ, variation coefficient 0.08 and silver bromide 80.0%, cubic, average grain size 0.62μ, variation coefficient 0.07). The abovementioned emulsified dispersion and this emulsion were mixed and dissolved to prepare the first layer coating solution with the composition shown below. The coating solutions for the second layer to the seventh layer were prepared by similar methods to that for the first layer coating solution. Sodium 1-oxy-3,5-dichloro-s-triazine was used as a gelatin hardener in each layer. The following were used as spectrally sensitizing dyes in each layer.

Blue-sensitive emulsion layer

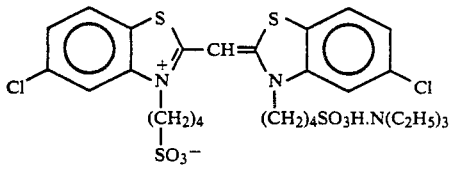

($5.0\times10^{-4}$ mole per mole of silver halide)

Green-sensitive emulsion layer

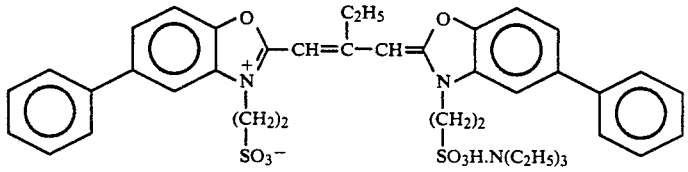

($4.0\times10^{-4}$ mole per mole of silver halide) and

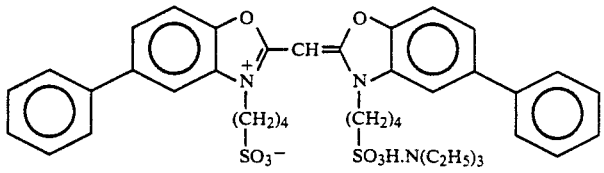

-continued ($7.0 \times 10^{-5}$ mole per mole of silver halide)

Red-sensitive emulsion layer

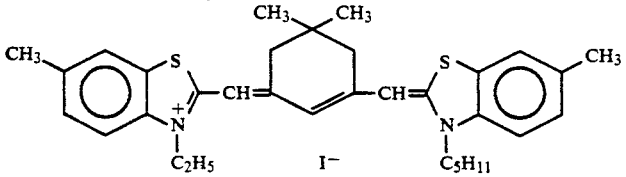

($0.9 \times 10^{-4}$ mole per mole of silver halide)

The following compound was added to the red-sensitive emulsion layer at $2.6\times10^{-3}$ mole per mole of silver halide.

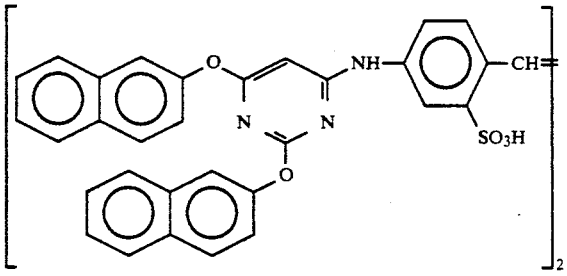

$4.0\times10^{-5}$ mole, $3.0\times10^{-5}$ mole and $1.0\times10^{-5}$ mole of 1-(5-methylureidophenyl)-5-mercaptotetrazole and $8\times10^{-3}$ mole, $2\times10^{-2}$ mole and $2\times10^{-2}$ mole of 2-methyl-5-t-octylhydroquinone were respectively added for each mole of silver halide in the blue-sensitive emulsion layer, green-sensitive emulsion layer and red-sensitive emulsion layer.

$1.2\times10^{-2}$ mole and $1.1\times10^{-2}$ mole of 4-hydroxy-6-methyl-1,3,3a,7-tetraazaindene were respectively added per mole of silver halide to the blue-sensitive emulsion layer and green-sensitive emulsion layer. The following dyes were added to the emulsion layers to prevent irradiation

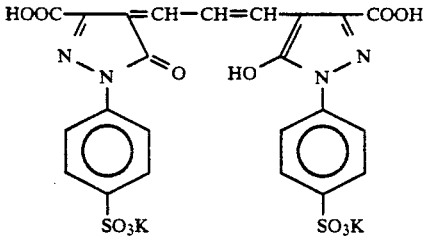

and

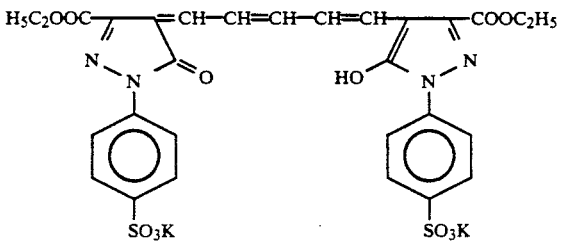

Layer Compositions

The composition of each layer is given below. The figures represent coated amounts (g/m²). For the silver halide emulsions they represent coated amounts calculated as silver.

Support

Polyethylene-laminated paper [containing a white pigment ($TiO_2$) and a blue dye (ultramarine) in the polyethylene layer on the first side].

| | |
|---|---|
| First Layer: Blue-sensitive layer | |
| Silver chlorobromide emulsion discussed previously (AgBr: 80 mol %) | 0.26 |
| Gelatin | 1.83 |
| Yellow coupler (ExY) | 0.83 |
| Color image stabilizer (Cpd-1) | 0.19 |
| Color image stabilizer (Cpd-7) | 0.08 |
| Solvent (Solv-3) | 0.18 |
| Solvent (Solv-6) | 0.18 |
| Second Layer: Color mixing prevention layer | |
| Gelatin | 0.99 |
| Color mixing preventor (Cpd-5) | 0.08 |
| Solvent (Solv-1) | 0.16 |
| Solvent (Solv-4) | 0.08 |
| Third Layer: Green-sensitive layer | |
| Silver chlorobromide emulsion (a 1:1 mixture (Ag molar ratio) of AgBr 90 mol %, cubic, average grain size 0.47μ, variation coefficient 0.12 and AgBr 90 mol %, cubic average grain size 0.36μ, variation coefficient 0.09) | 0.16 |
| Gelatin | 1.79 |
| Magenta coupler (ExM-1) | 0.32 |
| Color image stabilizer 1 | — |
| Color image stabilizer 2 (Cpd-3) | 0.20 |
| Color image stabilizer (Cpd-8) | 0.03 |
| Color image stabilizer (Cpd-4) | 0.01 |
| Color image stabilizer (Cpd-9) | 0.04 |
| Solvent (Solv-2) | 0.65 |
| Fourth Layer: Ultraviolet absorbing layer | |
| Gelatin | 1.58 |
| Ultraviolet absorber (UV-1) | 0.47 |
| Color mixing preventor (Cpd-5) | 0.05 |
| Solvent (Solv-5) | 0.24 |
| Fifth Layer: Red-sensitive layer | |
| Silver chlorobromide emulsion (a 1:2 mixture (Ag molar ratio) of AgBr 70 mol %, cubic, average grain size 0.49μ, variation coefficient 0.08 and AgBr 70 mol %, cubic average grain size 0.34μ, variation coefficient 0.10) | 0.23 |
| Gelatin | 1.34 |
| Cyan coupler (ExC-1) | 0.30 |
| Color image stabilizer (Cpd-6) | 0.17 |
| Color image stabilizer (Cpd-7) | 0.40 |
| Solvent (Solv-6) | 0.20 |
| Sixth Layer: Ultraviolet absorbing layer | |
| Gelatin | 0.53 |

-continued

| | |
|---|---|
| Ultraviolet absorber (UV-1) | 0.16 |
| Color mixing preventor (Cpd-5) | 0.02 |
| Solvent (Solv-5) | 0.08 |
| Seventh Layer: Protective layer | |
| Gelatin | 1.33 |
| Acrylic modified copolymer of polyvinyl alcohol (degree of modification 17%) | 0.17 |
| Liquid paraffin | 0.03 |

(Cpd-1) Color image stabilizer

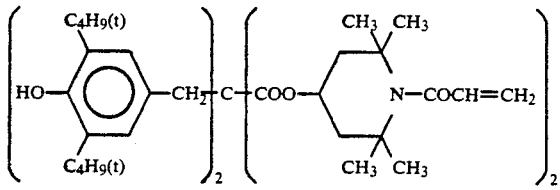

(Cpd-3) Color image stabilizer

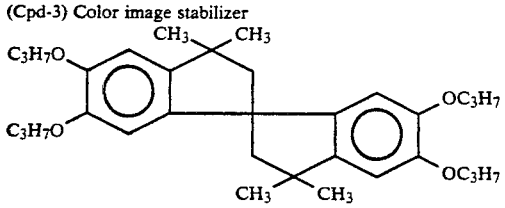

(Cpd-4) Color image stabilizer

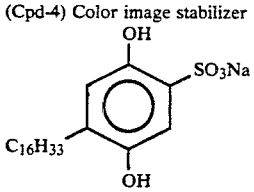

(Cpd-5) Color mixing preventor

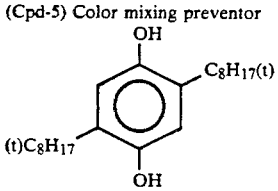

(Cpd-6) Color image stabilizer
a 2:4:4 mixture (weight ratio) of

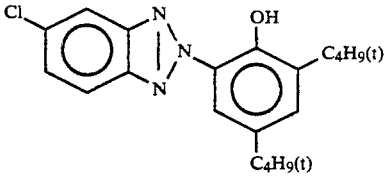

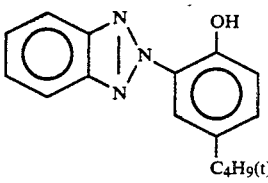

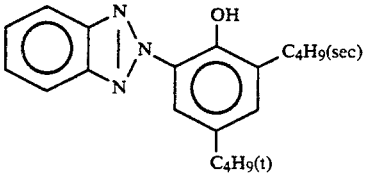

-continued (Cpd-7) Color image stabilizer $$\left(CH_2-\underset{\underset{CONHC_4H_9(t)}{|}}{CH}\right)_n$$

average molecular weight 80,000

(Cpd-8) Color image stabilizer

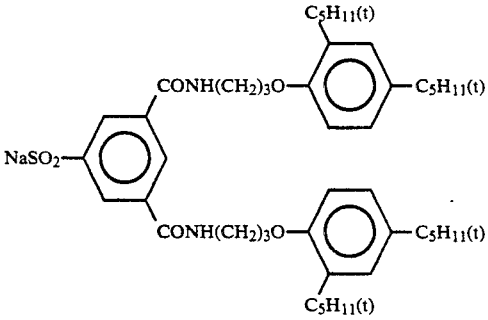

(Cpd-9) Color image stabilizer

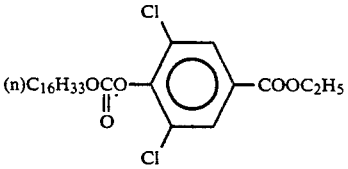

(UV-1) Ultraviolet absorber
a 4:2:4 mixture (weight ratio) of

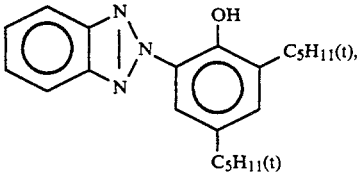

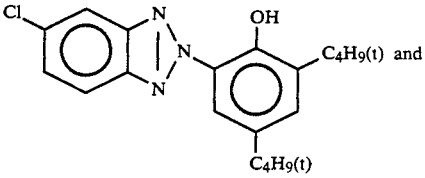

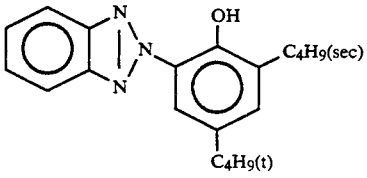

(Solv-1) Solvent

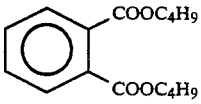

(Solv-2) Solvent
a 2:1 mixture (weight ratio) of $$O{=}P\left(OCH_2\underset{\underset{C_4H_9}{|}}{CH}\overset{\overset{C_2H_5}{|}}{}\right)_3 \quad \text{and}$$

-continued

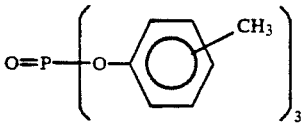

(Solv-3) Solvent $O{=}P{\leftarrow}O{-}C_9H_{19}\text{-(iso)})_3$ (Solv-4) Solvent

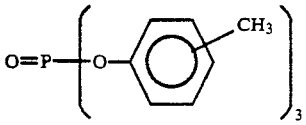

(Solv-5) Solvent $(CH_2)_8(COOC_8H_{17})_2$ (Solv-6) Solvent $C_8H_{17}CH(O)CH(CH_2)_7COOC_8H_{17}$ (ExY) Yellow coupler a 1:1 mixture (molar ratio) of

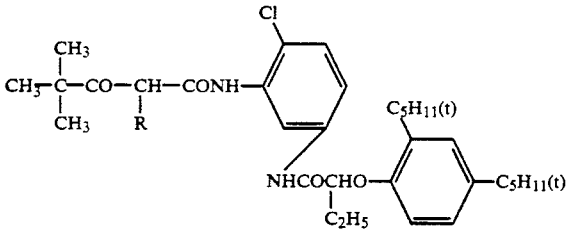

R =

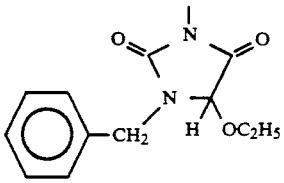

and

R =

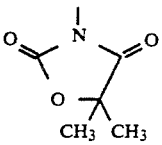

(ExM-1) Magenta Coupler a 1:1 mixture (molar ratio) of

-continued

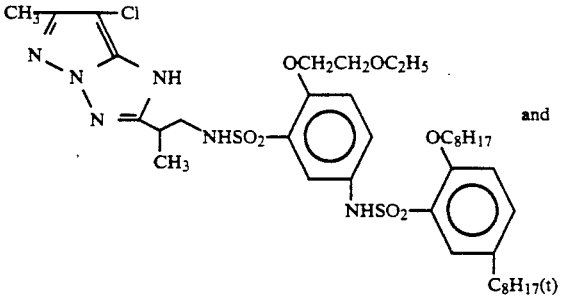

and

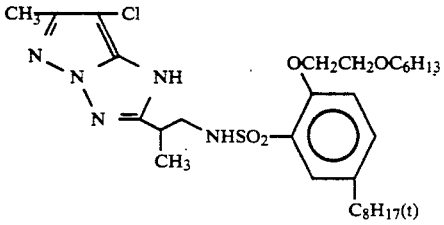

(ExC-1) Cyan coupler a 1:1 mixture (molar ratio) of

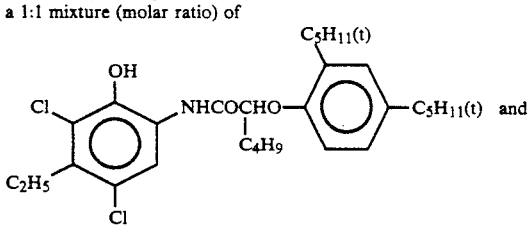

and

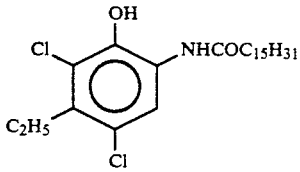

The sample obtained in this way was denoted 1A, and other samples were prepared in the same way as Example 1A except that, in the third layer, the magenta coupler and color image stabilizer 1 (a compound of general formula (III) or a compound analogous thereto, 50 mol % with respect to the coupler) and color image stabilizer 2 (a compound of general formula (IV) or a compound analogous thereto, 100 mol % with respect to the coupler) were recombined as shown in Table 1.

The abovementioned materials were exposed via an optical wedge.

Once the exposure was completed, the materials were subjected to processing by an automatic developing apparatus using the processing stages and solutions with the processing solution compositions shown below.

| Processing Stage | Temperature | Time |
|---|---|---|
| Color development | 37° C. | 3 min. 30 sec. |
| Bleach-fixing | 33° C. | 1 min. 30 sec. |
| Washing | 24–34° C. | 3 min. |
| Drying | 70–80° C. | 1 min. |

The compositions of the various processing solutions were as given below.

| | |
|---|---|
| Color Developing Solution | |
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfate | 4.5 g |
| Hydroxylamine sulfate | 3.0 g |
| Fluorescent brightener (WHITEX 4B, Sumitomo Kagaku) | 1.0 g |
| Water | to 1,000 ml |
| pH (25° C.) | 10.25 |
| Bleach-fixing Solution | |
| Water | 400 ml |
| Ammonium thiosulfate (70%) | 150 ml |
| Sodium sulfite | 18 g |
| Iron (III) ammonium ethylenediaminetetraacetate | 55 g |
| Disodium ethylenediaminetetraacetate | 5 g |
| Water | to 1,000 ml |
| pH (25° C.) | 6.70 |

Comparative coupler (a)

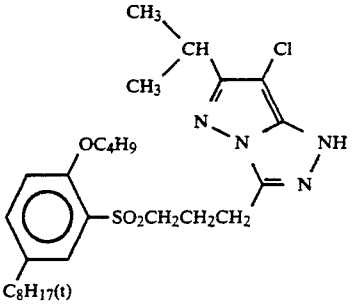

The coupler is disclosed in JP-A-62-180367, JP-A-62-183459 and JP-A-63-231340.

Comparative coupler (b)

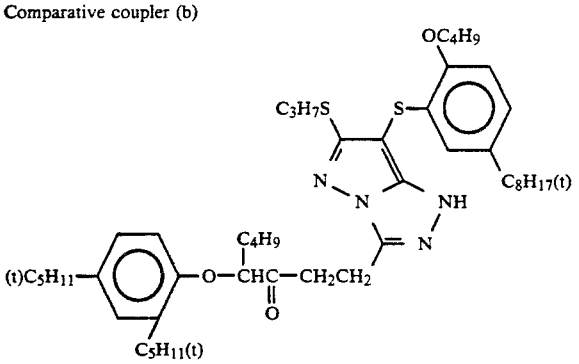

The coupler is disclosed in JP-A-63-231340

Comparative coupler (c)

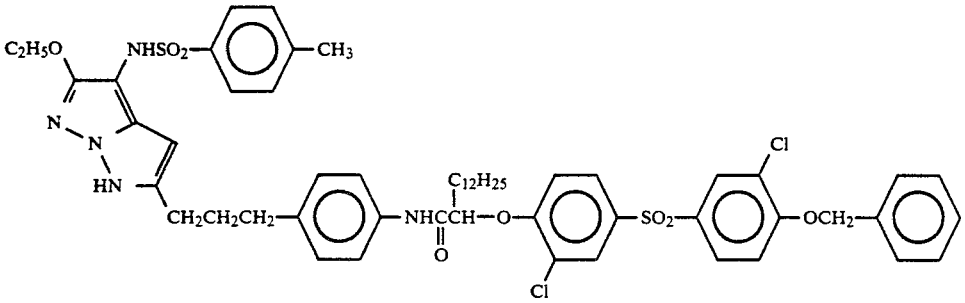

The coupler is described in, for example, JP-A-62-180367 and JP-A-62-183459

Comparative coupler (d)

-continued

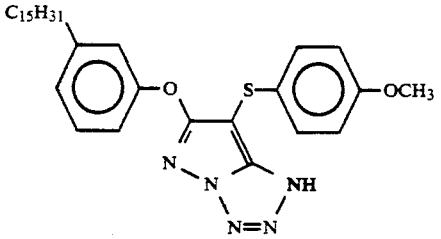

The coupler is described in, for example, JP-A-62-180367 and JP-A-183459

Comparative coupler (e)

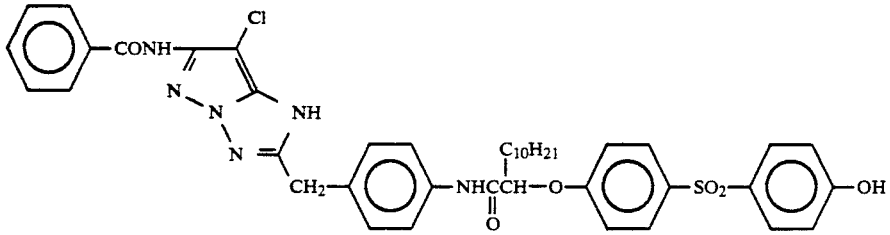

The coupler is described in European Patent 218,266

Comparative coupler (f)

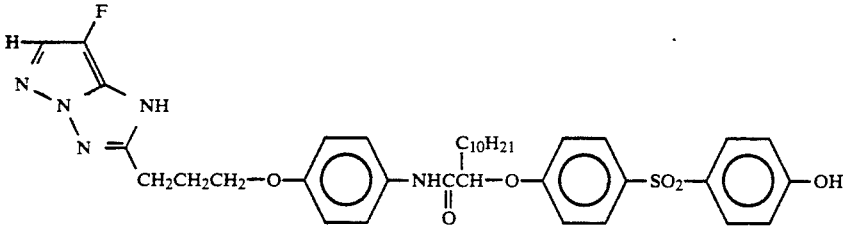

The coupler is described in European Patent 218,266

Comparative coupler (g)

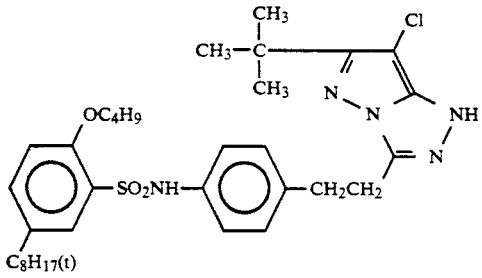

The coupler is described in JP-A-62-180367 and JP-A-62-183459

Comparative compound (a)

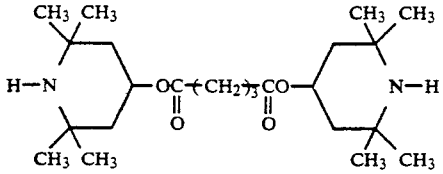

The compound is described in, for example, JP-A-62-180367, JP-A-62-183459 and EP-A-319985

Comparative compound (b)

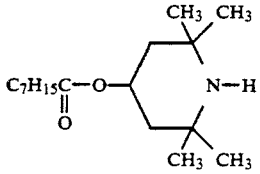

The compound is descrbed in, for example, European Patent 0,218,266

Comparative compound (c)

-continued

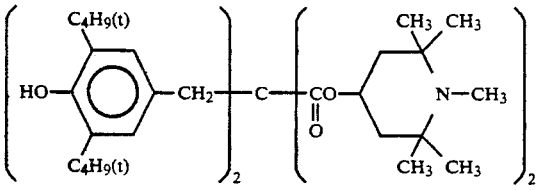

The compound is described in, for example, JP-A-62-180367 and JP-A-62-183459

Comparative compound (d)

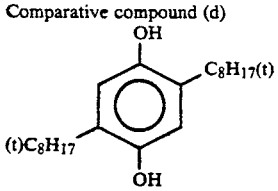

The compound is described in JP-A-62-180367

Comparative compound (e)

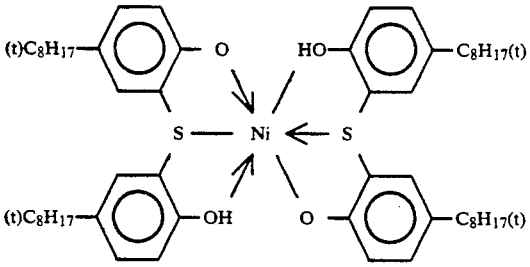

The compound is described in JP-A-62-183459

Comparative compound (f)

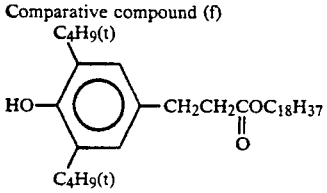

The compound is described in European Patent 242,211

Each of the samples in which a color image had been formed in this way was subjected to photographic performance evaluation and color fading tests.

The photographic performance evaluation was carried out for the magenta density (Dmax) and gradation, and the color fading test was carried out with a damp heat staining test (65° C.-15% RH) for the unexposed portions and a color fading by light test. In the evaluation of the maximum density (Dmax), the densities of the samples of color image stabilizer Cpd-3 (A-18) and the couplers respectively are taken as 100 and the relative values within the same couplers are given with these as the standard. For the gradation, the density from the sensitivity point to the point where the exposure was increased logarithmically by 0.5 is taken as 100 and relative values are given in the same way as for the maximum density. Furthermore, in the damp heat stain test, the yellow reflected density in the unexposed portion was measured after being left, for 80 days at 65° C.-15% RH. For the light fading test, irradiation was carried out for 8 days using a xenon tester (illuminance 200,000 lux) and then the magenta density was measured and the residual magenta density percentages at initial densities of 1.0 and 0.5 are shown. The results are given in Table 1.

TABLE 1

| Sample | Magenta Coupler | Color Image Stabilizer 1 (50 mol %) | Color Image Stabilizer 2 (100 mol %) | Photographic Properties Dmax | Photographic Properties Gradation | Yellow Stain Density 65° C.-15% RH 80 hrs. | Residual Dye Percentage Xe 200,000 lux, 8 days Initial Density 1.0 | Residual Dye Percentage Xe 200,000 lux, 8 days Initial Density 0.5 | Comments |
|---|---|---|---|---|---|---|---|---|---|
| 1A | EXM-1 | — | Cpd-3 (A-18) | 100 | 100 | 0.29 | 68 | 52 | Comp. Ex. |
| 1B | " | Comp. Com. (a) | " | 88 | 91 | 0.28 | 68 | 54 | " |
| 1C | " | Comp. Com. (b) | " | 92 | 93 | 0.28 | 68 | 53 | " |
| 1D | " | Comp. Com. (a) | Comp. Com. (d) | 84 | 90 | 0.30 | 43 | 33 | " |
| 1E | " | Comp. Com. (c) | " | 84 | 91 | 0.30 | 42 | 33 | " |
| 1F | " | Comp. Com. (a) | Comp. Com. (e) | 92 | 92 | 0.28 | 63 | 50 | " |
| 1G | " | Comp. Com. (c) | " | 92 | 94 | 0.30 | 62 | 48 | " |

TABLE 1-continued

| Sample | Magenta Coupler | Color Image Stabilizer 1 (50 mol %) | Color Image Stabilizer 2 (100 mol %) | Photographic Properties Dmax | Photographic Properties Gradation | Yellow Stain Density 65° C.-15% RH 80 hrs. | Residual Dye Percentage Xe 200,000 lux, 8 days Initial Density 1.0 | Residual Dye Percentage Xe 200,000 lux, 8 days Initial Density 0.5 | Comments |
|---|---|---|---|---|---|---|---|---|---|
| 1H | " | Comp. Com. (a) | — | 88 | 91 | 0.28 | 35 | 25 | " |
| 1I | " | Comp. Com. (b) | — | 92 | 92 | 0.29 | 37 | 24 | " |
| 1J | " | Comp. Com. (c) | — | 89 | 91 | 0.29 | 35 | 27 | " |
| 1K | " | — | Comp. Com. (d) | 85 | 92 | 0.31 | 43 | 33 | " |
| 1L | " | — | Comp. Com. (e) | 98 | 95 | 0.29 | 63 | 51 | " |
| 1M | Comp. Coup. (a) | — | A-2 | 100 | 100 | 0.29 | 50 | 38 | " |
| 1N | Comp. Coup. (b) | — | " | 100 | 100 | 0.45 | 52 | 38 | " |
| 1O | Comp. Coup. (c) | — | A-2 | 100 | 100 | 0.42 | 51 | 36 | " |
| 1P | Comp. Coup. (d) | — | " | 100 | 100 | 0.43 | 47 | 35 | " |
| 1Q | Comp. Coup. (e) | — | " | 100 | 100 | 0.31 | 47 | 36 | " |
| 1R | Comp. Coup. (f) | — | " | 100 | 100 | 0.30 | 50 | 38 | " |
| 1S | Comp. Coup. (g) | — | " | 100 | 100 | 0.30 | 50 | 37 | " |
| 1T | Comp. Coup. (a) | Comp. Com. (c) | " | 90 | 92 | 0.29 | 50 | 39 | " |
| 1U | Comp. Coup. (b) | " | " | 92 | 94 | 0.43 | 53 | 39 | " |
| 1V | Comp. Coup. (c) | " | " | 85 | 88 | 0.39 | 51 | 37 | " |
| 1W | Comp. Coup. (d) | " | " | 89 | 91 | 0.40 | 47 | 36 | " |
| 1X | Comp. Coup. (e) | " | " | 85 | 87 | 0.31 | 47 | 35 | " |
| 1Y | Comp. Coup. (f) | " | " | 92 | 94 | 0.31 | 50 | 35 | " |
| 1Z | Comp. Coup. (g) | " | " | 90 | 92 | 0.30 | 50 | 40 | " |
| 1AA | M-3 | — | A-2 | 100 | 100 | 0.45 | 70 | 55 | |
| 1BB | M-27 | — | " | 100 | 100 | 0.46 | 71 | 54 | " |
| 1CC | M-42 | — | " | 100 | 100 | 0.45 | 68 | 48 | " |
| 1DD | M-3 | Comp. Com. (c) | " | 92 | 94 | 0.24 | 72 | 57 | " |
| 1EE | M-27 | " | " | 94 | 94 | 0.25 | 72 | 56 | " |
| 1FF | M-42 | " | " | 92 | 93 | 0.26 | 70 | 51 | " |
| 1GG | Comp. Coup (a) | III-42 | " | 99 | 99 | 0.29 | 52 | 42 | " |
| 1II | Comp. Coup (b) | " | " | 99 | 98 | 0.45 | 53 | 44 | " |
| 1JJ | Comp. Coup (c) | " | " | 99 | 99 | 0.42 | 52 | 39 | " |
| 1KK | Comp. Coup (d) | " | " | 98 | 99 | 0.43 | 47 | 39 | " |
| 1LL | Comp. Coup (g) | " | " | 97 | 100 | 0.30 | 50 | 42 | " |
| 1MM | M-27 | — | " | 100 | 100 | 0.46 | 28 | 20 | " |
| 1NN | " | III-6 | — | 100 | 100 | 0.22 | 43 | 25 | " |
| 1OO | " | III-20 | — | 100 | 100 | 0.23 | 42 | 22 | " |
| 1PP | M-27 | III-42 | — | 98 | 98 | 0.25 | 40 | 22 | |
| 1QQ | Comp. Coup (a) | III-6 | A-2 | 100 | 100 | 0.29 | 52 | 43 | " |
| 1RR | Comp. Coup (b) | " | " | 100 | 100 | 0.43 | 52 | 44 | " |
| 1SS | Comp. Coup (c) | " | " | 100 | 100 | 0.40 | 50 | 40 | " |
| 1TT | Comp. Coup (d) | " | " | 100 | 100 | 0.40 | 48 | 40 | " |
| 1UU | M-27 | " | Cpd-3 (A-18) | 100 | 100 | 0.18 | 80 | 76 | This Inv. |
| IVV | " | " | A-2 | 100 | 100 | 0.19 | 78 | 73 | " |
| 1WW | " | " | A-12 | 100 | 100 | 0.19 | 79 | 75 | " |
| 1XX | " | " | A-27 | 100 | 100 | 0.18 | 79 | 76 | " |
| 1YY | " | III-20 | Cpd-3 (A-18) | 100 | 100 | 0.18 | 80 | 77 | " |
| 1ZZ | " | III-42 | " | 99 | 99 | 0.20 | 78 | 70 | " |
| 1a | Comp. Coup (a) | III-42 | A-44 | 100 | 100 | 0.30 | 51 | 43 | Comp. Ex. |
| 1b | Comp. Coup (b) | " | " | 100 | 100 | 0.42 | 52 | 44 | " |
| 1c | Comp. Coup (c) | " | " | 100 | 99 | 0.39 | 50 | 40 | " |
| 1d | Comp. Coup (d) | " | " | 99 | 100 | 0.40 | 49 | 41 | " |
| 1e | M-27 | III-6 | Comp. Com. (d) | 85 | 92 | 0.25 | 28 | 17 | " |
| 1f | " | " | Comp. Com. (f) | 97 | 97 | 0.26 | 30 | 27 | " |
| 1g | " | III-42 | Comp. Com. (d) | 83 | 91 | 0.26 | 27 | 18 | " |
| 1h | " | " | Comp. Com. (f) | 97 | 96 | 0.27 | 32 | 22 | " |
| 1i | " | Comp. Com. (c) | Comp. Com. (d) | 82 | 88 | 0.30 | 29 | 19 | " |
| 1j | " | " | Comp. Com. (f) | 85 | 87 | 0.33 | 30 | 18 | " |
| 1k | " | Comp. Com. (a) | Cpd-3 (A-18) | 89 | 91 | 0.30 | 75 | 58 | " |
| 1l | " | " | A-2 | 88 | 91 | 0.32 | 72 | 58 | " |
| 1m | M-27 | — | Cpd-3 (A-18) | 100 | 100 | 0.46 | 73 | 56 | Comp. Ex. |
| 1n | M-42 | Comp. Com. (a) | " | 87 | 92 | 0.33 | 71 | 55 | " |
| 1o | " | III-6 | " | 100 | 100 | 0.18 | 79 | 75 | This inve. |
| 1p | " | " | A-2 | 100 | 100 | 0.19 | 78 | 72 | " |
| 1q | " | " | A-12 | 100 | 100 | 0.19 | 79 | 74 | " |

Comp. Coup. = Comparative Coupler
Comp. Com. = Comparative Compound
Comp. Ex. = Comparative Example As is clear from Table 1, the effect on the photographic properties is extremely slight with the samples of this invention, while the occurrence of damp heat staining is inhibited and there is a change towards light fastness in the magenta image particularly in the low density portions, and these are surprising results which could not have been anticipated from known methods or combinations of known methods.

EXAMPLE 2

Multi-layer color printing papers with the layer compositions shown below were produced on paper supports which had been laminated on both sides with polyethylene. Coating solutions were prepared as described below.

Preparation of the first layer coating solution 19.1 g of the yellow coupler (ExY), 4.4 g of the color image stabilizer (Cpd-1) and 0.7 g of the color image stabilizer (Cpd-7) were dissolved by the addition of 27.2 cc of ethyl acetate and 8.2 g the solvent (Solv-3), and this solution was emulsified and dispersed in 18.5 cc of a 10% aqueous gelatin solution containing 8 cc of 10% sodium dodecylbenzenesulfonate. Meanwhile, a preparation was made in which the blue-sensitizing dye shown below had been added to a silver chlorobromide emulsion (a 3:7 mixture (silver molar ratio) of a 0.88μ and a 0.70μ average grain sizes cubic emulsion, grain size distribution variation coefficient 0.08 and 0.10, each emulsion locally containing 0.2 mol % of silver bromide on the grain surfaces) at $2.0\times10^{-4}$ mole for the large size emulsion and at $2.5\times10^{-4}$ mole for the small size emulsion with respect to 1 mole of silver and then this was sulfur sensitized. The abovementioned emulsified dispersion and this emulsion were mixed and dissolved and a first coating solution was prepared to constitute the composition shown below. Coating solutions for the second layer to the seventh layer were prepared by the same method as that for the first layer coating solution. Sodium 1-oxy-3,5-dichloro-s-triazine was used as a gelatin hardener in each layer. The following were used as spectrally sensitizing dyes in each layer.

Blue-sensitive emulsion layer

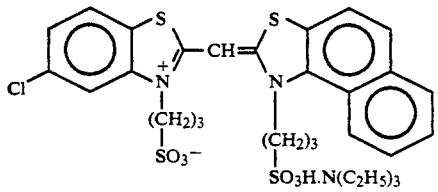

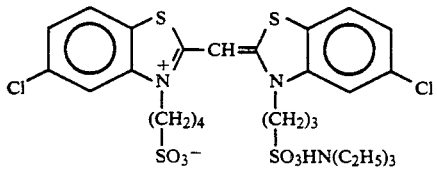

(Respectively at $2.0\times10^{-4}$ mole for large sized emulsions and respectively at $2.5\times10^{-4}$ mole for small sized emulsions with respect to 1 mole of silver halide)

Green-sensitive emulsion layer

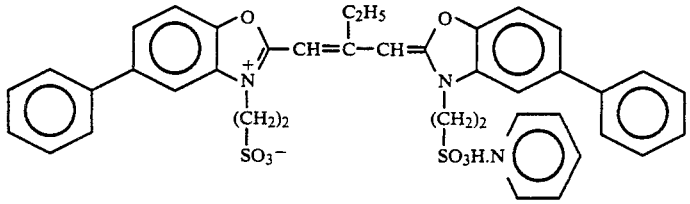

(At $4.0\times10^{-4}$ mole for large sized emulsions and $5.6\times10^{-4}$ mole for small sized emulsions with respect to 1 mole of silver halide) and

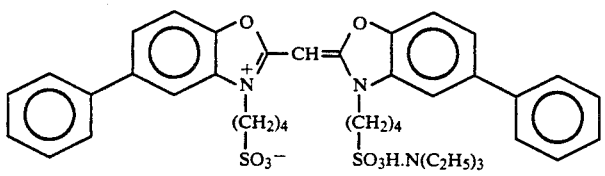

(At $7.0\times10^{-5}$ mole for large sized emulsions and $1.0\times10^{-5}$ mole for small sized emulsions with respect to 1 mole of silver halide)

Red-sensitive emulsion layer

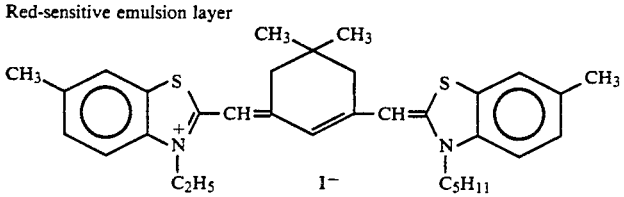

(At $0.9\times10^{-4}$ mole for large sized emulsions and $1.1\times10^{-4}$ mole for small sized emulsions with respect to 1 mole of silver halide)

The following compound was added to the red-sensitive emulsion layer at $2.6\times10^{-3}$ mole with respect to 1 mole of silver halide.

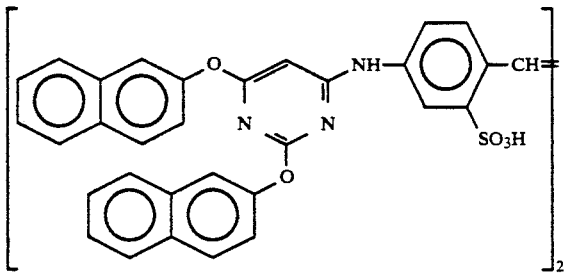

Furthermore, 1-(5-methylureidophenyl)-5-mercaptotetrazole was added at $8.5\times10^{-5}$ mole, $7.7\times10^{-4}$ mole and $2.5\times10^{-4}$ mole with respect to 1 mole of silver halide to the blue-sensitive emulsion layer, green-sensitive emulsion layer and red-sensitive emulsion layer respectively.

The following dyes were added to the emulsion layers to prevent irradiation.

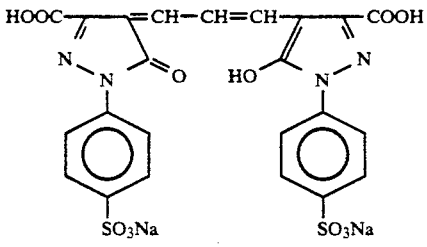

and

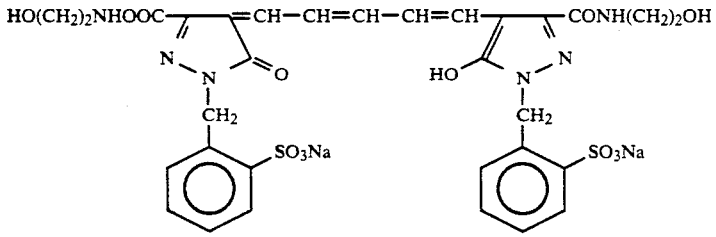

Layer compositions

The compositions of the various layers are shown below. The figures represent coated amounts (g/m²). For the silver halide emulsions they represent the coated amounts calculated as silver.

| | |
|---|---|
| Support | |
| Polyethylene-laminated paper [containing a white pigment ($TiO_2$) and a blue dye (ultramarine) in the polyethylene layer on the first side] | |
| First layer (blue-sensitive layer) | |
| Silver chlorobromide emulsion discussed previously | 0.30 |
| Gelatin | 1.86 |
| Yellow coupler (ExY) | 0.82 |
| Color image stabilizer (Cpd-1) | 0.19 |
| Solvent (Solv-3) | 0.35 |
| Color image stabilizer (Cpd-10) | 0.06 |
| Second layer (color mixing prevention layer) | |
| Gelatin | 0.99 |

-continued

| | |
|---|---|
| Color mixing preventor (Cpd-5) | 0.08 |
| Solvent (Solv-1) | 0.16 |
| Solvent (Solv-4) | 0.08 |
| Third layer (green-sensitive layer) | |
| Silver chlorobromide emulsion (a 1:3 mixture (Ag molar ratio) of cubic emulsions with average grain sizes of 0.55μ and 0.39μ. Grain size distribution variation coefficients 0.10 and 0.08; 0.8 mol % of AgBr being locally contaied on the grain surfaces of each emulsion) | 0.12 |
| Gelatin | 1.24 |
| Magenta coupler (ExM-2) | 0.20 |
| Color image stabilizer 1 | — |
| Color image stabilizer 2 (Cpd-3) | 0.15 |
| Color image stabilizer (Cpd-8) | 0.02 |
| Color image stabilizer (Cpd-9) | 0.03 |
| Solvent (Solv-2) | 0.40 |
| Fourth layer (ultraviolet absorbing layer) | |
| Gelatin | 1.58 |
| Ultraviolet absorber (UV-1) | 0.47 |
| Color mixing preventor (Cpd-5) | 0.05 |
| Solvent (Solv-5) | 0.24 |
| Fifth layer (red-sensitive layer) | |
| Silver chlorobromide emulsion (a 1:4 mixture (Ag molar ratio) of cubic emulsions with average grain sizes of 0.58μ and 0.45μ. Grain size distribution variation coefficients 0.09 and 0.11; 0.6 mol % of AgBr being locally contained in a portion of the grain surfaces in each emulsion) | 0.23 |
| Gelatin | 1.34 |
| Cyan coupler (ExC-2) | 0.32 |
| Color image stabilizer (Cpd-6) | 0.17 |
| Color image stabilizer (Cpd-11) | 0.04 |
| Color image stabilizer (Cpd-10) | 0.40 |
| Solvent (Solv-7) | 0.15 |
| Sixth layer (ultraviolet absorbing layer) | |
| Gelatin | 0.53 |
| Ultraviolet absorber (UV-1) | 0.16 |
| Color mixing preventor (Cpd-5) | 0.02 |
| Solvent (Solv-5) | 0.08 |
| Seventh layer (protective layer) | |
| Gelatin | 1.33 |
| Acrylic modified copolymer of polyvinyl alcohol (degree of modification 17%) | 0.17 |
| Liquid paraffin | 0.03 |

(Cpd-10) color image stabilizer

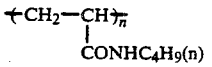

average molecular weight 60,000

(Cpd-11) color image stabilizer

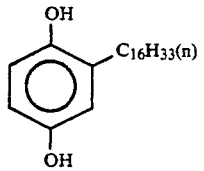

(Solv-7) Solvent

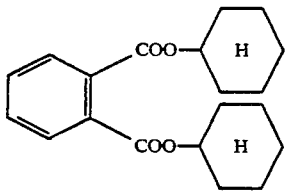

(ExM-2) magenta coupler

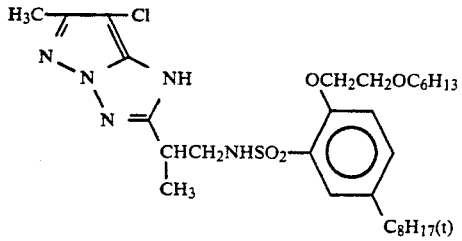

(ExC-2) cyan coupler a 2:4:4 mixture (weight ratio) of

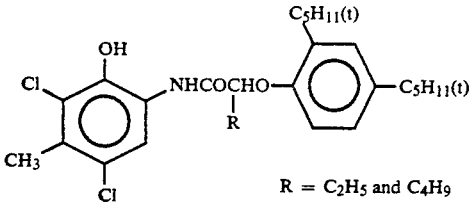

R = $C_2H_5$ and $C_4H_9$

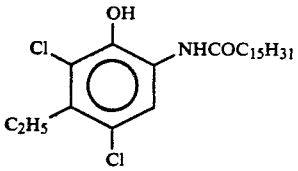

The sample obtained in this way was designated 2A and other samples were prepared in the same way as sample 2A except that, in the third layer, the magenta coupler and color image stabilizer 1 (a compound of general formula (III) or a compound analogous thereto, 20 mol % with respect to the coupler) and color image stabilizer 2 (a compound of general formula (IV) or a compound analogous thereto, 100 mol % with respect to the coupler) were recombined as shown in Table 2. The codes and the structures of the compounds are the same as described in Example 1.

First of all, each sample was exposed following the method described in Example 1. The samples which had been exposed were subjected to continuous processing (a running test) until twice the tank capacity in a color development with the following processing stages had been replenished using a paper processing apparatus.

| Processing stage | Temperature (°C.) | Time | Replenishment solution (ml) | Tank capacity (l) |
|---|---|---|---|---|
| Color development | 30 | 45 sec. | 161 | 17 |
| Bleach-fixing | 30 to 35 | 45 sec. | 215 | 17 |
| Rinse (1) | 30 to 35 | 20 sec. | — | 10 |
| Rinse (2) | 30 to 35 | 20 sec. | — | 10 |
| Rinse (3) | 30 to 35 | 20 sec. | 350 | 10 |
| Drying | 70 to 80 | 60 sec. | | |

The replenishment amount is per 1 $m^2$ of photosensitive material (a three-tank countercurrent system from rinse (3)→(1) was adopted).

The compositions of the various processing solutions are as give below.

| Color developing solution | Tank solution | Replenishment solution |
|---|---|---|
| Water | 800 ml | 800 ml |
| Ethylenediamine-N,N,N,N-tetramethylene phosphonate | 1.5 g | 2.0 g |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 5.5 g | 7.0 g |
| Fluorescent brightener (WHITEX 4B Sumitomo Kagaku) | 1.0 g | 2.0 g |
| Water to | 1,000 ml | 1,000 ml |
| pH (25° C.) | 10.05 | 10.45 |

Bleach-fixing solution (tank solution and replenishment solution the same)

| | |
|---|---|
| Water | 400 ml |
| Ammonium thiosulfate (70%) | 100 ml |
| Sodium sulfite | 17 g |
| Iron (III) ammonium ethylenediaminetetraacetate | 55 g |
| Disodium ethylenediaminetetraacetate | 5 g |
| Ammonium bromide | 40 g |
| Water to | 1,000 ml |
| pH (25° C.) | 6.0 |

Rinse solution (tank solution and replenishment solution the same)

Ion exchanged water (no more than 3 ppm of calcium and magnesium respectively)

The various samples obtained in this way and subjected to running solution processing were subjected to color fading tests under the same conditions as for Example 1 (65° C.–15% RH and xenon tester illuminance of 200,000 lux, 8 days).

TABLE 2

| Sample | Magenta coupler | Color image stabilizer 1 (20 mol %) | Color image stabilizer 2 (100 mol %) | Yellow stain density 65° C.-15% RH 80 hours | Residual dye percentage Xe 200,000 lux, 8 days Initial density 1.0 (%) | Initial density 0.5 (%) | Comments |
|---|---|---|---|---|---|---|---|
| 2A | EXM-2 | — | Cpd-3 (A-18) | 0.32 | 66 | 50 | Comparative Example |
| 2B | " | Comparative Compound (c) | " | 0.32 | 67 | 53 | Comparative Example |
| 2C | " | Comparative Compound (c) | Comparative Compound (d) | 0.33 | 40 | 29 | Comparative Example |
| 2D | " | Comparative Compound (c) | — | 0.32 | 30 | 22 | Comparative Example |
| 2E | " | — | Comparative Compound (d) | 0.33 | 42 | 29 | Comparative Example |
| 2F | Comparative Coupler (a) | — | Comparative Compound (d) | 0.32 | 38 | 27 | Comparative Example |
| 2G | Comparative Coupler (b) | — | Comparative Compound (d) | 0.45 | 43 | 30 | Comparative Example |
| 2H | Comparative Coupler (c) | — | Comparative Compound (d) | 0.43 | 42 | 28 | Comparative Example |
| 2I | Comparative Coupler (d) | — | Comparative Compound (d) | 0.45 | 40 | 25 | Comparative Example |
| 2J | M-22 | — | Comparative Compound (d) | 0.45 | 42 | 30 | Comparative Example |
| 2K | EXM-2 | III-42 | Comparative Compound (d) | 0.32 | 40 | 29 | Comparative Example |
| 2L | Comparative Coupler (a) | III-42 | Comparative Compound (d) | 0.32 | 43 | 32 | Comparative Example |
| 2M | Comparative Coupler (b) | " | Comparative Compound (d) | 0.44 | 42 | 29 | Comparative Example |
| 2N | Comparative Coupler (c) | " | Comparative Compound (d) | 0.45 | 42 | 30 | Comparative Example |
| 2O | Comparative Coupler (d) | " | Comparative Compound (d) | 0.44 | 43 | 33 | Comparative Example |
| 2P | M-22 | " | Comparative Compound (d) | 0.41 | 43 | 36 | Comparative Example |
| 2Q | " | " | Comparative Compound (f) | 0.40 | 45 | 37 | Comparative Example |
| 2R | Comparative Coupler (a) | — | Cpd-3 (A-18) | 0.32 | 59 | 44 | Comparative Example |
| 2S | Comparative Coupler (b) | — | " | 0.45 | 60 | 48 | Comparative Example |
| 2T | Comparative Coupler (c) | — | " | 0.43 | 59 | 47 | Comparative Example |
| 2U | Comparative Coupler (d) | — | " | 0.45 | 58 | 44 | Comparative Example |
| 2V | M-22 | — | " | 0.45 | 70 | 52 | Comparative Example |
| 2W | EXM-2 | III-6 | — | 0.32 | 44 | 33 | Comparative Example |
| 2X | Comparative Coupler (a) | III-6 | — | 0.32 | 40 | 37 | Comparative Example |
| 2Y | Comparative Coupler (b) | " | — | 0.29 | 46 | 37 | Comparative Example |
| 2Z | Comparative Coupler (c) | " | — | 0.37 | 46 | 38 | Comparative Example |
| 2AA | Comparative Coupler (d) | " | — | 0.39 | 45 | 35 | Comparative Example |
| 2BB | M-22 | " | — | 0.24 | 47 | 37 | Comparative Example |
| 2CC | EXM-2 | " | Cpd-3 (A-18) | 0.31 | 68 | 56 | Comparative Example |
| 2DD | Comparative Coupler (a) | " | " | 0.32 | 59 | 46 | Comparative Example |
| 2EE | Comparative Coupler (b) | " | " | 0.30 | 61 | 50 | Comparative Example |
| 2FF | Comparative Coupler (c) | " | " | 0.36 | 62 | 46 | Comparative Example |
| 2GG | Comparative Coupler (d) | " | " | 0.38 | 60 | 44 | Comparative Example |
| 2HH | M-22 | " | " | 0.19 | 80 | 75 | This Invention |
| 2II | EXM-2 | III-42 | Comparative Compound (d) | 0.32 | 51 | 35 | Comparative Example** |
| 2JJ | Comparative Coupler (a) | III-42 | Comparative Compound (d) | 0.32 | 50 | 35 | Comparative Example* |
| 2KK | M-22 | III-23 | — | 0.24 | 48 | 37 | Comparative Example* |
| 2LL | " | III-25 | — | 0.24 | 46 | 36 | Comparative Example* |
| 2MM | " | III-42 | — | 0.26 | 46 | 37 | Comparative |

TABLE 2-continued

| Sample | Magenta coupler | Color image stabilizer 1 (20 mol %) | Color image stabilizer 2 (100 mol %) | Yellow stain density 65° C.-15% RH 80 hours | Residual dye percentage Xe 200,000 lux, 8 days Initial density 1.0 (%) | Initial density 0.5 (%) | Comments |
|---|---|---|---|---|---|---|---|
| 2NN | " | III-23 | Cpd-3 (A-18) | 0.19 | 78 | 72 | Example* This Invention |
| 2OO | " | III-25 | " | 0.20 | 76 | 71 | This Invention |
| 2PP | " | III-42 | " | 0.21 | 77 | 70 | This Invention |
| 2QQ | " | — | A-3 | 0.45 | 68 | 51 | Comparative Example |
| 2RR | " | — | A-10 | 0.46 | 69 | 50 | Comparative Example |
| 2SS | " | — | A-12 | 0.45 | 71 | 51 | Comparative Example |
| 2TT | " | — | A-31 | 0.46 | 69 | 50 | Comparative Example |
| 2UU | " | III-6 | A-3 | 0.19 | 78 | 74 | This Invention |
| 2VV | M-22 | III-6 | A-10 | 0.20 | 70 | 68 | This Invention |
| 2WW | " | " | A-12 | 0.19 | 77 | 75 | This Invention |
| 2XX | " | " | A-31 | 0.20 | 70 | 67 | This Invention |
| 2YY | " | " | Comparative Compound (d) | 0.39 | 43 | 35 | Comparative Example |
| 2ZZ | " | " | Comparative Compound (f) | 0.38 | 44 | 35 | Comparative Example |

*,**With further addition of 50 mol % of Cpd-3 (A-18) with respect to the coupler As is clear from Table 2, the samples of this invention greatly inhibit the occurrence of damp heat staining in unexposed portions and render particularly low density portions of the magenta image fast to light even when the development processing solution is a running solution and these are surprisingly improved effects which could not have been anticipated from known techniques or combinations. Furthermore, the compounds of general formula [III] (color image stabilizer 1) exhibit strong effects even when its addition amount is slight.

EXAMPLE 3

The coated samples of Example 2 were subjected to exposure by the method described in Example 2 and the above materials were subjected to imagewise exposure by a separate method and these samples were processed after carrying out continuous processing (a running test) until twice the tank capacity in the color development processing stages given below had been replenished using a paper processing apparatus, thereby obtaining a color image.

| Processing stage | Temperature (°C.) | Time | Replenishment amount* (ml) | Tank capacity (l) |
|---|---|---|---|---|
| Color development | 30 | 45 sec. | 161 | 17 |
| Bleach-fixing | 30 to 36 | 45 sec. | 215 | 17 |
| Stabilization (1) | 30 to 37 | 20 sec. | — | 10 |
| Stabilization (2) | 30 to 37 | 20 sec. | — | 10 |
| Stabilization (3) | 30 to 37 | 20 sec. | — | 10 |
| Stabilization (4) | 30 to 37 | 30 sec. | 248 | 10 |
| Drying | 70 to 85 | 60 sec. | | |

*The replenishment amount per 1 $m^2$ of photo-sensitive material (a four-tank countercurrent system from stabilization (4) → (1) was adopted).

The various processing solution compositions were as shown below.

| Color developing solution | Tank solution | Replenishment solution |
|---|---|---|
| Water | 800 ml | 800 ml |
| Ethylenediaminetetraacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| Diethylhydroxylamine | 4.2 g | 6.0 g |
| Fluorescent brightener (4,4'-diaminostilbene-based) | 2.0 g | 2.5 g |
| Water to | 1,000 ml | 1,000 ml |
| pH (25° C.) | 10.05 | 10.45 |

Bleach-fixing solution (the tank solution and the replenishment solution were the same)

| | |
|---|---|
| Water | 400 ml |
| Ammonium thiosulfate (70%) | 100 ml |
| Sodium sulfite | 17 g |
| Iron (III) ammonium ethylenediaminetetraacetate | 55 g |
| Disodium ethylenediaminetetraacetate | 5 g |
| Glacial acetic acid | 9 g |
| Water to | 1,000 ml |
| pH (25° C.) | 5.40 |

Stabilization solution (the tank solution and the replenishment solution were the same)

| | |
|---|---|
| Formalin (37 g) | 0.1 g |
| Formalin/sulfurous acid adduct | 0.7 g |
| 5-Chloro-2-methyl-4-isothiazolin-3-one | 0.02 g |
| 2-Methyl-4-isothiazolin-3-one | 0.01 g |
| Copper sulfate | 0.005 g |
| Water to | 1,000 ml |
| pH (25° C.) | 4.0 |

When the samples obtained in this way underwent color-fading tests in the same way as in Example 2, the samples of this invention showed outstanding light-fastness in the same way as in Example 2.

EXAMPLE 4

Samples were prepared by changing the couplers in the various samples 1BB, 1EE, 1NN, 1UU, 1VV, 1WW, 1XX, 1YY and 1ZZ in Example 1 into M-3, M-5, M-7, M-14, M-23, M-25 and M-37 and, when the same exposure, processing and testing as in Example 1 was carried out, it was seen that the samples of this invention markedly inhibited the occurrence of damp heat staining and were outstanding in their light fastness.

EXAMPLE 5

Samples in which, in the third layer, the color image stabilizer (Cpd-8) and the color image stabilizer (Cpd-9) had been eliminated were prepared using the various samples 1UU, 1VV, 1WW and 1XX of Example 1. When these samples were exposed, processed and subjected to color fading testing in the same way as in Example 1, the occurrence of magenta staining was observed even though yellow staining was inhibited in the unexposed portions. It was found that the color image stabilizer (Cpd-8) and the color image stabilizer (Cpd-9) were effective for the image storage stability, in particular for the prevention of magenta staining, even in combination with the color image stabilizers of this invention.

As is clear from the examples, this invention is outstanding for image storage stability, and in particular it markedly decreases the occurrence of staining in unexposed portions and color fading by light in the magenta image.

While the invention has been described in detail and with reference to specific embodiments thereof, it will be apparent to one skilled in the art that various changes and modifications can be made therein without departing from the spirit and scope thereof.

The present invention is only limited by the scope of the appended claims.

What is claimed is:

1. A silver halide color photographic material wherein at least one coupler selected from the group consisting of the compounds represented by the following general formulae (I) and (II), at least one compound represented by the following general formula (III) and at least one compound represented by the following general formula (IV) are included in the same layer,

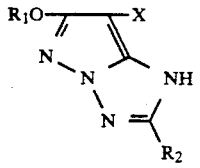

Formula (I)

and

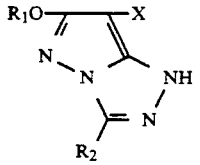

Formula (II)

wherein $R_1$ represents an 2-alkoxyphenyl group and $R_2$ represents a hydrogen atom or a substituent group, and X represents a hydrogen atom or a group eliminated by a coupling reaction,

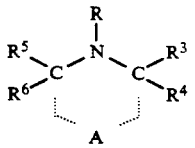

Formula (III)

wherein R represents an acyl group, an alkyloxycarbonyl group, aryloxycarbonyl group, alkylsulfinyl group, arylsulfinyl group, alkylsulfonyl group, carbamoyl group, sulfamoyl group or arylsulfonyl group; $R^3$, $R^4$, $R^5$ and $R^6$ may be identical or different and respectively represent alkyl groups, A represents a group of non-metallic atoms necessary to form a 5-membered, 6-membered or 7-membered ring, $R^3$ and $R^4$, $R^5$ and $R^6$, R and $R^3$, and $R^3$ and A may respectively link together to form a 5-membered or 6-membered ring, and A, R, or A and R may represent a divalent group to form a dimer or a trimer of the compound represented by formula (III),

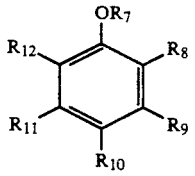

Formula (IV)

wherein $R_7$ represents an alkyl group, alkenyl group, aryl group, heterocyclic group or

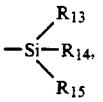

wherein $R_{13}$, $R_{14}$ and $R_{15}$ may be identical or different and respectively represent an alkyl group, alkenyl group, aryl group, alkoxy group, alkenoxy group or aryloxy group, $R_8$, $R_9$, $R_{10}$, $R_{11}$ and $R_{12}$ may be identical or different and respectively represent a hydrogen atom, alkyl group, alkenyl group, aryl group, acylamino group, alkylamino group, alkylthio group, arylthio group, halogen atom or —O—$R_7'$, wherein $R_7'$ has the same meaning as $R_7$, $R_7$ and $R_8$ may link together to form a 5-membered ring, 6-membered ring or spiro ring and $R_8$ and $R_9$ or $R_9$ and $R_{10}$ may link together to form a 5-membered ring, 6-membered ring or spiro ring.

2. The silver halide photographic material recited in claim 1, wherein:

R is an acyl group, alkyloxycarbonyl group or aryloxycarbonyl group.

3. The silver halide photographic material recited in claim 1, wherein:

R is an acyl group.

4. The silver halide photographic material recited in claim 1, wherein the compound of Formula IV has one of the following structures:

Formula (IV-1)

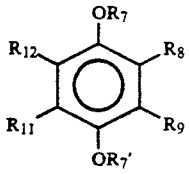

Formula (IV-5)

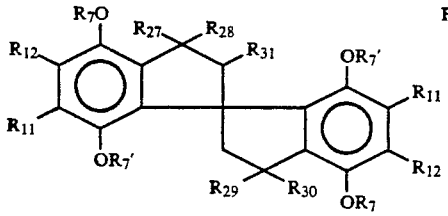

Formula (IV-6)

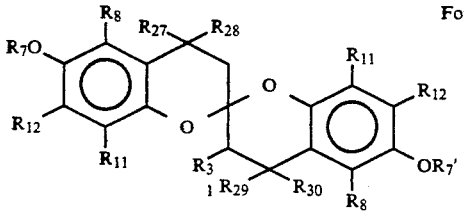

or

Formula (IV-7)

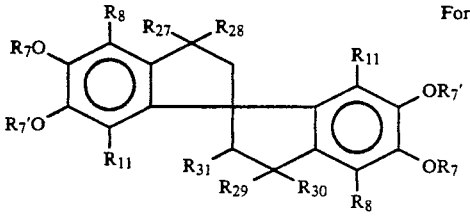

wherein $R_7$ and $R_{7'}$, same or different, are an alkyl or aryl group;

$R_8$, $R_9$, $R_{11}$ and $R_{12}$, same or different, are hydrogen atoms, alkyl groups or aryl groups; and $R_{27}$, $R_{28}$ $R_{29}$, $R_{30}$ and $R_{31}$, same or different, are hydrogen atoms, alkyl groups or aryl groups.

5. The silver halide photographic material recited in claim 1, wherein:

$R_1$ is an 2-alkoxyphenyl group;

$R_2$ is an alkyl group or an aryl group;

X is a hydrogen atom, a halogen atom, a group linked by an oxygen atom, a group linked by a nitrogen atom, or a group linked by a sulfur atom;

R is an acyl group;

A forms a 2, 2, 6, 6 tetramethylpiperidine group; and the compound of Formula (IV) is a compound having the structure:

Formula (IV-7)

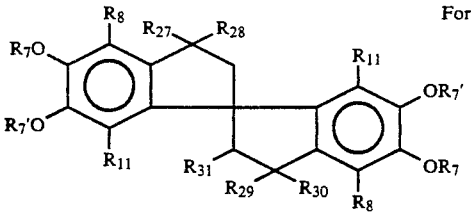

wherein $R_7$ and $R_{7'}$, same or different, are an alkyl or aryl groups;

$R_8$, $R_9$, $R_{11}$ and $R_{12}$ same or different, are hydrogen atoms, alkyl groups or aryl groups, and $R_{27}$, $R_{28}$, $R_{29}$, $R_{30}$ and $R_{31}$, same or different, are hydrogen atoms, alkyl groups or aryl groups.

6. The silver halide material recited in claim 1, further including in the same layer at least one compound having one of the following structures:

Formula (V)

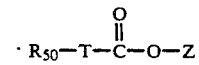

Formula (IV)

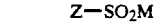

wherein $R_{50}$ is an alkyl group, alkenyl group, aryl group or heterocyclic group, T is —O— or a simple single bond, Z is an aryl group or heterocyclic group, and M is a hydrogen atom or a group of atoms which forms an inorganic or organic salt.

7. The silver halide photographic material recited in claim 6, wherein $R_{50}$ is an alkyl group;

Z is an aryl group; and

M is an inorganic salt.

8. The silver halide color photographic material recited in claim 1, wherein the compounds represented by formulas (I) and (II) are used in an amount of from $2\times10^{-3}$ to $5\times10^{-1}$ mol/mol of total silver contained in emulsion layers.

9. The silver halide color photographic material recited in claim 1, wherein the compound represented by formula (III) is used in an amount of from 5 to 300 mol % based on coupler.

10. The silver halide color photographic material recited in claim 1, wherein the compound represented by formula (IV) is used in an amount of from 10 to 400 mol % based on coupler.

11. The silver halide color photographic material recited in claim 1, wherein the compound represented by formula (V) is used in an amount of from 1 to 200 mol % based on coupler.

* * * * *